US007606709B2

(12) United States Patent
Yoshioka et al.

(10) Patent No.: US 7,606,709 B2
(45) **Date of Patent: *Oct. 20, 2009**

(54) VOICE CONVERTER WITH EXTRACTION AND MODIFICATION OF ATTRIBUTE DATA

(75) Inventors: Yasuo Yoshioka, Hamamatsu (JP); Hiraku Kayama, Hamamatsu (JP); Xavier Serra, Barcelona (ES); Jordi Bonada, Barcelona (ES)

(73) Assignees: Yamaha Corporation, Hamamatsu-shi (JP); Pompeu Fabra University, Barcelona (ES)

( * ) Notice: Subject to any disclaimer, the term of this patent is extended or adjusted under 35 U.S.C. 154(b) by 197 days.

This patent is subject to a terminal disclaimer.

(21) Appl. No.: 10/282,536

(22) Filed: Oct. 29, 2002

(65) Prior Publication Data

US 2003/0055646 A1 Mar. 20, 2003

Related U.S. Application Data

(62) Division of application No. 09/277,582, filed on Mar. 26, 1999, now abandoned.

(30) Foreign Application Priority Data

| | | |
|---|---|---|
| Jun. 15, 1998 | (JP) | 10-167590 |
| Jun. 15, 1998 | (JP) | 10-183338 |
| Jun. 16, 1998 | (JP) | 10-169045 |
| Jun. 22, 1998 | (JP) | 10-175038 |
| Oct. 15, 1998 | (JP) | 10-293844 |

(51) Int. Cl.
*G10L 13/00* (2006.01)
*G10L 21/00* (2006.01)

(52) U.S. Cl. ..... 704/258; 704/205

(58) Field of Classification Search ..... 704/200–201, 704/205, 207–209, 267–269, 258, 278; 84/622–625, 84/627

See application file for complete search history.

(56) References Cited

U.S. PATENT DOCUMENTS 4,754,679 A 7/1988 Suzuki (Continued)

FOREIGN PATENT DOCUMENTS

EP 0 260 053 A1 3/1988

(Continued)

OTHER PUBLICATIONS

Mizuno et al (1994), "Voice conversion based on piecewise linear conversion rules of formant frequency and spectrum tilt," 1994 IEEE International Conference on Acoustics, Speech and Signal Processing, (ICASSP-94), vol. 1, pp. 469-472.*

(Continued)

*Primary Examiner*—Angela A Armstrong
(74) *Attorney, Agent, or Firm*—Pillsbury Winthrop Shaw Pittman LLP

(57) ABSTRACT

An apparatus is constructed for converting an input voice signal into an output voice signal according to a target voice signal. In the apparatus, an input device provides the input voice signal composed of original sinusoidal components and original residual components other than the original sinusoidal components. An extracting device extracts original attribute data from at least the sinusoidal components of the input voice signal. The original attribute data is characteristic of the input voice signal. A synthesizing device synthesizes new attribute data based on both of the original attribute data derived from the input voice signal and target attribute data being characteristic of the target voice signal composed of target sinusoidal components and target residual components other than the sinusoidal components. The target attribute data is derived from at least the target sinusoidal components. An output device operates based on the new attribute data and either of the original residual component and the target residual component for producing the output voice signal.

9 Claims, 35 Drawing Sheets

U.S. PATENT DOCUMENTS

| | | | | |
|---|---|---|---|---|
| 5,327,521 | A | 7/1994 | Savic et al. | |
| 5,504,270 | A | 4/1996 | Sethares | |
| 5,536,902 | A * | 7/1996 | Serra et al. | 84/623 |
| 5,621,182 | A | 4/1997 | Matsumoto | |
| 6,336,092 | B1 | 1/2002 | Gibson et al. | |
| 7,149,682 | B2 * | 12/2006 | Yoshioka et al. | 704/205 |

FOREIGN PATENT DOCUMENTS

| | | |
|---|---|---|
| JP | 60-038698 | 2/1985 |
| JP | 5035278 | 2/1993 |
| JP | 05-313693 | 11/1993 |
| JP | 07-056598 | 3/1995 |
| JP | 60-084997 | 6/1995 |
| JP | 07-325583 | 12/1995 |
| JP | 08-263077 | 10/1996 |
| JP | 08-339184 | 12/1996 |
| JP | 09-258779 | 10/1997 |

OTHER PUBLICATIONS

Chuang et al (1996), "Glottal characteristics of male speakers: Acoustic correlates and comparison with female data," Journal of the Acoustical Society of America, Oct. 1996, 100(4), p. 2657.*

Mizuno et at (1994), "Voice conversion based on piecewise linear conversion rules of formant frequency and spectrum tilt," 1994 IEEE International Conference on Acoustics, Speech and Signal Processing, (ICASSP-94), vol. 1, pp. 469-472.*

Japan Patent Office, "Notice of Reasons for Rejection for Patent Application No. 10-183338," p. 1-3, (Jun. 10, 2003).

Japan Patent Office, "Notice for Reasons for Rejection for Patent Application No. 10-169045," p. 1-4, (Jun. 11, 2002).

Japan Patent Office, "Notice for Reasons for Rejection for Patent Application No. 10-167590," p. 1-4, (Apr. 9, 2002).

Japan Patent Office, "Notice of Reasons for Rejection for Patent Application No. 10-167590," p. 1-3, (Jun. 10, 2003).

Siegel and Bessey: "A Decision Tree Procedure for Voiced/Unvoiced/Mixed Excitation Classification of Speech", ICASSP 80 Proceedings. IEEE International Conference on Acoustics, Speech and Signal Processing, 1980-1980, pp. 53-56, XP002142509.

Asai et al.: "Voiced-Unvoiced Classification Using Weighted Distance Measures", Proceedings of the International Conference on Spoken Language Processing (ICSLP), JP, Tokyo, ASJ, Nov. 18, 1990, pp. 205-208, XP000503348.

McAulay R J et al: "Pitch Estimation and Voicing Detection Based on a Sinusoidal Speech Model1", International Conference on Acoustics, Speech & Signal Processing. ICASSP, US, New York, IEEE, vol. 1 Conf. 15, Apr. 3, 1990, pp. 249-253, XP000146452.

Arslan: "Speaker Transformation Algorithm Using Segmental Codebooks (STASC)", Speech Communication, 29 (1999) pp. 211-226, XP-002134217.

Notification of Reasons for Rejection issued Nov. 28, 2006 by Japanese Patent Office.

* cited by examiner f"n=fn*Pnew=fn*Pme*2

PRIOR ART

PRIOR ART

VOICE CONVERTER WITH EXTRACTION AND MODIFICATION OF ATTRIBUTE DATA

RELATED APPLICATIONS

This application is a divisional application of U.S. patent application Ser. No. 09/277,582, filed Mar. 26, 1999 now abandoned.

BACKGROUND OF THE INVENTION

The present invention generally relates to a voice converting apparatus and a voice converting method that make a voice simulate a target voice and, more particularly, to a voice converting apparatus and a voice converting method that are suitable for use in a karaoke apparatus.

The present invention also relates to a voice analyzing apparatus, a voice analyzing method and a recording medium with a voice analyzing program recorded thereon, which execute a voice/unvoice judgment on an input voice.

Various voice converting apparatuses have been developed by which the frequency characteristic and so on of an inputted voice are converted. For example, some karaoke apparatuses change the pitch of a singing voice to convert the same into a voice of opposite gender (as described in Publication of Translation of International Application No. Hei 8-508581, for example).

In the conventional voice converting apparatuses, however, voice conversion (for example, from male to female and vice versa) is executed only to change voice quality, not to simulate the voice of a particular singer (for example, a professional singer).

It would be amusing to have a karaoke apparatus provide a capability of simulating not only the voice quality but also singing mannerism of a particular singer. It has been impossible for the conventional karaoke apparatus to provide such a capability.

Conventionally, there have been proposed various voice conversion techniques to convert the pitch and voice quality by modifying attributes of a voice signal. FIG. 37 illustrates a first pitch converting method; FIG. 38 illustrates a second converting method.

As shown in FIG. 37, the first method is to execute such pitch conversion as to re-sample the waveform of an input voice signal and to compress or expand the waveform. According to this method, when the waveform is compressed, the pitch shifts up because of a rise in the basic frequency; while when it is expanded, the pitch shifts down because of a drop in the basic frequency.

On the other hand, as shown in FIG. 38 and according to the second method, the waveform of the input voice signal is extracted periodically and reconstructed at a desired pitch interval. This allows pitch conversion without changing frequency characteristics of the input voice signal.

In the above conventional methods, however, the voice conversion is insufficient to naturally convert a male voice to a female voice and vice versa. For example, if conversion is executed from the male voice to the female voice, the pitch must be raised by compressing the sampled signal as shown in FIG. 37, because the pitch of the female voice is typically higher than that of the male voice. Such pitch conversion, however, involves changing a frequency characteristic (formant) of the input voice signal. Since the pitch conversion is accompanied by changing the voice quality, natural and feminine voice quality has not been obtained by such conventional pitch conversion. On the other hand, if only the pitch is converted by the method shown in FIG. 38, the voice quality remains manly, not naturally feminine.

For voice quality conversion from a male voice to a female voice, a technique combining the above two methods, namely such a technique as to make the voice quality feminine by doubling the pitch and giving a certain amount of compression to a waveform extracted during one cycle has also been proposed. However, it has been difficult even for this technique to execute such voice conversion as to provide desired natural voice quality.

Further, in the above conventional techniques, all the voice conversion processing has been executed on the time axis, so that only waveforms of input voice signals have been able to be converted, resulting in low freedom of processing. This has also made it difficult to convert the voice quality and pitch naturally.

Conventionally, various techniques for voice/unvoice judgment on an input voice signal have been proposed in the field of voice analysis technology. Typical one of such techniques is to judge the input voice signal to be unvoiced when waveform zero-crossing counts obtained in a unit time is relatively great. There are also other judgment techniques, such as one using an auto-correlation function and one using a cepstrum analysis. Such techniques are described in "The Acoustic Analysis of Speech" (written by Ray D. Kent at al, the first edition dated May 10, 1996, published by Kaibundo).

Unvoiced sounds include not only strident sounds such as "s" but also plosive sounds such as "p". The above-mentioned judgment technique based on the zero crossing counts can discriminate the strident sounds (e.g., "s"), but not discriminate the plosive sounds (e.g., "p"). Even neither the method using the auto-correlation function nor the method using the cepstrum analysis has been sufficient for perfect judgment of the voiced and unvoiced sound. Thus, the conventional techniques involve a problem that the voice/unvoice judgment cannot be executed accurately.

SUMMARY OF THE INVENTION

It is therefore an object of the present invention to provide a voice converting apparatus and a voice converting method that allow the voice quality of a singer to simulate a target singer.

It is another object of the present invention to provide a voice converting apparatus and a voice converting method that allow the inputted voice of a singer to simulate the mannerism of a target singer.

It is still another object of the present invention to provide a voice converting apparatus and a voice converting method that allow voice conversion without losing naturalness of the voice.

It is a further object of the invention to provide a voice converting apparatus, a voice converting method. and a recording medium with a voice converting program recorded thereon, which allow high freedom of processing and more natural conversion of the voice quality and pitch.

It is a still further object of the invention to provide a voice analyzing apparatus, a voice analyzing method and a recording medium with a voice analyzing program recorded thereon, which allow an accurate voice/unvoice judgment.

In a first aspect of the invention, an apparatus for converting an input voice signal into an output voice signal according to a target voice signal comprises an input device that provides the input voice signal composed of an original sinusoidal component and an original residual component other than the original sinusoidal component, an extracting device that extracts original attribute data from at least the sinusoidal component of the input voice signal, the original attribute data being characteristic of the input voice signal, a synthesizing device that synthesizes new attribute data based on both of the original attribute data derived from the input voice signal and target attribute data being characteristic of the target voice signal composed of a target sinusoidal component and a target residual component other than the sinusoidal component, the target attribute data being derived from at least the target sinusoidal component, and an output device that operates based on the new attribute data and either of the original residual component and the target residual component for producing the output voice signal.

Preferably, the extracting device extracts the original attribute data containing at least one of amplitude data representing an amplitude of the input voice signal, pitch data representing a pitch of the input voice signal, and spectral shape data representing a spectral shape of the input voice signal.

Preferably, the extracting device extracts the original attribute data containing the amplitude data in the form of static amplitude data representing a basic variation of the amplitude and vibrato-like amplitude data representing a minute variation of the amplitude, superposed on the basic variation of the amplitude.

Preferably, the extracting device extracts the original attribute data containing the pitch data in the form of static pitch data representing a basic variation of the pitch and vibrato-like pitch data representing a minute variation of the pitch, superposed on the basic variation of the pitch.

Preferably, wherein the synthesizing device operates based on both of the original attribute data composed of a set of original attribute data elements and the target attribute data composed of another set of target attribute data elements in correspondence with one another to define each corresponding pair of the original attribute data element and the target attribute data element, such that the synthesizing device selects one of the original attribute data element and the target attribute data element from each corresponding pair for synthesizing the new attribute data composed of a set of new attribute data elements each selected from each corresponding pair.

Preferably, the synthesizing device operates based on both of the original attribute data composed of a set of original attribute data elements and the target attribute data composed of another set of target attribute data elements in correspondence with one another to define each corresponding pair of the original attribute data element and the target attribute data element, such that the synthesizing device interpolates with one another the original attribute data element and the target attribute data element of each corresponding pair for synthesizing the new attribute data composed of a set of new attribute data elements each interpolated from each corresponding pair.

Preferably, the inventive apparatus further comprises a peripheral device that provides the target attribute data containing pitch data representing a pitch of the target voice signal at a standard key, and a key control device that operates when a user key different than the standard key is designated to the input voice signal for adjusting the pitch data according to a difference between the standard key and the user key.

Preferably, the inventive apparatus further comprises a peripheral device that provides the target attribute data divided into a sequence of frames arranged at a standard tempo of the target voice signal, and a tempo control device that operates when a user tempo different than the standard tempo is designated to the input voice signal for adjusting the sequence of the frames of the target attribute data according to a difference between the standard tempo and the user tempo, thereby enabling the synthesizing device to synthesize the new attribute data based on both of the original attribute data and the target attribute data synchronously with each other at the user tempo designated to the input voice signal.

Preferably, the tempo control device adjusts the sequence of the frames of the target attribute data according to the difference between the standard tempo and the user tempo, such that an additional frame of the target attribute data is filled into the sequence of the frames of the target attribute data by interpolation of the target attribute data so as to match with a sequence of frames of the original attribute data provided from the extracting device.

Preferably, the inventive apparatus further comprises a synchronizing device that compares the target attribute data provided in the form of a first sequence of frames with the original attribute data provided in the form of a second sequence of frames so as to detect a false frame that is present in the second sequence but is absent from the first sequence, and that selects a dummy frame occurring around the false frame in the first sequence so as to compensate for the false frame, thereby synchronizing the first sequence containing the dummy frame to the second sequence containing the false frame.

Preferably, the synthesizing device modifies the new attribute data so that the output device produces the output voice signal based on the modified new attribute data.

Preferably, the synthesizing device synthesizes additional attribute data in addition to the new attribute so that the output device concurrently produces the output voice signal based on the new attribute data and an additional voice signal based on the additional attribute data in a different pitch than that of the output voice signal.

In a second aspect of the invention, an apparatus for converting an input voice signal into an output voice signal according to a target voice signal comprises an input device that provides the input voice signal composed of original sinusoidal components and original residual components other than the original sinusoidal components, a separating device that separates the original sinusoidal components and the original residual components from each other, a first modifying device that modifies the original sinusoidal components based on target sinusoidal components contained in the target voice signal so as to form new sinusoidal components having a first pitch, a second modifying device that modifies the original residual components based on target residual components contained in the target voice signal other than the target sinusoidal components so as to form new residual components having a second pitch, a shaping device that shapes the new residual components by removing therefrom a fundamental tone corresponding to the second pitch and overtones of the fundamental tone, and an output device that combines the new sinusoidal components and the shaped new residual components with each other for producing the output voice signal having the first pitch.

Preferably, the shaping device removes the fundamental tone corresponding to the second pitch which is identical to one of a pitch of the original sinusoidal components, a pitch of the target sinusoidal components, and a pitch of the new sinusoidal components.

Preferably, the shaping device comprises a comb filter having a series of peaks of attenuating frequencies corresponding to a series of the fundamental tone and the overtones for filtering the new residual components along a frequency axis.

Preferably, the shaping device comprises a comb filter having a delay loop creating a time delay equivalent to an inverse of the second pitch for filtering the residual components along a time axis so as to remove the fundamental tone and the overtones.

In a third aspect of the invention, an apparatus for converting an input voice signal into an output voice signal according to a target voice signal comprises an input device that provides the input voice signal composed of original sinusoidal components and original residual components other than the original sinusoidal components, a separating device that separates the original sinusoidal components and the original residual components from each other, a first modifying device that modifies the original sinusoidal components based on target sinusoidal components contained in the target voice signal so as to form new sinusoidal components, a second modifying device that modifies the original residual components based on target residual components contained in the target voice signal other than the target sinusoidal components so as to form new residual components, a shaping device that shapes the new residual components by introducing thereinto a fundamental tone and overtones of the fundamental tone corresponding to a desired pitch, and an output device that combines the new sinusoidal components and the shaped new residual components with each other for producing the output voice signal.

Preferably, the shaping device introduces the fundamental tone corresponding to the desired pitch which is identical to a pitch of the new sinusoidal components.

Preferably, the shaping device comprises a comb filter having a series of peaks of pass frequencies corresponding to a series of the fundamental tone and the overtones for filtering the new residual components along a frequency axis.

Preferably, the shaping device comprises a comb filter having a delay loop creating a time delay equivalent to an inverse of the desired pitch for filtering the residual components along a time axis so as to introduce the fundamental tone and the overtones.

In a fourth aspect of the invention, an apparatus for converting an input voice signal into an output voice signal by modifying a spectral shape comprises an input device that provides the input voice signal containing wave components, an separating device that separates sinusoidal ones of the wave components from the input voice signal such that each sinusoidal wave component is identified by a pair of a frequency and an amplitude, a computing device that computes a spectral shape of the input voice signal based on a set of the separated sinusoidal wave components such that the spectral shape represents an envelope having a series of break points corresponding to the pairs of the frequencies and the amplitudes of the sinusoidal wave components, a modifying device that modifies the spectral shape to form a new spectral shape having a modified envelope, a generating device that selects a series of points along the modified envelope of the new spectral shape and that generates a set of new sinusoidal wave components each identified by each pair of a frequency and an amplitude, which corresponds to each of the series of the selected points, and an output device that produces the output voice signal based on the set of the new sinusoidal wave components.

Preferably, the output device produces the output voice signal based on the set of the new sinusoidal wave components and residual wave components, which are a part of the wave components of the input voice signal other than the sinusoidal wave components.

Preferably, the modifying device forms the new spectral shape by shifting the envelope along an axis of the frequency on a coordinates system of the frequency and the amplitude.

Preferably, the modifying device forms the new spectral shape by changing a slope of the envelope.

Preferably, the generating device comprises a first section that determines a series of frequencies according to a specific pitch of the output voice signal, and a second section that selects the series of the points along the modified envelope in terms of the series of the determined frequencies, thereby generating the set of the new sinusoidal wave components corresponding to the series of the selected points and having the determined frequencies.

Preferably, the modifying device modifies the spectral shape to form the new spectral shape according to a specific pitch of the output voice signal such that a modification degree of the frequency or the amplitude of the spectral shape is determined in function of the specific pitch of the output voice signal.

Preferably, the apparatus further comprises a vibrating device that periodically varies the specific pitch of the output voice signal.

Preferably, the output device produces a plurality of the output voice signals having different pitches, and wherein the modifying device modifies the spectral shape to form a plurality of the new spectral shapes in correspondence with the different pitches of the plurality of the output voice signals.

Preferably, the generating device comprises a first section that selects the series of the points along the modified envelope of the new spectral shape in which each selected point is denoted by a pair of a frequency and an normalized amplitude calculated using a mean amplitude of the sinusoidal wave components of the input voice signal, and a second section that generates the set of the new sinusoidal wave components in correspondence with the series of the selected points such that each new sinusoidal wave component has a frequency and an amplitude calculated from the corresponding normalized amplitude with using a specific mean amplitude of the new sinusoidal wave components of the output voice signal.

Preferably, the apparatus further comprises a vibrating device that periodically varies the specific mean amplitude of the new sinusoidal wave components of the output voice signal.

Preferably, an inventive apparatus for converting an input voice signal into an output voice signal dependently on a predetermined pitch of the output voice signal comprises an input device that provides the input voice signal containing wave components, an separating device that separates sinusoidal ones of the wave components from the input voice signal such that each sinusoidal wave component is identified by a pair of a frequency and an amplitude, a computing device that computes a modification amount of at least one of the frequency and the amplitude of the separated sinusoidal wave components according to the predetermined pitch of the output voice signal, a modifying device that modifies at least one of the frequency and the amplitude of the separated sinusoidal wave components by the computed modification amount to thereby form new sinusoidal wave components, and an output device that produces the output voice signal based on the new sinusoidal wave components.

In a fifth aspect of the invention, an apparatus for discriminating between a voiced state and an unvoiced state at each frame of a voice signal having a waveform oscillating around a zero level with a variable energy comprises a zero-cross detecting device that detects a zero-cross point at which the waveform of the voice signal crosses the zero level and that counts a number of the zero-cross points detected within each frame, an energy detecting device that detects the energy of the voice signal per each frame, and an analyzing device operative at each frame to determine that the voice signal is placed in the unvoiced state, when the counted number of the zero-cross points is equal to or greater than a lower zero-cross threshold and is smaller than an upper zero-cross threshold, and when the detected energy of the voice signal is equal to or greater than a lower energy threshold and is smaller than an upper energy threshold.

Preferably, the analyzing device determines that the voice signal is placed in the unvoiced state when the counted number of the zero-cross points is equal to or greater than the upper zero-cross threshold regardless of the detected energy, and determines that the voice signal is placed in a silent state other than the voiced state and the unvoiced state when the detected energy of the voice signal is smaller than the lower energy threshold regardless of the counted number of the zero-cross points.

Preferably, the zero-cross detecting device counts the number of the zero-cross points in terms of a zero-cross factor calculated by dividing the number of the zero-crossing points by a number of sample points of the voice signal contained in one frame, and the energy detecting device detects the energy in terms of an energy factor calculated by accumulating absolute energy values at the sample points throughout one frame and further by dividing the accumulated results by the number of the sample points of the voice signal contained in one frame the.

Preferably, an apparatus for discriminating between a voiced state and an unvoiced state at each frame of a voice signal comprises a wave detecting device that processes each frame of the voice signal to detect therefrom a plurality of sinusoidal wave components, each of which is identified by a pair of a frequency and an amplitude, a separating device that separates the detected sinusoidal wave components into a higher frequency group and a lower frequency group at each frame by comparing the frequency of each sinusoidal wave component with a predetermined reference frequency, and an analyzing device operative at each frame to determine whether the voice signal is placed in the voiced state or the unvoiced state based on an amplitude related to at least one sinusoidal wave component belonging to the higher frequency group.

Preferably, the analyzing device determines that the voice signal is placed in the unvoiced state when a sinusoidal wave component having the greatest amplitude belongs to the higher frequency group.

Preferably, the analyzing device determines whether the voice signal is placed in the voiced state or the unvoiced state based on a ratio of a mean amplitude of the sinusoidal wave components belonging to the higher frequency group relative to a mean amplitude of the sinusoidal wave components belonging to the lower frequency group.

Preferably, an apparatus for discriminating between a voiced state and an unvoiced state at each frame of a voice signal having a waveform composed of sinusoidal wave components and oscillating around a zero level with a variable energy comprises a zero-cross detecting device that detects a zero-cross point at which the waveform of the voice signal crosses the zero level and that counts a number of the zero-cross points detected within each frame, an energy detecting device that detects the energy of the voice signal per each frame, a first analyzing device operative at each frame to determine that the voice signal is placed in the unvoiced state, when the counted number of the zero-cross points is equal to or greater than a lower zero-cross threshold and is smaller than an upper zero-cross threshold, and when the detected energy of the voice signal is equal to or greater than a lower energy threshold and is smaller than an upper energy threshold, a wave detecting device that processes each frame of the voice signal to detect therefrom a plurality of sinusoidal wave components, each of which is identified by a pair of a frequency and an amplitude, a separating device that separates the detected sinusoidal wave components into a higher frequency group and a lower frequency group at each frame by comparing the frequency of each sinusoidal wave component with a predetermined reference frequency, and a second analyzing device operative at each frame when the first analyzing device does not determine that the voice signal is placed in the unvoiced state for determining whether the voice signal is placed in the voiced state or the unvoiced state based on an amplitude related to at least one sinusoidal wave component belonging to the higher frequency group.

Preferably, the first analyzing device determines that the voice signal is placed in the unvoiced state when the counted number of the zero-cross points is equal to or greater than the upper zero-cross threshold regardless of the detected energy, and determines that the voice signal is placed in a silent state other than the voiced state and the unvoiced state when the detected energy of the voice signal is smaller than the lower energy threshold regardless of the counted number of the zero-cross points.

DETAILED DESCRIPTION OF THE INVENTION

Figure 1:
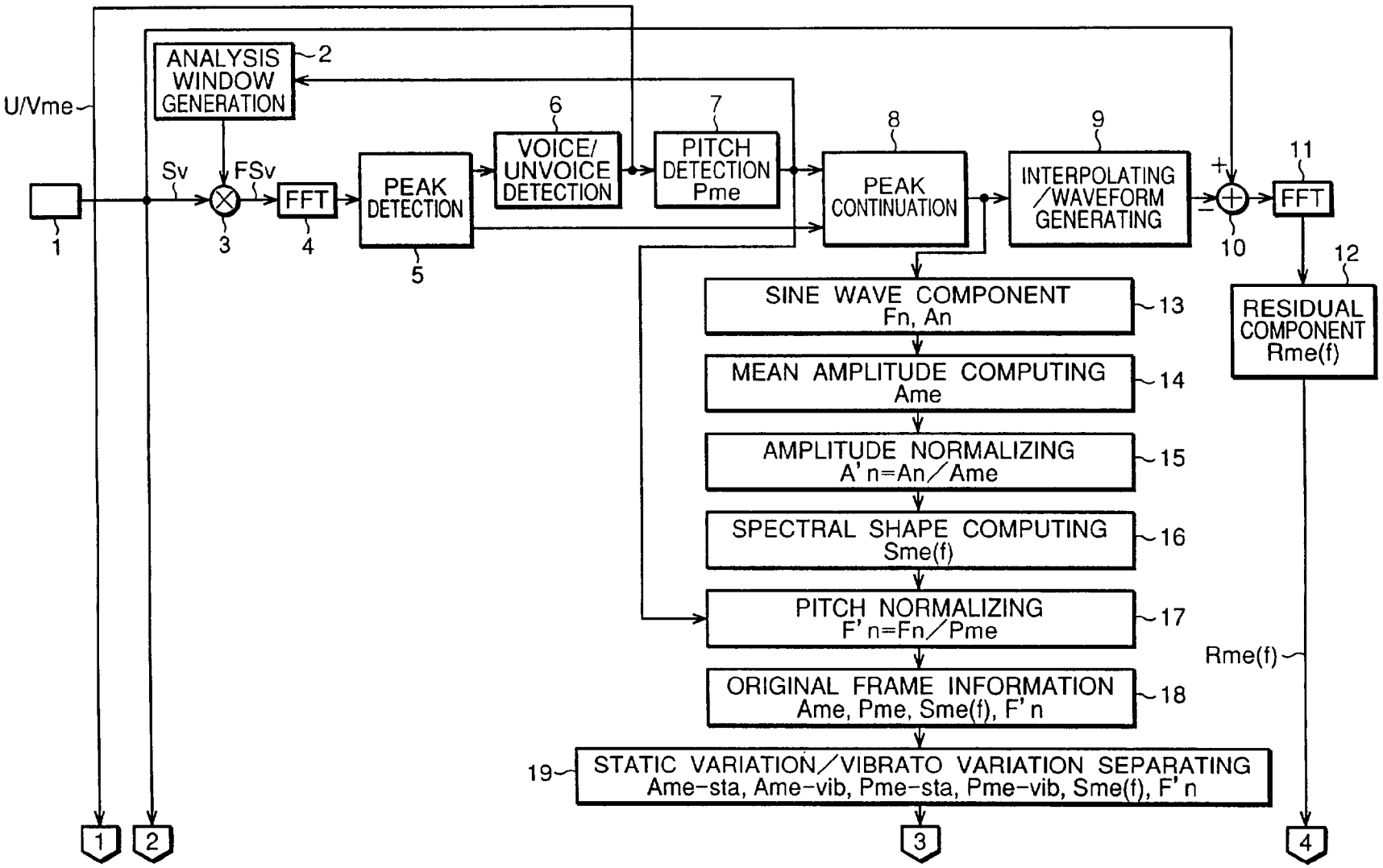
FIG. 1 is a block diagram illustrating a constitution of a first preferred embodiment of the invention.

This invention will be described in further detail by way of example with reference to the accompanying drawings.

[1] Outline of Voice Conversion Process in First Embodiment

[1.1] Step S1

First, the voice (namely the input voice signal) of a singer who wants to mimic another singer is analyzed real-time by SMS (Spectral Modeling Synthesis) including FFT (Fast Fourier Transform) to extract sine wave components on a frame basis. At the same time, residual components are separated from the input voice signal other than the sine wave components on a frame basis. Concurrently, it is determined whether the input voice signal includes an unvoiced sound. If the decision is yes, the processing of steps S2 through S6 is skipped, and the input voice signal is outputted without change or modification. In the above-mentioned SMS analysis, pitch sync analysis is employed such that an analysis window width of a current frame is changed according to the pitch in a previous frame.

[1.2] Step S2

If the input voice signal is a voiced sound, the pitch, amplitude, and spectral shape, which are original or source attributes, are further extracted from the extracted sine wave components. The extracted pitch and amplitude are separated into a vibrato part and a stable part other than the vibrato part.

[1.3] Step S3

From provisionally stored attribute data of a target singer (target attribute data=pitch, amplitude, and spectral shape), the target data (pitch, amplitude, and spectral shape) of the frame corresponding to the frame of the input voice signal of a singer (me) who wants to mimic the target singer is taken. In this case, if the target attribute data of the frame corresponding to the frame of the input voice signal of the mimicking singer (me) does not exist, the target attribute data is generated according to a predetermined easy synchronization rule as will be described later in detail.

[1.4] Step S4

The source or original attribute data corresponding to the mimicking singer (me) and the target attribute data corresponding to the target singer are appropriately selected and combined together to obtain new attribute data (pitch, amplitude, and spectral shape). It should be noted that, if these items of data are not used for mimicking but used for simple voice conversion, the new attribute data may be obtained by computation based on-both the source and target attribute data by executing arithmetic operation on the source attribute data and the target attribute data.

[1.5] Step S5

Based on the obtained new attribute data, the sine wave components of the frame concerned are obtained.

[1.6] Step S6

Inverse FFT is executed based on the obtained sine wave components and/or the stored residual components of the target singer to obtain a converted voice signal.

[1.7] Summary

As described above, according to the first aspect of the invention, the inventive method of converting an input voice signal into an output voice signal according to a target voice signal comprises the steps of providing the input voice signal composed of an original sinusoidal component and an original residual component other than the original sinusoidal component, extracting original attribute data from at least the sinusoidal component of the input voice signal, the original attribute data being characteristic of the input voice signal, synthesizing new attribute data based on both of the original attribute data derived from the input voice signal and target attribute data being characteristic of the target voice signal composed of a target sinusoidal component and a target residual component other than the sinusoidal component, the target attribute data being derived from at least the target sinusoidal component, and producing the output voice signal based on the new attribute data and either of the original residual component and the target residual component. According to the converted voice signal obtained by the above-mentioned method, the reproduced voice sounds like that of the target singer rather other than the mimicking singer.

[2] Detail Constitution of the First Embodiment

Figure 2:
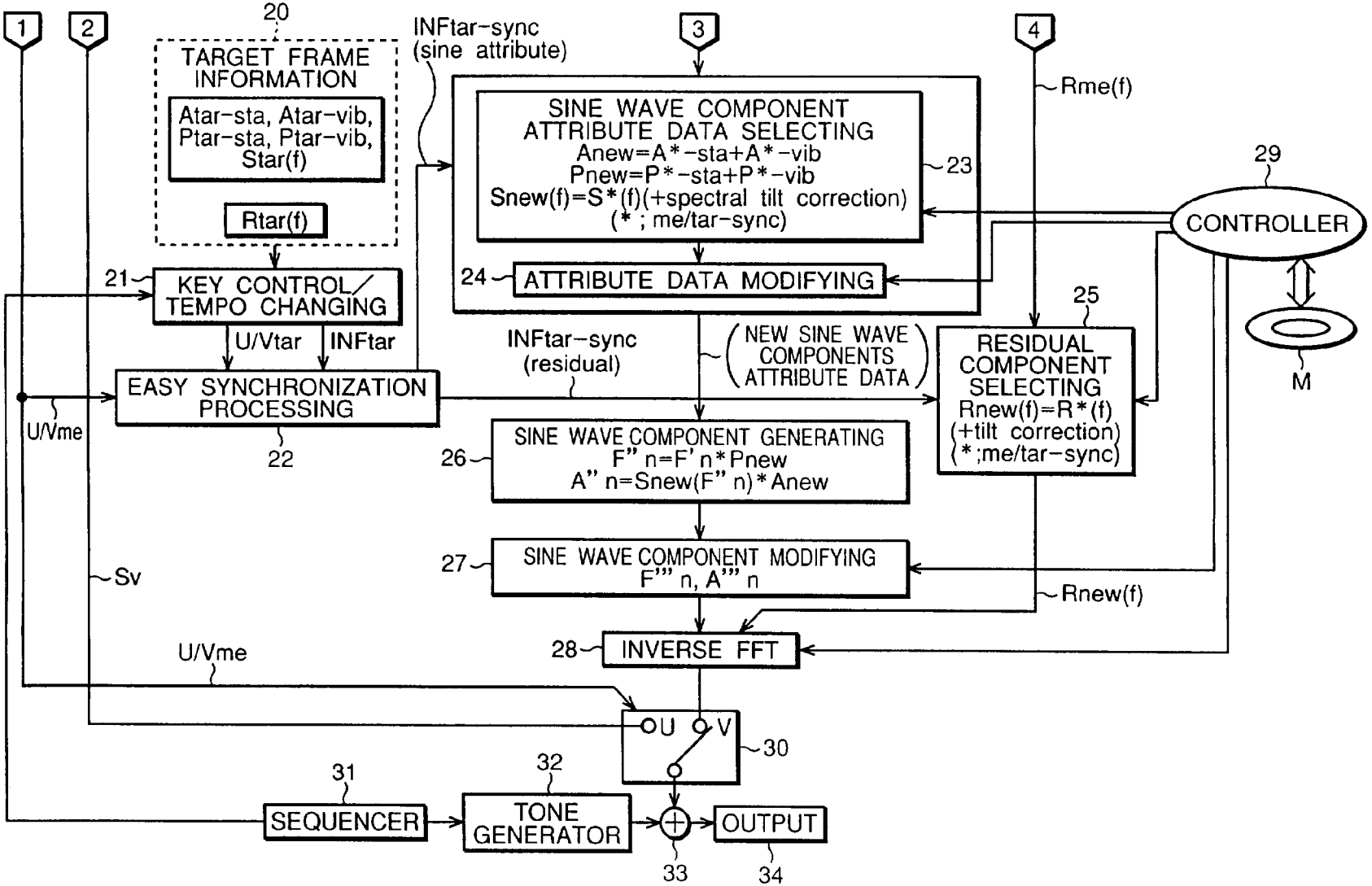
FIG. 2 is another block diagram illustrating the constitution of the above-mentioned preferred embodiment.

Referring to FIGS. 1 and 2, there is shown a detailed constitution of the first embodiment. It should be noted that the present embodiment is an example in which the voice converting apparatus (voice converting method) according to the invention is applied to a karaoke apparatus that allows a singer to mimic a particular singers. Namely, the inventive apparatus is constructed for converting an input voice signal into an output voice signal according to a target voice signal. In the inventive apparatus, an input device including a microphone 1 provides the input voice signal composed of an original sinusoidal component and an original residual component other than the original sinusoidal component. An extracting device including blocks 13-18 extracts original attribute data from at least the sinusoidal component of the input voice signal. The original attribute data is characteristic of the input voice signal. A synthesizing device including blocks 20-24 synthesizes new attribute data based on both of the original attribute data derived from the input voice signal and target attribute data being characteristic of the target voice signal composed of a target sinusoidal component and a target residual component other than the sinusoidal component. The target attribute data is derived from at least the target sinusoidal component. An output device including blocks 25-28 operates based on the new attribute data and either of the original residual component and the target residual component for producing the output voice signal. Further, a machine readable medium M can be used in a computer machine of the inventive apparatus having a CPU in a controller block 29. The medium M contains program instructions executable by the CPU to cause the computer machine for performing a process of converting an input voice signal into an output voice signal according to a target voice signal as described above.

More particularly, as shown in FIG. 1, the microphone 1 picks up the voice of a mimicking singer (me) and outputs an input voice signal Sv to an input voice signal multiplier 3. Concurrently, an analysis window generator 2 generates an analysis window (for example, a Hamming window) AW having a period which is a fixed multiplication (for example, 3.5 times) of the period of the pitch detected in the last frame, and outputs the generated AW to the input voice signal multiplier 3. It should be noted that, in the initial state or if the last frame is an unvoiced sound (including no tone or soundless), an analysis window having a preset fixed period is outputted to the input voice signal multiplier 3 as the analysis window AW.

Then, the input voice signal multiplier 3 multiplies the inputted analysis window AW by the input voice signal Sv to extract the input voice signal Sv on a frame basis, thereby outputting the same to a FFT 4 as a frame voice signal FSv. To be more specific, the relationship between the input voice signal Sv and frames is shown in FIG. 3, in which each frame FL is set so as to partially overlap a preceding frame.

Figure 4:
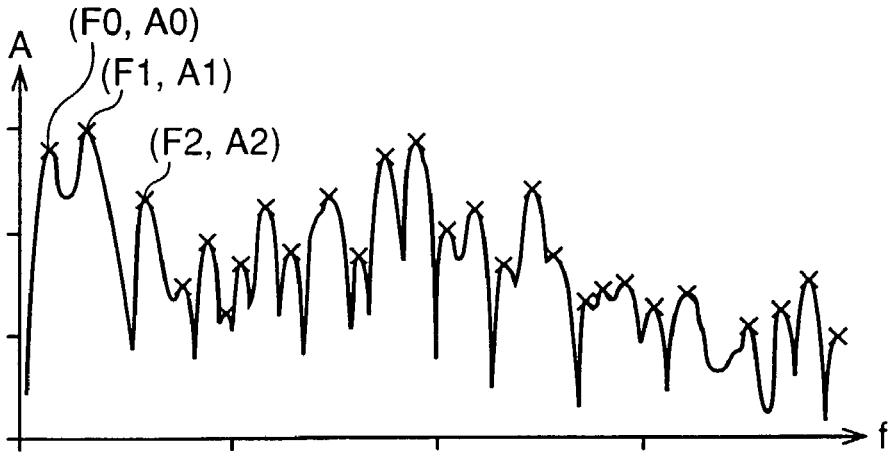
FIG. 4 is a diagram for describing frequency spectrum peak detection in the above-mentioned embodiment.

In the FFT 4, the frame voice signal FSv is analyzed. At the same time, a local peak is detected by a peak detector 5 from a frequency spectrum, which is the output of the FFT 4. To be more specific, relative to the frequency spectrum as shown in FIG. 4, local peaks indicated by "x" are detected. Each local peak is represented as a combination of a frequency value and an amplitude value. Namely, as shown in FIG. 4, local peaks are detected in each frame as represented by (F0, A0), (F1, A1), (F2, A2), . . . , (FN, AN).

Figure 3:
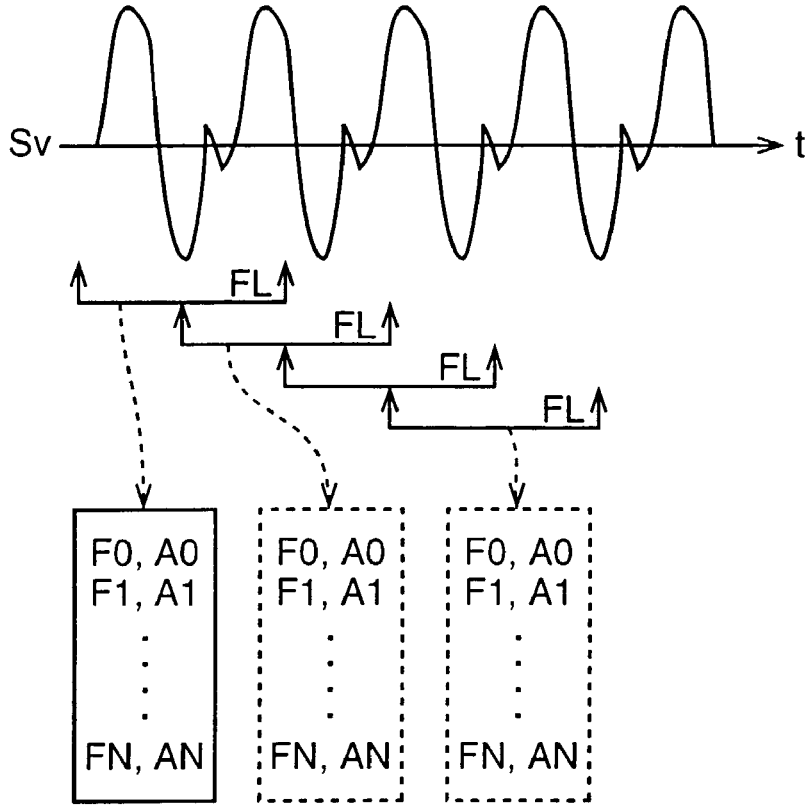
FIG. 3 is a diagram illustrating states of frames in the above-mentioned embodiment.

Then, as schematically shown in FIG. 3, the pairs (F0, A0), (F1, A1), (F2, A2), . . . , (FN, AN) (hereafter, each referred to as a local peak pair) in each frame are outputted to an unvoice/voice detector 6 and a peak continuation block 8.

Based on the inputted local peaks of each frame, the unvoice/voice detector 6 detects an unvoiced sound ('t', 'k' and so on) according to the magnitude of high frequency components among the local pairs, and outputs an unvoice/voice detect signal U/Vme to a pitch detector 7, an easy synchronization processor 22, and a cross fader 30. Alternatively, the unvoice/voice detector 6 detects an unvoiced sound ('s' and so on) according to zero-cross counts in a unit time along the time axis, and outputs the source unvoice/voice detect signal U/Vme to the pitch detector 7, the easy synchronization processor 22, and the cross fader 30.

Further, if the inputted frame is found not unvoiced, the unvoice/voice detector 6 outputs the inputted set of the local peak pairs to the pitch detector 7 directly. Based on the inputted local peak pairs, the pitch detector 7 detects the pitch Pme of the frame corresponding to that local peak pair set. A more specific frame pitch Pme detecting method is disclosed in "Fundamental Frequency Estimation of Musical Signal using a two-way Mismatch Procedure," Maher, R. C. and J. W. Beauchamp (Journal of Acoustical Society of America 95(4), 2254-2263).

Next, the local peak pair set outputted from the peak detector 5 is checked by the peak continuation block 8 for linking peaks between consecutive frames so as to establish peak continuation. If the peak continuation is found, the local peaks are linked to form a data sequence.

Figure 5:
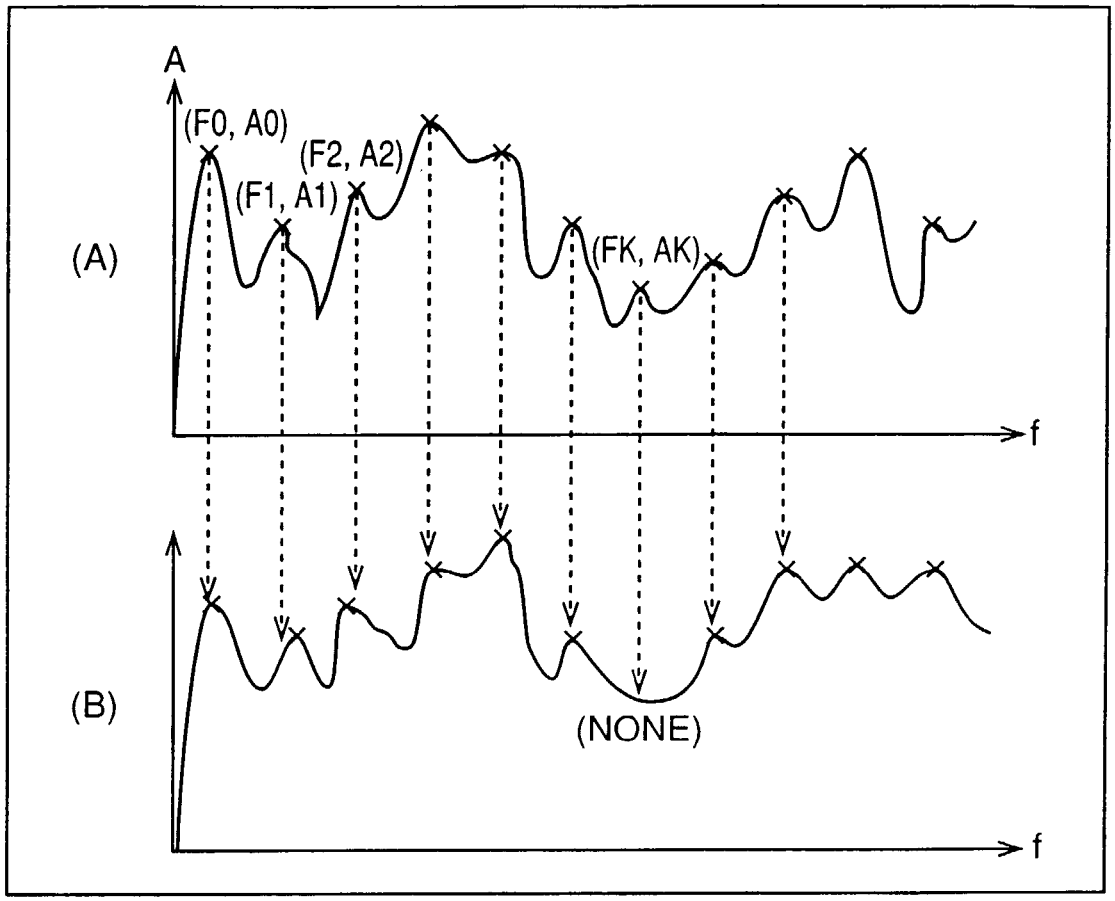
FIG. 5 is a diagram illustrating linking of peak values of frames in the above-mentioned embodiment.

The following describes the link processing or the peak continuation with reference to FIG. 5. Here it is assumed that the peaks as shown in FIG. 5(A) be detected in the last frame and the local peaks as shown in FIG. 5(B) be detected in the current frame. In this case, the peak continuation block 8 checks whether the local peaks corresponding to the local peaks (F0, A0), (F1, A1), (F2, A2), . . . , (FN, AN) detected in the last frame have also detected in the current frame. This check is made by determining whether the local peaks of the current frame are detected in a predetermined range around the frequency of the local peaks detected in the last frame. To be more specific, in the example of FIG. 5, as for the local peaks (F0, A0), (F1, A1), (F2, A2), and so on, the corresponding local peaks have been detected. As for a local peak (FK, AK) (refer to FIG. 5(A)), no corresponding local peak has been detected (refer to FIG. 5(B)). If corresponding local peaks have been detected, the peak continuation block 8 links the detected local peaks in the order of time, and outputs a pair of data sequences. If no local peak has been detected, the peak continuation block 8 provides data indicating that there is no corresponding local peak in that frame.

Figure 6:
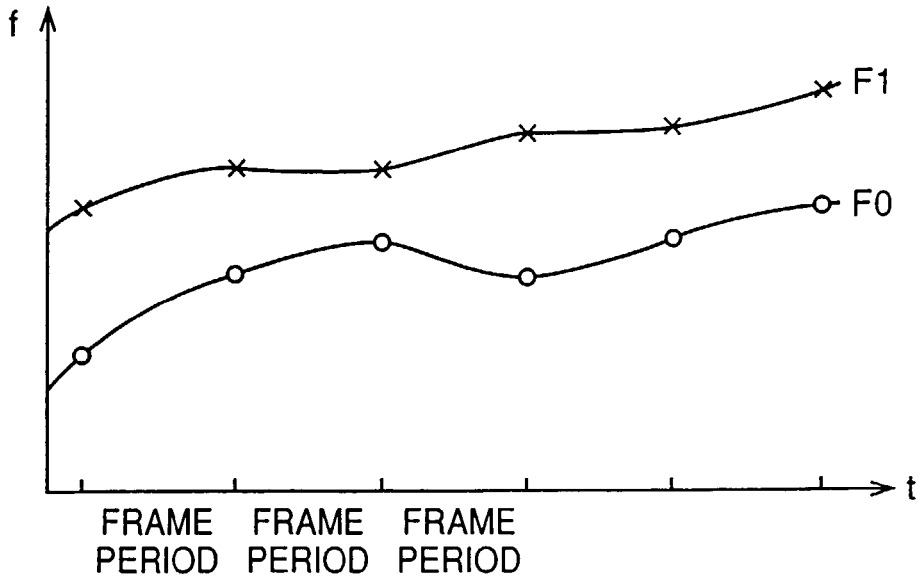
FIG. 6 is a diagram illustrating a changing state of frequency values in the above-mentioned embodiment.

FIG. 6 shows an example of changes in the frequencies F0 and F1 of the local peaks along two or more frames. These changes are also recognized with respect to amplitudes A0, A1, A2, and so on. In this case, the data sequence outputted from the peak continuation block 8 represents a discrete value to be outputted in every interval between frames. It should be noted that the peak value outputted from the peak continuation block 8 is hereafter referred to as a deterministic component or an established component. This denotes the component that is definitely replaced as a sine wave component of the source voice signal Sv. Each of the replaced sine waves (strictly, frequency and amplitude that are sine wave parameters) is hereafter referred to as a sine wave component or sinusoidal wave component.

An interpolator/waveform generator 9 interpolates the deterministic components outputted from the peak continuation block 8 and, based on the interpolated deterministic components, the interpolator/waveform generator 9 executes waveform generation according to a so-called oscillating method. The interpolation interval used in this case is the sampling rate (for example, 44.1 KHz) of a final output signal of an output block 34 to be described later. The solid lines shown in FIG. 6 show images indicative of the interpolation executed on the frequencies F0 and F1 of the sine wave components.

[2.1] Constitution of the Interpolator/Waveform Generator

Figure 7:
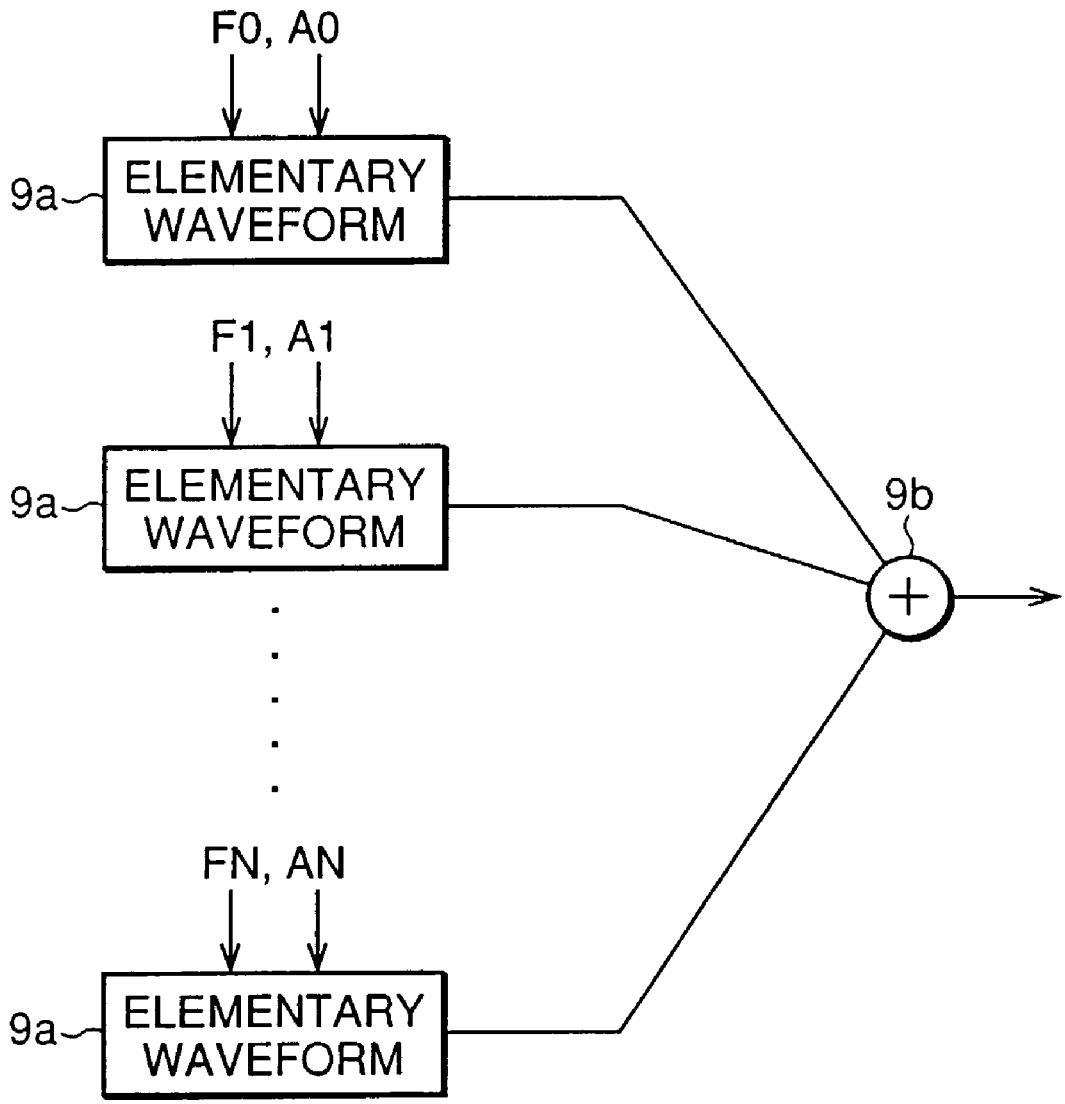
FIG. 7 is a diagram illustrating a changing state of an established component in the course of processing in the above-mentioned embodiment.

The following describes a constitution of the interpolator/waveform generator 9 with reference to FIG. 7. As shown, the interpolator/waveform generator 9 comprises a plurality of elementary waveform generators 9*a*, each elementary waveform generator 9*a* generating a sine wave corresponding to the frequency (F0, F1, and so on) and amplitude (A0, A1, and so on) of a specified sine wave component. However, because the sine wave components (F0, A0), (F1, A1), (F2, A2), and so on vary in the present first embodiment of the invention change from time to time according to interpolation interval, the waveforms to be outputted from the elementary waveform generators 9*a* may shift. Namely, the peak continuation block 8 sequentially outputs sine wave components (F0, A0), (F1, A1), (F2, A2), and so on, each being interpolated, so that each elementary waveform generator 9*a* outputs a waveform of which frequency and amplitude vary within a predetermined frequency range. Then, the waveforms outputted from the elementary waveform generators 9*a* are added together by an adder 9*a*. Consequently, the output signal of the interpolator/waveform generator 9 becomes a synthesized signal $S_{SS}$ of the sine wave components obtained by extracting the established components from the input voice signal Sv.

[2.2] Operation of Residual Component Detector

Then, a residual component detector 10 generates a residual component signal $S_{RD}$ (time domain waveform), which is a difference between the sine wave component synthesized signal $S_{SS}$ and the input voice signal Sv. This residual component signal $S_{RD}$ includes an unvoiced component included in a voice. On the other hand, the above-mentioned sine wave component synthesized signal $S_{SS}$ corresponds to a voiced component.

Meanwhile, mimicking the voice of a target singer requires to process voiced sounds; it seldom requires to process unvoiced sounds. Therefore, in the present embodiment, the voice conversion is executed on the deterministic components corresponding to a voiced vowel component. To be more specific, the residual component signal $S_{RD}$ is converted by the FFT 11 into a frequency waveform, and the obtained residual component signal (the frequency domain waveform) is held in a residual component holding block 12 as Rme(f).

[2.3] Operation of Mean Amplitude Computing Block

Figure 8:
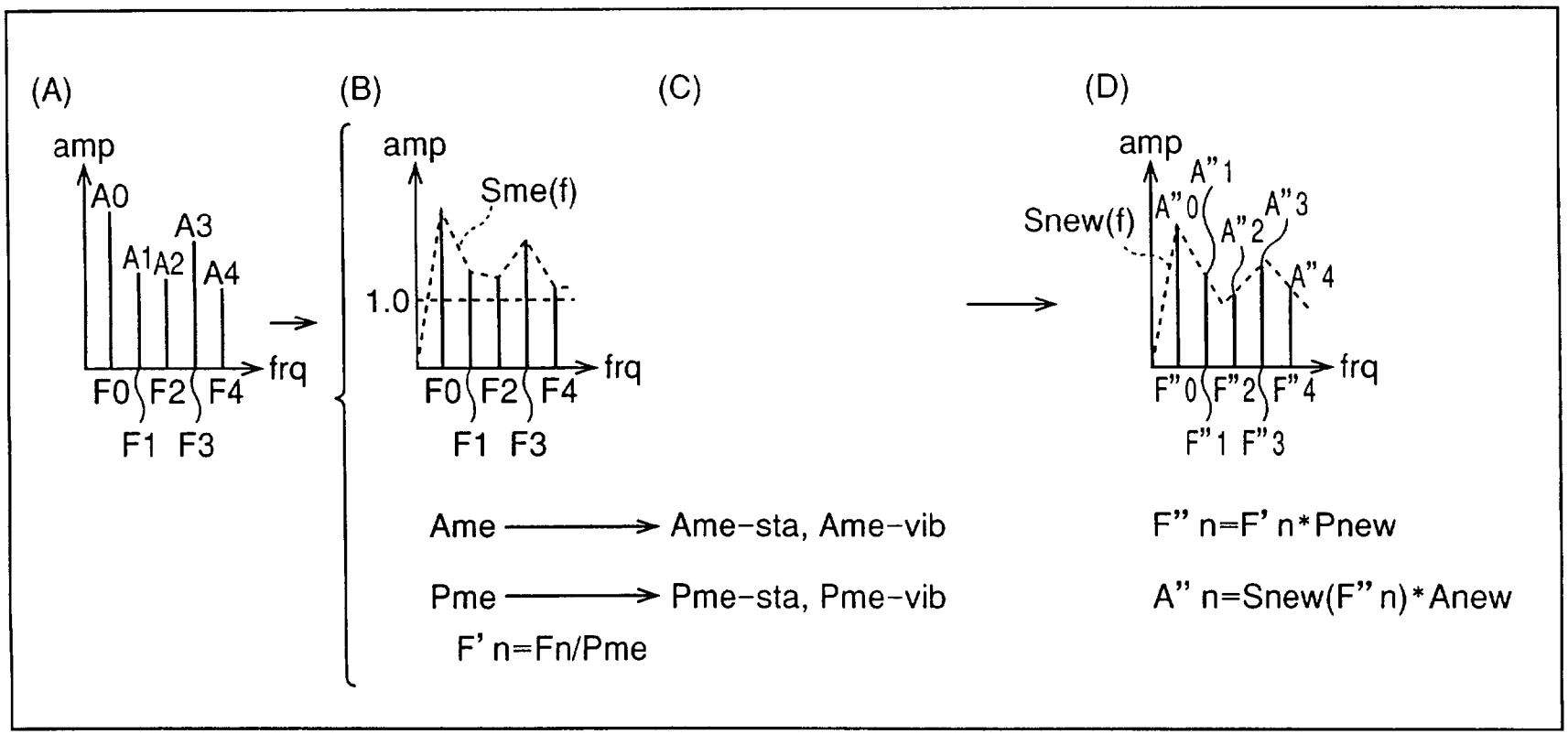
FIG. 8 is a diagram for describing signal processing in the above-mentioned embodiment.

On the other hand, as shown in FIG. 8(A), N sine wave components (F0, A0), (F1, A1), (F2, A2), and so on (hereafter generically represented as Fn, An, n=0 to (N−1)) outputted from the peak detector 5 through the peak continuation block 8 are held in the sine wave component holding block 13. The amplitude An is inputted in the mean amplitude computing block 14, and mean amplitude Ame is computed by the following relation for each frame:

$$Ame=\Sigma(An)/N$$

[2.4] Operation of Amplitude Normalizer

Then, each amplitude An is normalized by the mean amplitude Ame according to the following relation in an amplitude normalizer 15 to obtain normalized amplitude A'n:

$$A'n=An/Ame$$

[2.5] Operation of Spectral Shape Computing Block

Then, in a spectral shape computing block 16, an envelope is generated to define a spectral shape Sme(f) with the sine wave components (Fn, A'n) obtained from frequency Fn and normalized amplitude A'n being break points of the envelope shown in FIG. 8(B). In this case, the value of amplitude at an intermediate frequency between two break point frequencies is computed by, for example, linear-interpolating these two break points. It should be noted that interpolating is not limited to the linear-interpolation.

[2.6] Operation of Pitch Normalizer

Then, in a pitch normalizer 17, each frequency Fn is normalized by pitch Pme detected by the pitch detector 7 to obtain normalized frequency F'n.

$$F'n=Fn/Pme$$

Consequently, a source frame information holding block 18 holds mean amplitude Ame, pitch Pme, spectral shape Sme(f), and normalized frequency F'n, which are source attribute data corresponding to the sine wave component set included in the input voice signal Sv. It should be noted that, in this case, the normalized frequency F'n represents a relative value of the frequency of a harmonics tone sequence or overtone sequence. If a frame frequency spectrum can be handled as a complete harmonics tone structure, the normalized frequency F'n need not be held.

In this embodiment, if male voice/female voice conversion is to be executed, male voice/female voice pitch control processing is preferably executed, such that the pitch is raised one octave for male voice to female voice conversion, and the pitch is lowered one octave for female voice to male voice conversion.

Then, of the source attribute data held in the source frame information holding block 18, the mean amplitude Ame and the pitch Pme are filtered by a static variation/vibrato variation separator 19 to be separated into a static variation component and a vibrato variation component. It should be noted that a jitter component, which is a higher frequency variation component, may be further separated from the vibrato variation component. To be more specific, the mean amplitude Ame is separated into a mean amplitude static component Ame-sta and a mean amplitude vibrato component Ame-vib. In addition, the pitch Pme is separated into a pitch static component Pme-sta and a pitch vibrato component Pme-vib.

As a result, source frame information data INFme of the corresponding frame is held in the form of mean amplitude static component Ame-sta, mean amplitude vibrato component Ame-vib, pitch static component Pme-sta, pitch vibrato component Pme-vib, spectral shape Sme(f), normalized frequency F'n, and residual component Rme(f), which are source attribute data corresponding to the sine wave component set of the input voice signal Sv as shown in FIG. 8(C). Namely, in the inventive apparatus, the extracting device including the blocks 13-18 extracts the original attribute data containing at least one of amplitude data Ame representing an amplitude of the input voice signal, pitch data Pme representing a pitch of the input voice signal, and spectral shape data Sme representing a spectral shape of the input voice signal. The extracting device includes the block 19 extracts the original attribute data containing the amplitude data in the form of static amplitude data Ame-sta representing a basic variation of the amplitude and vibrato-like amplitude data Ame-vib representing a minute variation of the amplitude, superposed on the basic variation of the amplitude. Further, the extracting device extracts the original attribute data containing the pitch data in the form of static pitch data Pme-sta representing a basic variation of the pitch and vibrato-like pitch data pe-vib representing a minute variation of the pitch, superposed on the basic variation of the pitch.

On the other hand, target frame information data INFtar constituted by the target attribute data corresponding to a target singer is analyzed beforehand and held in a hard disk for example that constitutes a target frame information holding block 20. In this case, of the target frame information data INFtar, the target attribute data corresponding to the sine wave component set includes mean amplitude static component Atar-sta, mean amplitude vibrato component Atar-vib, pitch static component Ptar-sta, pitch vibrato component Ptar-vib, and spectral shape Star(f). Of the target frame information data INFtar, the target attribute data corresponding to the residual component set includes residual component Rtar (f).

[2.7] Operation of Key Control/Temp Change Block

Based on a sync signal $S_{SYNC}$ supplied from a sequencer 31, A key control/tempo change block 21 reads the target frame information INFtar of the frame corresponding to the sync signal SSYNC from the target frame information holding block 20, then interpolates the target attribute data constituting the target frame information data INFtar thus read, and outputs the target frame information data INFtar and a target unvoice/voice detect signal U/Vtar indicative of whether that frame is unvoiced or voiced.

To be more specific, a key control unit, not shown, of the key control/tempo change block 21 executes interpolation processing such that, if the key of the karaoke apparatus has been raised or lowered in excess of standard level, the pitch static component Ptar-sta and the pitch vibrato component Ptar-vib, which are the target attribute data, are also raised or lowered by the same amount. For example, if the key is raised by 50 [cent], the pitch static component Ptar-sta and the pitch vibrato component Ptar-vib must also be raised by 50 [cent]. Namely, the inventive apparatus further comprises a peripheral device including the block 20 that provides the target attribute data containing pitch data representing a pitch of the target voice signal at a standard key, and a key control device including the block 21 that operates when a user key different than the standard key is designated to the input voice signal for adjusting the pitch data according to a difference between the standard key and the user key.

If the tempo of the karaoke apparatus is raised or lowered, the tempo change unit, not shown, of the key control/tempo change block 21 must reads the target frame information data INFtar in a timed relation equivalent to a changed tempo. In this case, if the target frame information data INFtar equivalent to the timing corresponding to the necessary frame does not exist, the tempo change unit reads the target frame information data INFtar of two frames before and after the timing of that necessary frame, then executes interpolation of the two pieces of target frame Information data INFtar, and generates the target frame information data INFtar of the frame at the necessary timing and the target attribute data of that frame. Namely, the inventive apparatus further comprises a peripheral device including the block 20 that provides the target attribute data divided into a sequence of frames arranged at a standard tempo of the target voice signal, and a tempo control device including the bock 21 that operates when a user tempo different than the standard tempo is designated to the input voice signal for adjusting the sequence of the frames of the target attribute data according to a difference between the standard tempo and the user tempo, thereby enabling the synthesizing device including the block 23 to synthesize the new attribute data based on both of the original attribute data and the target attribute data synchronously with each other at the user tempo designated to the input voice signal. In such a case, the tempo control device adjusts the sequence of the frames of the target attribute data according to the difference between the standard tempo and the user tempo, such that an additional frame of the target attribute data is filled into the sequence of the frames of the target attribute data by interpolation of the target attribute data so as to match with a sequence of frames of the original attribute data provided from the extracting device including the block 1.

In this case, for the vibrato component (mean amplitude vibrato component Atar-vib and pitch vibrato component Ptar-vib), the period of the vibrato changes if nothing is done on the vibrato component. Therefore, interpolation must be executed to prevent the period from changing. Alternatively, this problem may be circumvented by using not the data representative of the locus of the vibrato but vibrato period and vibrato depth parameters as the target attribute data and obtaining an actual locus by computation.

[2.8] Operation of Easy Synchronization Processor

Then, if the target frame information data INFtar does not exist in a frame of the target singer (hereafter referred to as a target frame) although the source frame information data InFme exists in a frame of the input voice signal of a mimicking singer (hereafter referred to as a source frame), an easy synchronization processor 22 executes easy synchronization processing with the target frame information data INFtar of adjacent frames before and after that target frame to create the target frame information data INFtar. Namely, the inventive apparatus further comprises a synchronizing device in the form of the easy synchronization processor 22 that compares the target attribute data provided in the form of a first sequence of frames with the original attribute data provided in the form of a second sequence of frames so as to detect a false frame that is present in the second sequence but is absent from the first sequence, and that selects a dummy frame occurring around the false frame in the first sequence so as to compensate for the false frame, thereby synchronizing the first sequence containing the dummy frame to the second sequence containing the false frame.

Then, the easy synchronization processor 22 outputs the target attribute data (mean amplitude static component Atar-sync-sta, mean amplitude vibrato component Atar-sync-vib, pitch static component Ptar-sync-sta, pitch vibrato component Ptar-sync-vib, and spectral shape Star-sync(f)) associated with the sine wave components among the target attribute data included in the replaced target frame information data INFtar-sync. In addition, the easy synchronization processor 22 outputs the target attribute data (residual component Rtar-sync(f)) associated with the residual components among the target attribute data included in the replaced target frame information data INFtar-sync.

In the above-mentioned processing by the easy synchronization processor 22, the period of the vibrato changes for the vibrato components (mean amplitude vibrato component Atar-vib and pitch vibrato component Ptar-vib) if nothing is done. Therefore, interpolation must be executed to prevent the period from changing. Alternatively, this problem may be circumvented by using not the. data representative of the locus itself of the vibrato but vibrato period and vibrato depth parameters as the target attribute data and obtaining an actual locus by computation.

[2.8.1] Details of Easy Synchronization Processing

Figure 9:
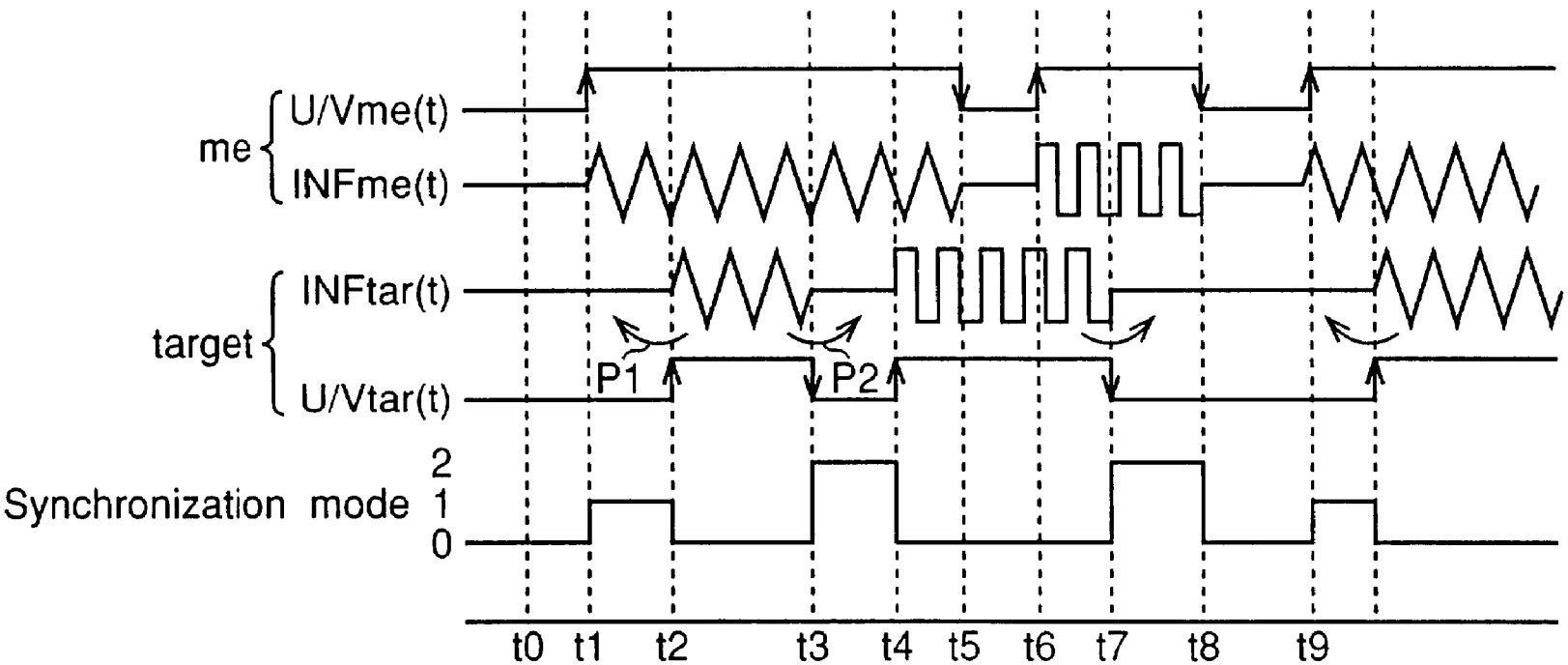
FIG. 9 is a timing chart of easy synchronization processing.
Figure 10:
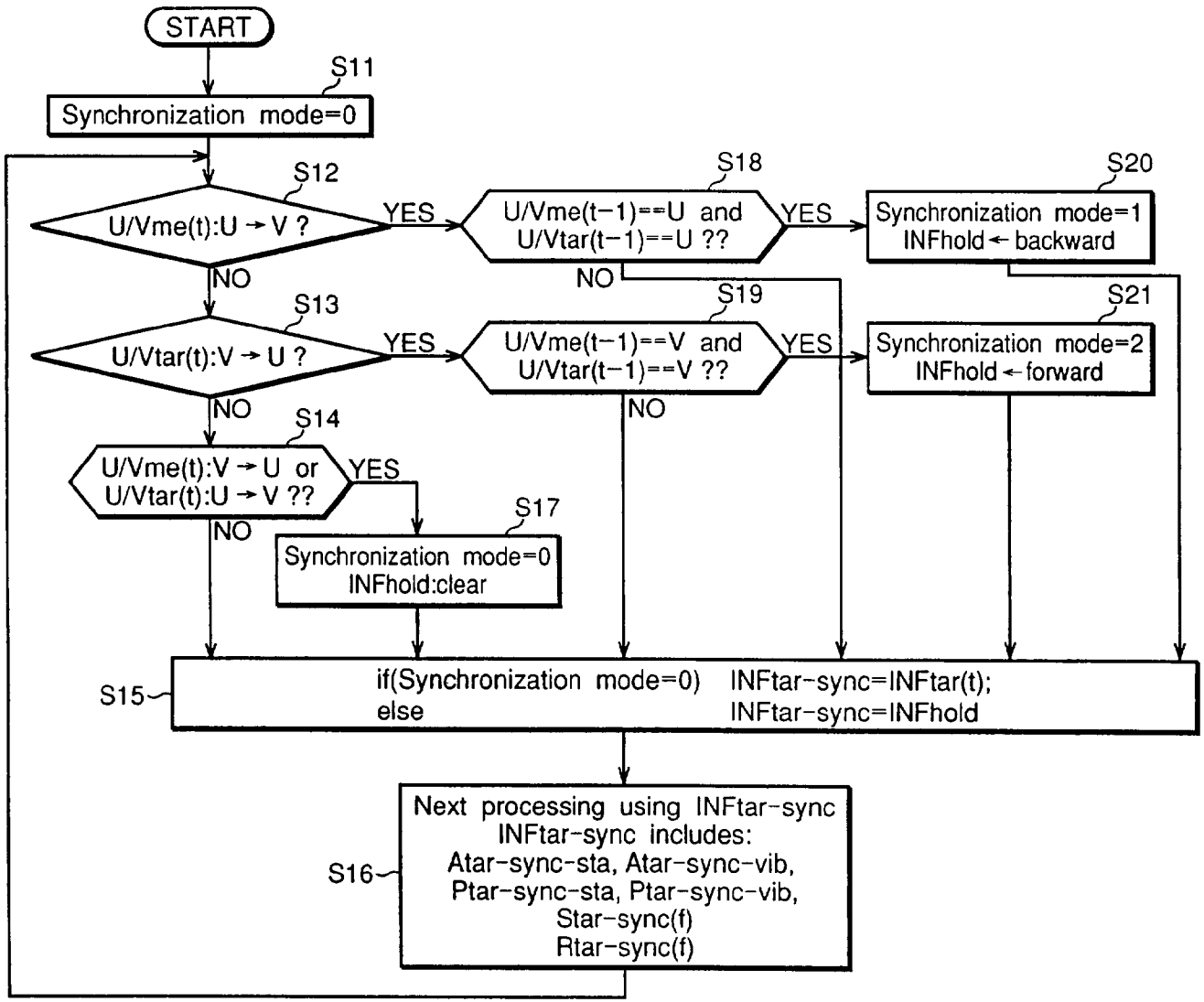
FIG. 10 is a flowchart of easy synchronization processing.

The following describes in detail the easy synchronization processing with reference to FIGS. 9 and 10. FIG. 9 is a timing chart of the easy synchronization processing. FIG. 10 is a flowchart of the easy synchronization processing. First, the easy synchronization processor 22 is set to the synchronization mode="0" that indicates the states of synchronization processing (step S1). This synchronization mode="0" is equivalent to the normal processing in which the target frame information data INFtar exists in the target frame corresponding to the source frame.

Then, it is determined whether a source unvoice/voice detect signal U/Vme(t) in timing t has changed from unvoiced state (U) to voiced state(V) (step S12). For example, as shown in FIG. 9, at timing t=t1, the source unvoice/voice detect signal U/Vme(t) changes from unvoiced (U) to voiced (V). If the source unvoice/voice detect signal U/Vme(t) is changed in step S12 from unvoiced (U) to voiced (V) (step S12: YES), it is determined whether the source unvoice/voice detect signal U/Vme(t−1) at the last timing t−1 before timing t is unvoiced (U) and a target unvoice/voice detect signal U/Vtar(t−1) is unvoiced (U) (step S18). For example, as shown in FIG. 9, at timing t=t0(=t1−1), the source unvoice/voice detect signal U/Vme(t−1) indicate unvoiced and the target unvoice/voice detect signal U/Vtar(t−1) indicates unvoiced (U).

If the source unvoice/voice detect signal U/Vme(t−1) is found unvoiced (U) and the target unvoice/voice detect signal U/Vtar(t−1) is found unvoiced in step S18 (step S18: YES), it indicates that the target frame information data INFtar does not exist in that target frame, the synchronization mode is set to "1", and substitute target frame information data INFhold is used as the target frame information of the frame backward of that target frame. For example, as shown in FIG. 9, the target frame information data INFtar does not exist in the target frame at timing t=t1~t2, so that the synchronization mode is set to "1", and the substitute target frame information data INFhold is used as target frame information data backward of the frame (namely the frame existing at timing t=t2~t3) backward of that target frame.

Then, in step S15, it is determined whether the synchronization mode is "0" (step S15). If the synchronization mode is found "0" in step S15, replaced target frame information data INFtar-sync is used as target frame information data INFtar(t) if the target frame information data INFtar(t) exists in the target frame corresponding to the source frame at timing t, which indicates the normal processing:

INFtar-sync=INFtar(t).

For example, as shown in FIG. 9, the target frame information data INFtar exists in the target frame at timing t=t2~t3, so that INFtar-sync=INFtar(t).

In this case, the target attribute data (mean amplitude static component Atar-sync-sta, mean amplitude vibrato component Atar-sync-vib, pitch static component Ptar-sync-sta, pitch vibrato component Ptar-sync-vib, spectral shape Star-sync(f), and residual component R-tar-sync(f)) included in the replaced target frame information data INFtar-sync to be used in the subsequent processing substantially have the following contents (step S16):

Atar-sync-sta=Atar-sta

Atar-sync-vib=Atar-vib

Ptar-sync-sta=Ptar-sta

Ptar-sync-vib=Ptar-vib

Star-sync(f)=Star(f)

Rtar-sync(f)=Rtar(f)

If the synchronization mode is found "1" or "2" in step S15, it indicates that the target frame information data INFtar(t) does not exist in the target frame corresponding to the source frame at timing t, so that the replaced target frame information data INFtar-sync is used as the replacing target frame information data INFhold:

INFtar-sync=INFhold.

For example, as shown in FIG. 9, the target frame information data INFtar does not exist in the target frame at timing t=t1~t2 and the synchronization mode is therefore "1". But, the target frame information data INFtar exists in the target frame at timing t=t2~t3, so that processing P1 is executed in which the replaced target frame information data INFtar-sync is used as the replacing target frame information data INFhold, which is the target frame information data of the target frame at the timing t=t2~t3. The target attribute data included in the replaced target frame information data INFtar-sync to be used in the subsequent processing includes mean amplitude static component Atar-sync-sta, mean amplitude vibrato component Atar-sync-vib, pitch static component Ptarsync-sta, pitch vibrato component Ptar-sync-vib, spectral shape Star-sync(f), and residual component R-tar-sync(f) (step S16).

As shown in FIG. 9, the target frame information data INFtat does not exist in the target frame at timing t=t3~t4 and therefore the synchronization mode is "2". But, the target frame information data INFtar exists in the target frame at timing t=t2~t3, so that processing P2 is executed in which the replaced target frame information data INFtar-sync is used as the replacing target frame information data INFhold, which is the target frame information data of the target frame at timing t=t2~t3. The target attribute data included in the replaced target frame information data INFtar-sync to be used in the subsequent processing includes mean amplitude static component Atar-sync-sta, mean amplitude vibrato component Atar-sync-vib, pitch static component Ptar-sync-sta, pitch vibrato component Ptar-sync-vib, spectral shape Star-sync (f), and residual component R-tar-sync(f) (step S16).

If the source unvoice/voice detect signal U/Vme(t) is not changed from the unvoiced state (U) to the voiced state (V) in step S12 (step S12: NO), it is determined whether the target unvoice/voice detect signal U/Vtar(t) has changed from voiced (V) to unvoiced (U) (step S13). If the target unvoice/voice detect signal U/Vtar(t) is changed from voiced (V) to unvoiced (U) (step S13: YES), it is determined whether the source unvoice/voice detect signal U/Vme(t−1) indicates voiced (V) and the target unvoice/voice detect signal U/Vtar (t−1) indicates voiced (V) at the last timing t−1 of the timing 1 (step S19). For example, as shown in FIG. 9, the target unvoice/voice detect signal U/Vtar(t) changes from voiced (V) to unvoiced (U) at time T3, and the source unvoice/voice detect signal U/Vme(t−1) changes to voiced (V), and the target unvoice/voice detect signal U/Vtar(t−1) indicates unvoiced (U) at timing t−1=t2~t3.

If the source unvoice/voice detect signal U/Vme(t−1) indicates voiced (V) and the target unvoice/voice detect signal U/Vtar(t−1) indicates voiced (V) in step S19 (step S19: YES), it indicates that the target frame information data INFtar does not exist in that target frame, so that the synchronization mode is "2" and the replacing target frame information data INFhold is used as the target frame information existing forward of that target frame (step S21). For example, as shown in FIG. 9, the target frame information data INFtar does not exist in the target frame at timing t=t3~t4, so that the synchronization mode is "2", and the replacing target frame information data INFhold is used as the target frame information data of the frame (namely, the frame existing at timing t=t2~t3) existing forward of that target frame. Then, in step S15, it is determined whether the synchronization mode is "0" (step S15) and the above-mentioned processing is repeated.

If the target unvoice/voice detect signal U/Vtar(t) is not changed from voiced (V) to unvoiced (U) in step S13 (step S13: NO), it is determined whether the source unvoice/voice detect signal U/Vme(t) has changed from voiced (V) to unvoiced (U) or the target unvoice/voice detect signal U/Vtar (t) has changed from unvoiced (U) to voiced (V) (step S14). If the source unvoice/voice detect signal U/Vme(t) at timing t is changed from voiced (V) to unvoiced (U) and the target unvoice/voice detect signal U/Vme(t) is changed from unvoiced (U) to voiced (V) in step S14 (step S14: YES), the synchronization mode is "0" and the replacing target frame information data INFhold is cleared (step S17). Then, the above-mentioned processing is repeated back in step S15.

If the source unvoice/voice detect signal U/Vme(t) at timing t is not changed from voiced (V) to unvoiced (U) or the target unvoice/voice detect signal U/Vtar(t) is not changed from unvoiced (U) to voiced (V) in step S14 (step S14: NO), then in step S15, the above-mentioned processing is repeated.

[2.9] Operation of Sine Wave Component Attribute Data Selector

Then, a sine wave component attribute data selector 23 generates a new amplitude component Anew, a new pitch component Pnew, and a new spectral shape Snew(f), which are new sine wave component attribute data, based on sine-wave-component-associated data (mean amplitude static component Atar-sync-sta, mean amplitude vibrato component Atar-sync-vib, pitch static component Ptar-sync-sta, pitch vibrato component Ptar-sync-vib, and spectral shape Star-sync(f)) among the target attribute data included in the replaced target frame information data INFtar-sync inputted from the easy synchronization processor 22 and based on the sine wave component attribute data select information inputted from a controller 29.

Namely, the new amplitude component Anew is generated by the following relation:

$$Anew = A^{*}\text{-sta} + A^{*}\text{vib (where "*" denotes "me" or "tar-sync")}$$

To be more specific, as shown in FIG. 8(D), the new amplitude component Anew is generated as a combination of one of the mean amplitude static component Ame-sta of the source attribute data and the mean amplitude static component Atar-sync-sta of the target attribute data and one of the mean amplitude vibrato component Ame-vib of the source attribute data and the mean amplitude vibrato component Atar-sync-vib of the target attribute data.

The new pitch component Pnew is generated by the following relation:

$$Pnew = P^{*}\text{-sta} + P^{*}\text{-vib (where "*" denotes "me" or "tar-sync")}$$

To be more specific, as shown in FIG. 8(D), the new pitch component Pnew is generated as a combination of the pitch static component Pme-sta of the source attribute data and the pitch static component P-tar-sync-sta of the target attribute data and one of the pitch vibrato component Pme-vib of the source attribute data and the pitch vibrato component Ptar-sync-vib of the target attribute data.

The new spectral shape Snew(f) is generated by the following relation:

$$Snew(f) = S^{*}(f) \text{ (where "*" denotes "me" or "tar-sync")}$$

Namely, in the inventive apparatus, the synthesizing device including the block 23 operates based on both of the original attribute data composed of a set of original attribute data elements and the target attribute data composed of another set of target attribute data elements in correspondence with one another to define each corresponding pair of the original attribute data element and the target attribute data element, such that the synthesizing device selects one of the original attribute data element and the target attribute data element from each corresponding pair for synthesizing the new attribute data composed of a set of new attribute data elements each selected from each corresponding pair.

Figure 11:
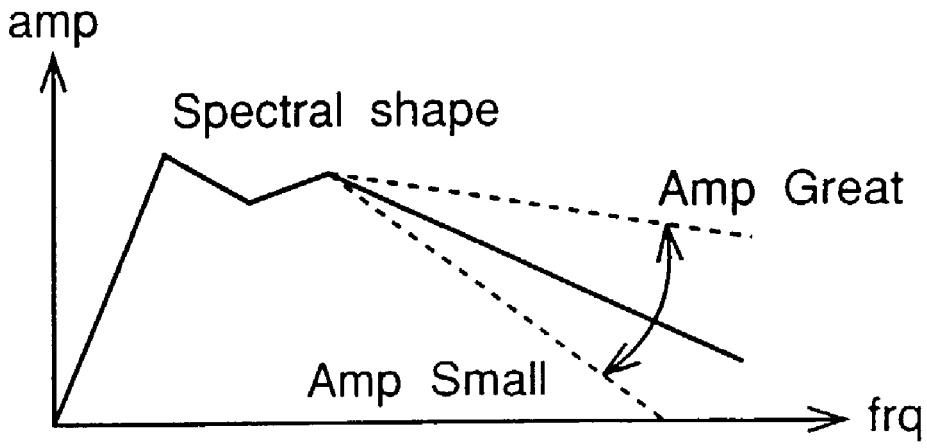
FIG. 11 is a diagram for describing the spectral tilt correction of a spectral shape.

It should be noted that, generally, a greater amplitude component produces an open tone extending into a high-frequency area, while a smaller amplitude component produces a closed tone. Therefore, as for the new spectral shape Snew (f), in order to simulate such a state, the high-frequency components of the spectral shape, more exactly the tilt of the spectral shape of high-frequency area is controlled by executing spectral tilt correction on the spectral shape tilt according to the magnitude of the new amplitude component Anew as shown in FIG. 11, thereby reproducing a more real voice.

Next, the generated new amplitude component Anew, new pitch component Pnew, and new spectral shape Snew(f) are further modified by an attribute data modifier 24 based on sine wave attribute data modifying information supplied from the controller 29 as required. For example, modification such as entirely extending the spectral shape is executed. Namely, the synthesizing device includes the modifier 23 that modifies the new attribute data so that the output device including the blocks 26-28 produces the output voice signal based on the modified new attribute data.

[2.10] Operation of Residual Component Selector

On the other hand, the residual component selector 25 generates new residual component Rnew(f), which is new residual component attribute data, based on the target attribute data (residual component R-tar-sync(f)) associated with the residual components among the target attribute data included in the replaced target frame information data INFtar-sync inputted from the easy synchronization processor 22, the residual component signal (frequency waveform) Rme(f) held in the residual component holding block 12, and the residual component attribute data select information inputted from the controller 29.

Namely, the new residual component Rnew(f) is generated by the following relation:

$$Rnew(f) = R^{*}(f) \text{ (where "*" denotes "me" or "tar-sync")}$$

In this case, it is preferable to select "me" or "tar-sync" that was selected for the new spectral shape Snew(f). Further, as for the new residual component Rnew(f), in order to simulate the same state as that of the new spectral shape, the high-frequency component of spectral shape, namely the tilt of the spectral shape of the high-frequency area is controlled by executing the spectral tilt correction on the spectral shape tilt according to the magnitude of the new amplitude component Anew as shown in FIG. 11, thereby reproducing a more real voice.

[2.11] Operation of Sine Wave Component Generator

A sine wave component generator 26 obtains N new sine wave components (f"0, a"0), (f"1, a"1), (f"2, a"2), . . . , (f"(N−1)) (hereafter collectively represented as f"n, a"n) (n=0−(N−1)) in the frame concerned based on the new amplitude component Anew, new pitch component Pnew, and new spectral shape Snew(f) accompanying or not accompanying the modification outputted from the attribute data modifier 24. To be more specific, the new frequency f"n and the new amplitude a"n are obtained by the following relations:

$$f''n = f'n \times P\text{new}$$

$$a''n = S\text{new}(f''n) \times A\text{new}$$

It should be noted that, if the present model is to be grasped as a complete harmonics tone structure, the following relation is provided:

$$f''n = (n+1) \times P\text{new}$$

Operation of Sine Wave Component Modifier

Further, a sine wave component modifier 27 modifies the obtained new frequency f"n and new amplitude a"n based on the sine wave component modifying information supplied from the controller 29 as required. The modification includes selective enlargement of the new amplitudes a"n (=a"0, a"2, a"4, . . . ) of odd-number-order components. This provides a further variety to the converted voice.

[2.13] Operation of Inverse FFT Block

An inverse FFT block 28 stores the obtained new frequency f'"n, new amplitude a'"n (=new sine wave components) and new residual components Rnew(f) into an FFT buffer to sequentially execute inverse FFT operation. Further, the inverse FFT block 28 partially overlaps the obtained signals along the time axis, and adds them together to generate a converted voice signal, which is a new voiced signal along the time axis. At this moment, a more real voiced signal is obtained by controlling the mixing ratio of the sine wave components and the residual components based on the sine wave component/residual component balance control signal supplied from the controller 29. In this case, generally, as the mixing ratio of the residual components gets greater, a coarser voice results.

In this case, when storing the new frequency f'", the new amplitude a'"n (=new sine wave components), and the new residual components Rnew(f) into the FFT buffer, sine wave components obtained by conversion at different and appropriate pitches may be further added to provide a harmony as a converted voice signal. In addition, providing a harmony pitch adapted to the harmonics tone may provide a musical harmony adapted to an accompaniment. Namely, the synthesizing device synthesizes additional attribute data in addition to the new attribute data so that the output device concurrently produces the output voice signal based on the new attribute data and an additional voice signal based on the additional attribute data in a different pitch than that of the output voice signal.

[2.14] Operation of Cross Fader

Next, based on the source unvoice/voice detect signal U/Vme(t), if the input voice signal Sv is in an unvoiced state(U), the cross fader 30 outputs the same to a mixer 33 without change. If the input voice signal Sv is in the voiced state(V), the cross fader 30 outputs the converted voice signal supplied from the inverse FFT block 28 to the mixer 33. In this case, the cross fader 30 is used as a selector switch to prevent a cross fading operation from generating a click sound at switching.

[2.15] Operations of Sequencer, Tone Generator, Mixer, and Output Block

On the other hand, the sequencer 31 outputs tone generator control information for generating a karaoke accompaniment tone as MIDI (Musical Instrument Digital Interface) data for example to a tone generator 32. This causes the mixer 33 to mix one of the input voice signal Sv or the converted voice signal with an accompaniment signal, and outputs a resultant mixed signal to an output block 34. The output block 34 has an amplifier, not shown, which amplifies the mixed signal and outputs the amplified mixed signal as an acoustic signal.

[3] Variations

[3.1] First Variation

In the above-mentioned constitution, one of the source attribute data and the target attribute data is selected as the attribute data. A variation may be made in which both the source attribute data and the target attribute data are used to provide a converted voice signal having an intermediate attribute by means of interpolation. Namely, the synthesizing device including the block 23 may operate based on both of the original attribute data composed of a set of original attribute data elements and the target attribute data composed of another set of target attribute data elements in correspondence with one another to define each corresponding pair of the original attribute data element and the target attribute data element, such that the synthesizing device interpolates with one another the original attribute data element and the target attribute data element of each corresponding pair for synthesizing the new attribute data composed of a set of new attribute data elements each interpolated from each corresponding pair. Such a constitution may produce a converted voice that resembles neither the mimicking singer nor the target singer. In addition, if the spectral shape is obtained by interpolation especially, when the mimicking singer utters vowel "a" and the target singer utters vowel "i", a sound that is neither vowel "a" nor vowel "i" may be outputted as a converted voice. Therefore, care must be taken in handling such a voice.

[3.2] Second Variation

The sine wave component extraction may be executed by any other methods than that used in the above-mentioned embodiment. It is essential that sine waves included in a voice signal be extracted.

[3.3] Third Variation

In the above-mentioned embodiment, the target sine wave components and residual components are provisionally stored. Alternatively, a target voice may be stored and the stored target voice may be read and analyzed to extract the sine wave components and residual components by real time processing. Namely, the processing executed in the above-mentioned embodiment on the mimicking singer voice may also be executed on the target singer voice.

[3.4] Fourth Variation

In the above-mentioned embodiment, all of pitch, amplitude, and spectral shape are handled as elements of attribute data. It is also practicable to handle at least one element of these attributes.

Consequently, according to the first embodiment of the invention, a song sung by a mimicking singer is outputted along a karaoke accompaniment. The voice quality and singing mannerism is significantly influenced by a target singer, substantially becoming those of the target singer. Thus, a mimicking song is outputted.

A second embodiment of the invention will be described in detail with reference to the accompanying drawings. Outline of processing by the second embodiment is as follows:

Step S1

First, the input voice signal of a singer who wants to mimic another singer is analyzed in real-time by SMS (Spectral Modeling Synthesis) including FFT (Fast Fourier Transform) to extract sine wave components on a frame basis. At the same time, residual components Rme are generated from the input voice signal other than the sine wave components on a frame basis. Concurrently, it is determined whether the input voice signal includes an unvoiced sound. If the decision is yes, the processing of steps S2 through S6 is skipped and the input voice signal is outputted without change. In this case, for the above-mentioned SMS analysis, pitch sync analysis is employed such that analysis window width of a current frame is set according to the pitch in a previous frame.

Step S2

If the input voice signal is a voiced sound, the pitch, amplitude, and spectral shape, which are source attributes, are further extracted from the extracted sine wave components. The extracted pitch and amplitude are separated into a vibrato part and a static part other than vibrato.

Step S3

From the stored attribute data of target singer (target attribute data=pitch, amplitude, and spectral shape), the target data (pitch, amplitude, and spectral shape) of the frame corresponding to the frame of the input voice signal of a singer (me) who wants to mimic the target singer is taken. In this case, if the target attribute data of the frame corresponding to the frame of the input voice signal of the mimicking singer (me) does not exist, the target attribute data is generated according to a predetermined easy synchronization rule as described before.

Step S4

The source attribute data corresponding to the mimicking singer (me) and the target attribute data corresponding to the target singer are appropriately selected and combined together to obtain new attribute data (pitch, amplitude, and spectral shape). It should be noted that, if these items of data are not used for mimicking but used for simple voice conversion, the new attribute data may be obtained by computation based on both the source and target attribute data by executing arithmetic operation on the source attribute data and the target attribute data.

Step S5

Based on the obtained new attribute data, a set of sine wave components SINnew of the frame concerned is obtained. Then, the amplitude and spectral shape of the sine wave components SINnew are modified to generate sine wave components SINnew'.

Step S6

Further, the residual components Rme(f) obtained in step S1 from the input voice signal are modified based on target residual components Rtar(f) to obtain new residual components Rnew(f).

Step S7

One of the pitch Pme-str of the sine wave components obtained in step S1 from the input voice signal, the pitch tar-sta of the sine wave components of the target singer, the pitch Pnew of the sine wave components SINnew generated in step S5 and the pitch Patt of the sine wave components SINnew' obtained by modifying the sine wave components SINnew is taken as an optimum pitch for a comb filter (comb filter pitch: Pcomb).

Step S8

Based on the obtained pitch Pcomb, the comb filter is constituted to filter the residual components Rnew(f) obtained in step S6, so that the fundamental tone component and its harmonic components are removed from the residual components Rnew(f) to obtain new residual components Rnew'(f).

Step S9

After the sine wave components SINnew' obtained in step S5 and the new residual components Rnew'(f) obtained in step S8 are synthesized with each other, inverse FFT is executed to obtain a converted voice signal.

As described above according to the second embodiment, the inventive method of converting an input voice signal into an output voice signal according to a target voice signal comprises the steps of providing the input voice signal composed of original sinusoidal components and original residual components other than the original sinusoidal components, separating the original sinusoidal components and the original residual components from each other, modifying the original sinusoidal components based on target sinusoidal components contained in the target voice signal so as to form new sinusoidal components having a first pitch, modifying the original residual components based on target residual components contained in the target voice signal other than the target sinusoidal components so as to form new residual components having a second pitch, shaping the new residual components by removing therefrom a fundamental tone corresponding to the second pitch and overtones of the fundamental tone, and combining the new sinusoidal components and the shaped new residual components with each other so as to produce the output voice signal having the first pitch. Preferably, the step of shaping comprises removing the fundamental tone corresponding to the second pitch which is identical to one of a pitch of the original sinusoidal components, a pitch of the target sinusoidal components, and a pitch of the new sinusoidal components. Further, the invention covers a machine readable medium used in a computer machine of the karaoke apparatus having a CPU. The medium contains program instructions executable by the CPU to cause the computer machine for performing a process of converting an input voice signal into an output voice signal according to a target voice signal as described above Next, detailed description is given to the second embodiment of the invention with reference to the drawings. The second embodiment is basically similar to the first embodiment shown in FIGS. 1 and 2. More specifically, the second embodiment has a first part and a second part. The first part has the construction shown in FIG. 1. The second part has the construction shown in FIG. 12, which is modified from the construction of FIG. 2.

In the first embodiment, a technique of signal processing to represent a voice signal as a sine wave (SIN) component, which is combined sine waves of the voice signal, and a residual component, which is a component other than the sine wave component, is used to modify the voice signal (including the sine wave component and the residual component) based on a target voice signal (including the sine wave component and the residual component) of a particular singer, thereby generating a voice signal reflecting the voice quality and singing mannerism of the particular singer to output the same along a karaoke accompaniment tone. In the voice converting apparatus thus configured, the residual component includes a pitch component, so that when the sine wave component and the residual component are synthesized with each other after the voice conversion has been executed to each component, both pitch components respectively included in the sine wave component and the residual component are caught by listeners. If the pitch of the sine wave component and the pitch of the residual component differ in frequency, naturalness in the converted voice may be lost.

Figure 12:
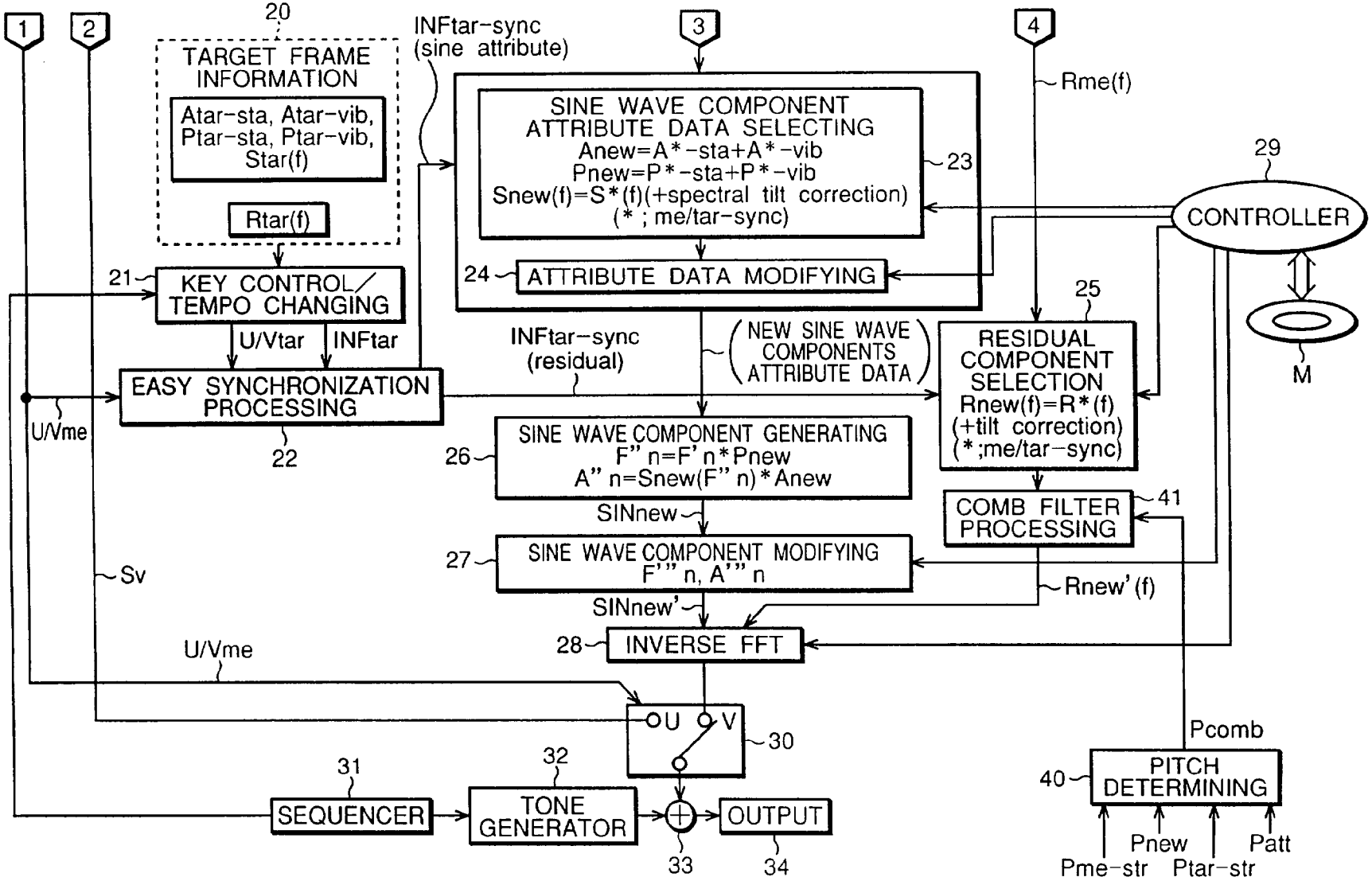
FIG. 12 is a block diagram illustrating a constitution of a second preferred embodiment.

It is therefore an object of the second embodiment to provide a voice converting apparatus and a voice converting method that allow voice conversion without losing naturalness of the voice. Referring to FIGS. 1 and 12, there is shown a detailed constitution of the second embodiment. It should be noted that the present embodiment is an example in which the voice converting apparatus (voice converting method) according to the invention is applied to a karaoke apparatus that allows a singer to mimic particular singers. The inventive apparatus is constructed for converting an input voice signal into an output voice signal according to a target voice signal. In the inventive apparatus, an input device including a microphone block 1 provides the input voice signal composed of original sinusoidal components and original residual components other than the original sinusoidal components. A separating device including blocks 2-10 (FIG. 1) separates the original sinusoidal components and the original residual components from each other. A first modifying device including a block 24 (FIG. 12) modifies the original sinusoidal components based on target sinusoidal components contained in the target voice signal so as to form new sinusoidal components having a first pitch. A second modifying device including a block 25 modifies the original residual components based on target residual components contained in the target voice signal other than the target sinusoidal components so as to form new residual components having a second pitch. A shaping device including blocks 40 and 41 shapes the new residual components by removing therefrom a fundamental tone corresponding to the second pitch and overtones of the fundamental tone. An output device including a block 28 combines the new sinusoidal components and the shaped new residual components with each other for producing the output voice signal having the first pitch.

According to the invention, the sine wave components and the residual components, which are extracted from an input voice signal, are modified based on the sine wave components and the residual components of a target voice signal, respectively. Then, before the sine wave components and the residual components respectively modified are synthesized with each other, the pitch component (the fundamental tone) and its harmonic components (overtones) are removed from the residual components. As a result, only the pitch component of the sine wave components become audible, thereby improving naturalness of the converted voice.

Referring to FIG. 12, specific description is given to operation of a pitch deciding block 40, which is one of significant elements of the second embodiment. The pitch deciding block 40 selects one of the pitch Pme-str from the pitch detector 7, the pitch Ptar-sta from the target frame information holding block 20, the pitch Pnew from the sine wave component attribute data selector 23 and the pitch Patt from the attribute data modifier 24 (basically the pitch Patt) to supply the selected one to a comb filter processor 41 as an optimum pitch for the comb filter (comb filter pitch: Pcomb).

The following describes a method of deciding the comb filter pitch (Pcomb). In the above description, though the pitch Pcomb is generated from the pitch Patt of which the attribute has been converted by the attribute data modifier 24, generation of the pitch Pcomb is not limited to the pitch Patt. For example, in the voice conversion processing, if the target pitch Ptar-sta is used as the pitch of the sine wave components and Rme(f) is used as the new residual components Rnew(f), the pitch Pme-sta in the residual components is not necessary and should be eliminated. In this case, for the pitch Pcomb, the pitch Pme-sta is used. Conversely, in the voice conversion processing, if the pitch Pme-sta is used as the pitch of the sine wave components and the target residual component Rtarsync(f) is used as the new residual components Rnew(f), the pitch Ptar-sta is used as the pitch Pcomb. Namely, In the inventive apparatus, the shaping device in the form of the block 41 removes the fundamental tone corresponding to the pitch which is identical to one of a pitch of the original sinusoidal components, a pitch of the target sinusoidal components, and a pitch of the new sinusoidal components.

In the final voice conversion processing, if attribute conversion is executed to shift the pitch such as octave shifting, the pitch Pme-sta is used as the pitch Pcomb when the residual component of the input voice is used for the pitch shifting, while the Ptar-sta is used when the target residual component is used. Further, if the residual component of the input voice and the residual component of the target vice are used by interpolating the residual components at any ratio, the comb filter pitch Pcomb is a pitch determined by interpolating the Pitch Pme-sta and the pitch Ptar-sta at the same ratio. Thus, an optimum comb filter pitch Pcomb needs to be so decided that the residual component to which voice conversion has been executed is filtered by means of the comb filter to remove a pitch component and its harmonic components from the residual components.

Figure 13:
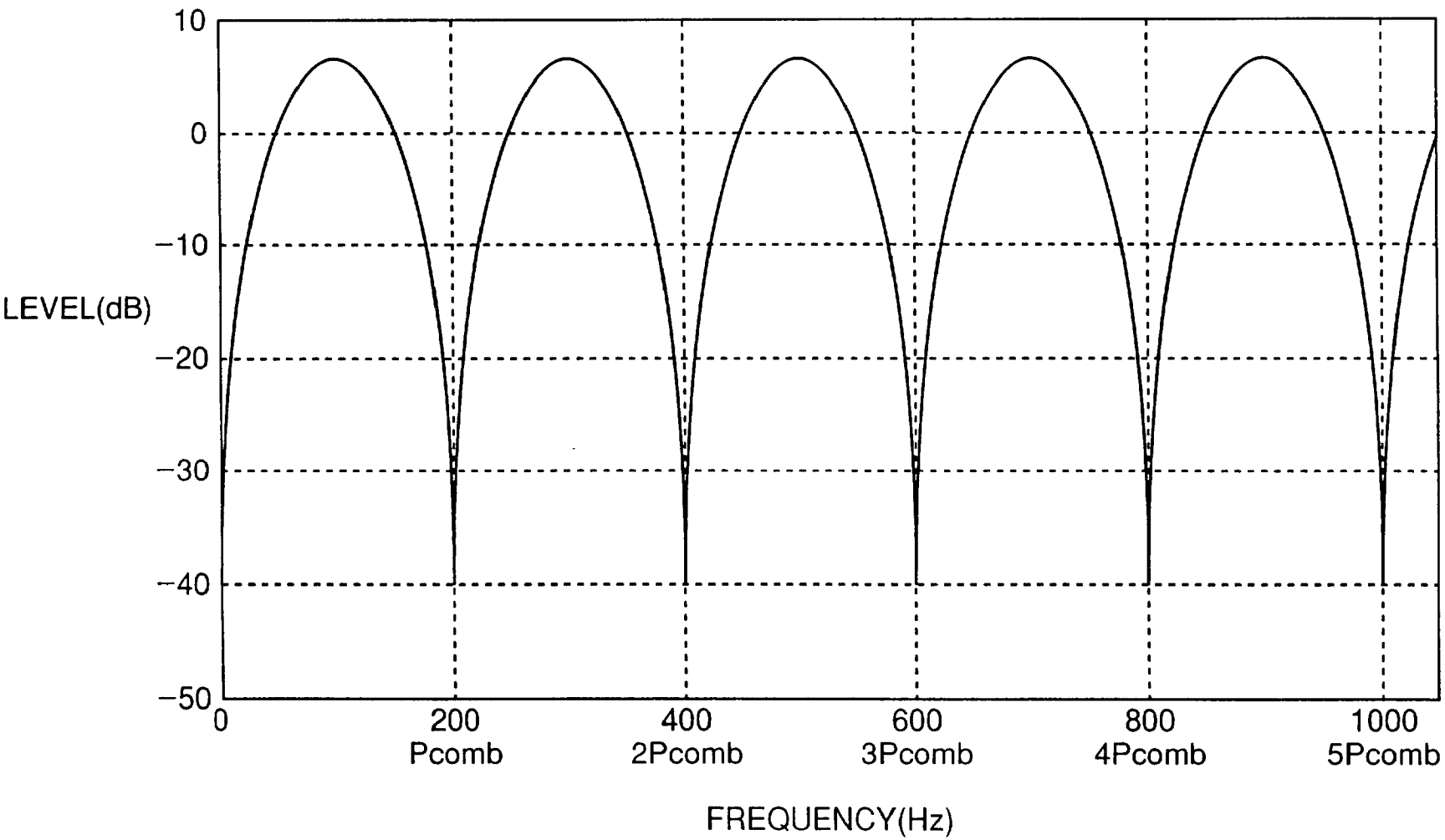
FIG. 13 is a conceptual diagram illustrating a frequency characteristic of a comb filter where a pitch Pcomb is set to 200 Hz.

Next, description is given to operation of the comb filter processor 41. The comb filter processor 41 uses the pitch Pcomb to constitute the comb filter through which the residual components Rnew(f) are filtered to remove a pitch component and its harmonic components therefrom. Consequently, new residual components Rnew'(f) are obtained and supplied to an inverse FFT block 28. FIG. 13 is a conceptual diagram illustrating a characteristic example of the comb filter when the pitch Pcomb is set to 200 Hz. As shown, when the residual components are held on the frequency axis, the comb filter is constituted on the frequency domain based on the pitch Pcomb. Namely, the shaping device comprises a comb filter 41 having a series of peaks of attenuating frequencies corresponding to a series of the fundamental tone and the overtones for filtering the new residual components along a frequency axis.

Figure 14:
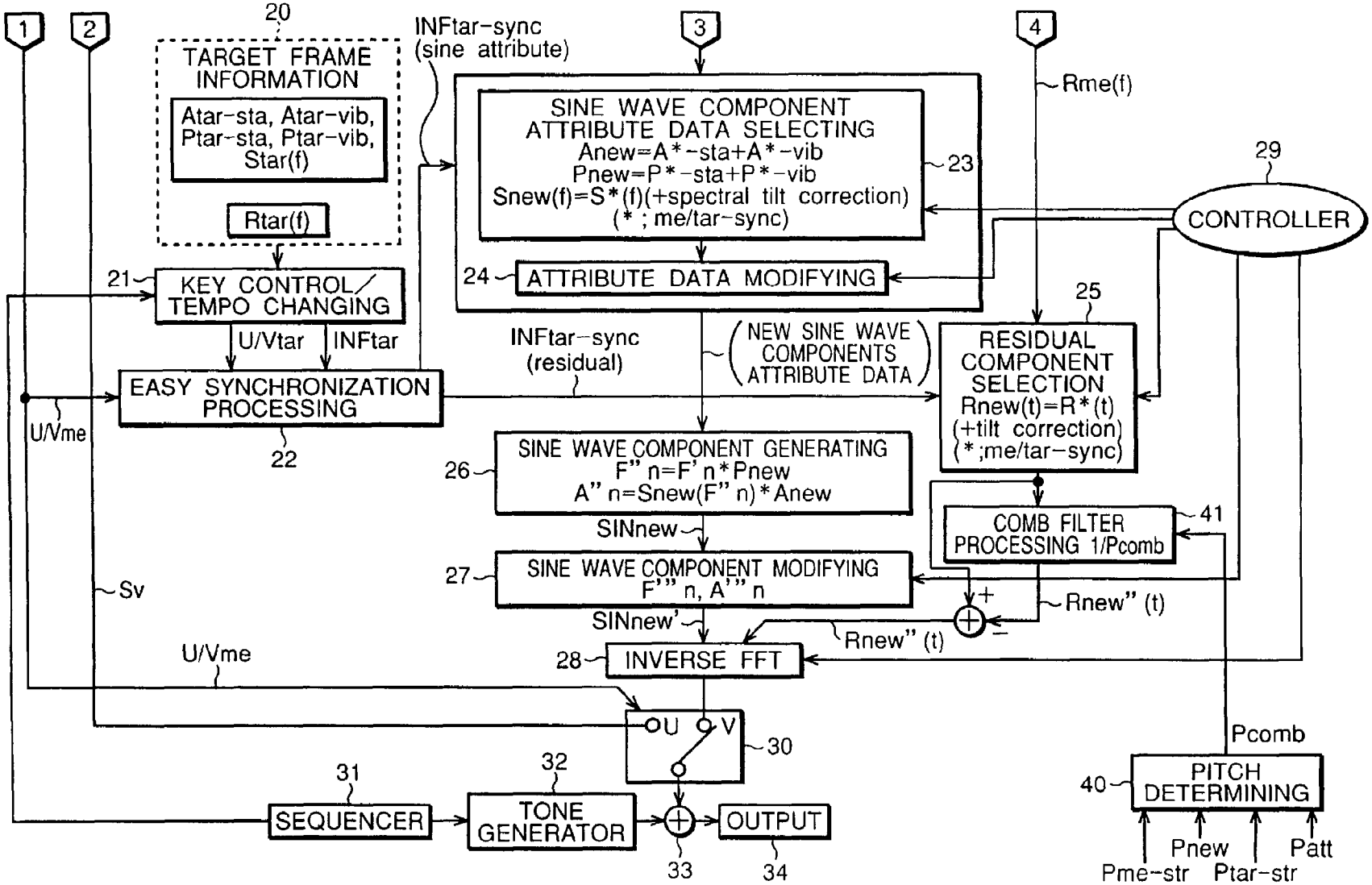
FIG. 14 is a (partial) block diagram illustrating a structure of a variation of the second embodiment of the inventive voice converting apparatus.
Figure 15:
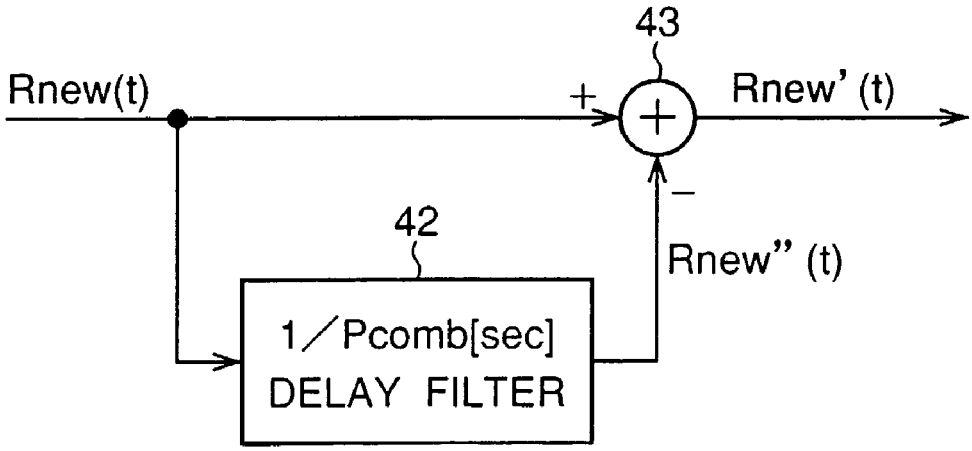
FIG. 15 is a block diagram for describing an example of a construction of a comb filter (delay filter).

In the above-mentioned second embodiment, the residual component is held on the frequency axis. The present invention is not limited by the embodiment, and the residual component may be held on the time axis. FIG. 14 is a block diagram illustrating (a part of) a constitution in which a variation is made to the above-mentioned second embodiment. FIG. 15 is a block diagram illustrating an example of a construction of the comb filter (delay filter). It should be noted here that blocks common to those of FIG. 12 are given the same reference numerals with their description omitted. As shown, a comb filter 42 takes the inverse of the pitch Pcomb decided by the pitch deciding block 40 as delay time to constitute the delay filter. Then, the comb filter processor 41 executes filtering of the residual components Rnew(t) by means of the delay filter 42 to supply the filtered residual components to a subtracter 43 as residual components Rnew" (t). The subtracter 43 removes a pitch component and its harmonic components from the residual components Rnew(t) by subtracting the filtered residual components Rnew"(t) from the residual components Rnew(t) to supply the same to the IFFT processor 8 as new residual components Rnew'(t). Namely, the shaping device comprises a comb filter 42 having a delay loop creating a time delay equivalent to an inverse of the pitch for filtering the residual components along a time axis so as to remove the fundamental tone and the overtones.

Even in the case where the residual components are processed on the time axis, it is possible to remove the pitch component and its harmonic components from the residual components Rnew(t) as similar to the above-mentioned second embodiment. As a result, only the pitch of the sine wave components become audible in the final output voice, thereby improving naturalness of the voice. A song sung by a mimicking singer is outputted along a karaoke accompaniment. The voice quality and singing mannerism is significantly influenced by a target singer, thereby substantially becoming those of the target singer. Thus, a mimicking song is outputted. Since the pitch component and its harmonic components are removed from the residual components Rnew(f), only the pitch the sine wave components becomes audible to prevent unnaturalness in the reproduced voice.

The third embodiment of the invention will be described in detail with reference to the accompanying drawings. Outline of processing by the third embodiment is as follows.

Step S1

First, the voice (namely the input voice signal) of a singer who wants to mimic another singer is analyzed real-time by SMS (Spectral Modeling Synthesis) including FFT (Fast Fourier Transform) to extract sine wave components on a frame basis. At the same time, residual components Rme are generated from the input voice signal other than the sine wave components on a frame basis. Concurrently, it is determined whether the input voice signal includes an unvoiced sound. If the decision is yes, the processing of steps S2 through S6 is skipped and the input voice signal is outputted as it is. For the above-mentioned SMS analysis, pitch sync analysis is adopted such that an analysis window width of a next frame is changed according to the pitch in the previous frame.

Step S2

If the input voice signal is a voiced sound, the pitch, amplitude, and spectral shape, which are source attributes, are further extracted from the extracted sine wave components. The extracted pitch and amplitude are separated into a vibrato part and a static part other than the vibrato part.

Step S3

From the stored attribute data of a target singer (target attribute data=pitch, amplitude, and spectral shape), the target data (pitch, amplitude, and spectral shape) of the frame corresponding to the frame of the input voice signal of a singer (me) who wants to mimic the target singer is taken. In this case, if the target attribute data of the frame corresponding to the frame of the input voice signal of the mimicking singer (me) does not exist, the target attribute data is generated according to the predetermined easy synchronization rule as described above.

Step S4

The source attribute data corresponding to the mimicking singer (me) and the target attribute data corresponding to the target singer are appropriately selected and combined together to obtain new attribute data (pitch, amplitude, and spectral shape). It should be noted that, if these items of data are not used for mimicking but used for simple voice conversion, the new attribute data may be obtained by computation based on both the source and target attribute data by executing arithmetic operation on the source attribute data and the target attribute data.

Step S5

Based on the obtained new attribute data, sine wave components SINnew of the frame concerned is obtained. Then, the amplitude and spectral shape of the sine wave components SINnew are modified to generate sine wave components SINnew'.

Step S6

Further, the residual components Rme(f) obtained in step S1 from the input voice signal are modified based on the target residual component Rtars(f) to obtain new residual components Rnew(f).

Step S7

Further, the pitch Patt of the modified sine wave components SINnew' is set to a pitch Pcomb of a comb filter.

Step S8

Based on the obtained pitch Pcomb, the comb filter is constituted to filter the residual components Rnew(f) obtained in step S6, so that the pitch component and its harmonic components are added to the residual components Rnew(f) to obtain final new residual components Rnew'(f).

Step S9

After the ew sine wave components SINnew' obtained in step S5 and the new residual components Rnew'(f) obtained in step S8 are synthesized with each other, inverse FFT is executed to obtain a converted voice signal.

As described above, the inventive method of converting an input voice signal into an output voice signal according to a target voice signal comprises the steps of providing the input voice signal composed of original sinusoidal components and original residual components other than the original sinusoidal components, separating the original sinusoidal components and the original residual components from each other, modifying the original sinusoidal components based on target sinusoidal components contained in the target voice signal so as to form new sinusoidal components, modifying the original residual components based on target residual components contained in the target voice signal other than the target sinusoidal components so as to form new residual components, shaping the new residual components by introducing thereinto a fundamental tone and overtones of the fundamental tone corresponding to a desired pitch, and combining the new sinusoidal components and the shaped new residual components with each other so as to produce the output voice signal. Specifically, the step of shaping comprises introducing the fundamental tone corresponding to the desired pitch which is identical to a pitch of the new sinusoidal components. Further, the invention includes a machine readable medium used in a computer-aided karaoke machine having a CPU. The inventive medium contains program instructions executable by the CPU to cause the computer machine for performing a process of converting an input voice signal into an output voice signal according to a target voice signal as described above.

Figure 16:
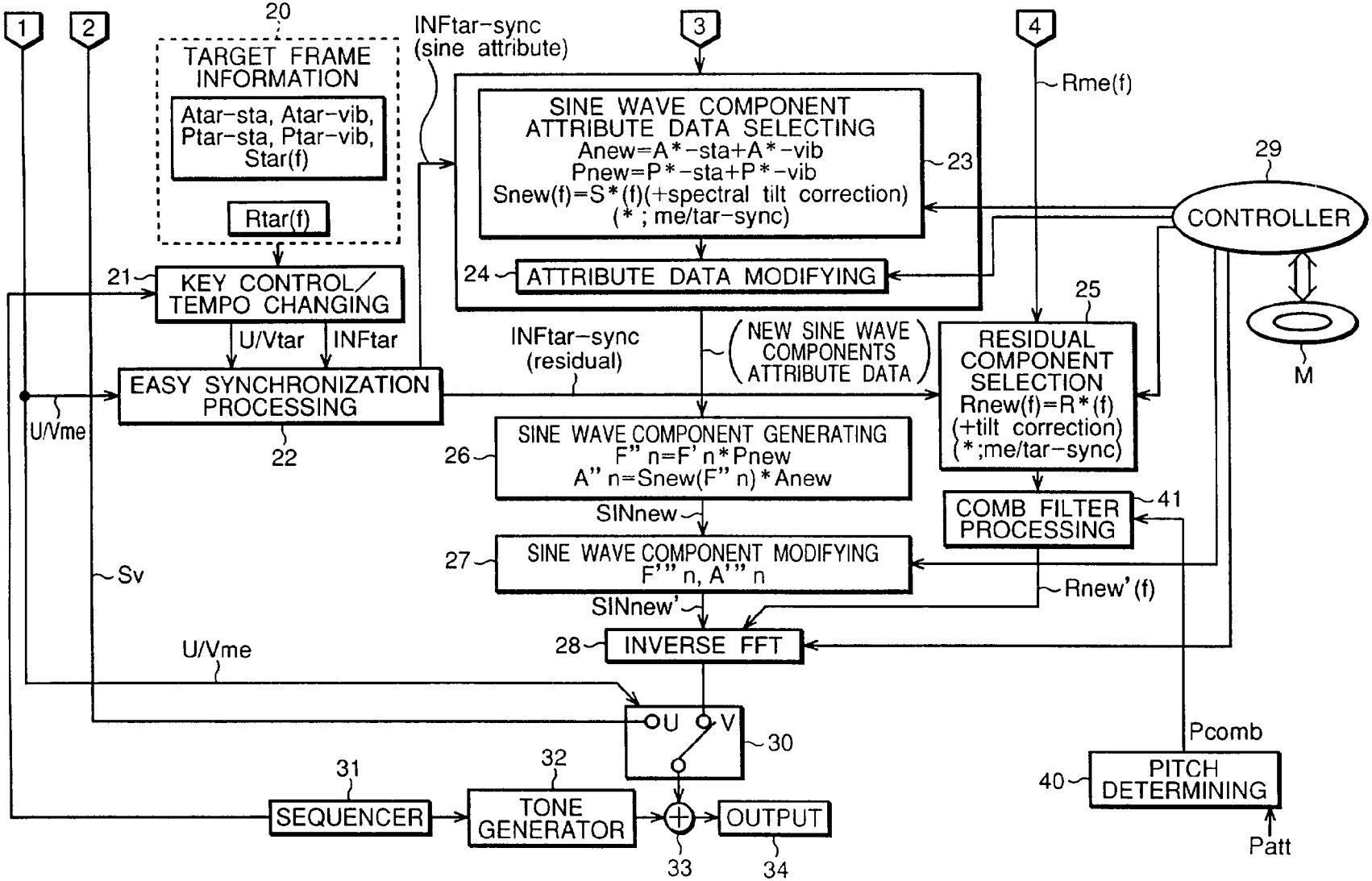
FIG. 16 is a block diagram illustrating a constitution of a third preferred embodiment.

Next, the detailed description is given to the third embodiment of the invention with reference to the drawings. The third embodiment is basically similar to the first embodiment shown in FIGS. 1 and 2. More specifically, the third embodiment has a first part and a second part. The first part has the construction shown in FIG. 1. The second part has the construction shown in FIG. 16, which is modified from the construction of FIG. 2. Referring to FIG. 16, there is shown a detailed constitution of the third embodiment. It should be noted that the present embodiment is an example in which the voice converting apparatus (voice converting method) according to the invention is applied to a karaoke apparatus that allows a singer to mimic particular singers. If the pitch and harmonics are removed from the residual components and combined with the sine wave components likewise the second embodiment, the residual components do not have a pitch element. The pitch is not maintained so that both of the sine wave components and the residual components are separately heard. Consequently, the naturalness of the synthesized voice may be impaired in extreme case. It is therefore an object of the third embodiment to provide a voice converting apparatus and a voice converting method that allow voice conversion without losing naturalness of the voice.

As shown in FIGS. 1 and 16, the inventive apparatus is constructed for converting an input voice signal into an output voice signal according to a target voice signal. In the inventive apparatus, an input device including a microphone block 1 provides the input voice signal composed of original sinusoidal components and original residual components other than the original sinusoidal components. A separating device including blocks 2-10 separates the original sinusoidal components and the original residual components from each other. A first modifying device including a block 23 modifies the original sinusoidal components based on target sinusoidal components contained in the target voice signal so as to form new sinusoidal components. A second modifying device including a block 25 modifies the original residual components based on target residual components contained in the target voice signal other than the target sinusoidal components so as to form new residual components. A shaping device including blocks 40 and 41 shapes the new residual components by introducing thereinto a fundamental tone and overtones of the fundamental tone corresponding to a desired pitch. An output device including a block 28 combines the new sinusoidal components and the shaped new residual components with each other for producing the output voice signal.

According to the invention, the sine wave components and the residual components, which are extracted from the input voice signal, are modified based on the sine wave components and the residual components of the target voice signal, respectively. Then, before the sine wave components and the residual components respectively modified are synthesized with each other, the pitch component and its harmonic components of the sine wave components are added to the residual components. As a result, only the pitch component of the sine wave components become audible, thereby improving naturalness of the converted voice.

Referring to FIG. 16, specific description is given to operation of the pitch deciding block 40, which is one of significant elements of the third embodiment. The pitch deciding block 40 takes the pitch Patt from the attribute data modifier 24 as the comb filter pitch (Pcomb) to supply the same to the comb filter processor 41. Namely, the shaping device including the block 40 introduces the fundamental tone corresponding to the desired pitch which is identical to a pitch of the new sinusoidal components.

Figure 17:
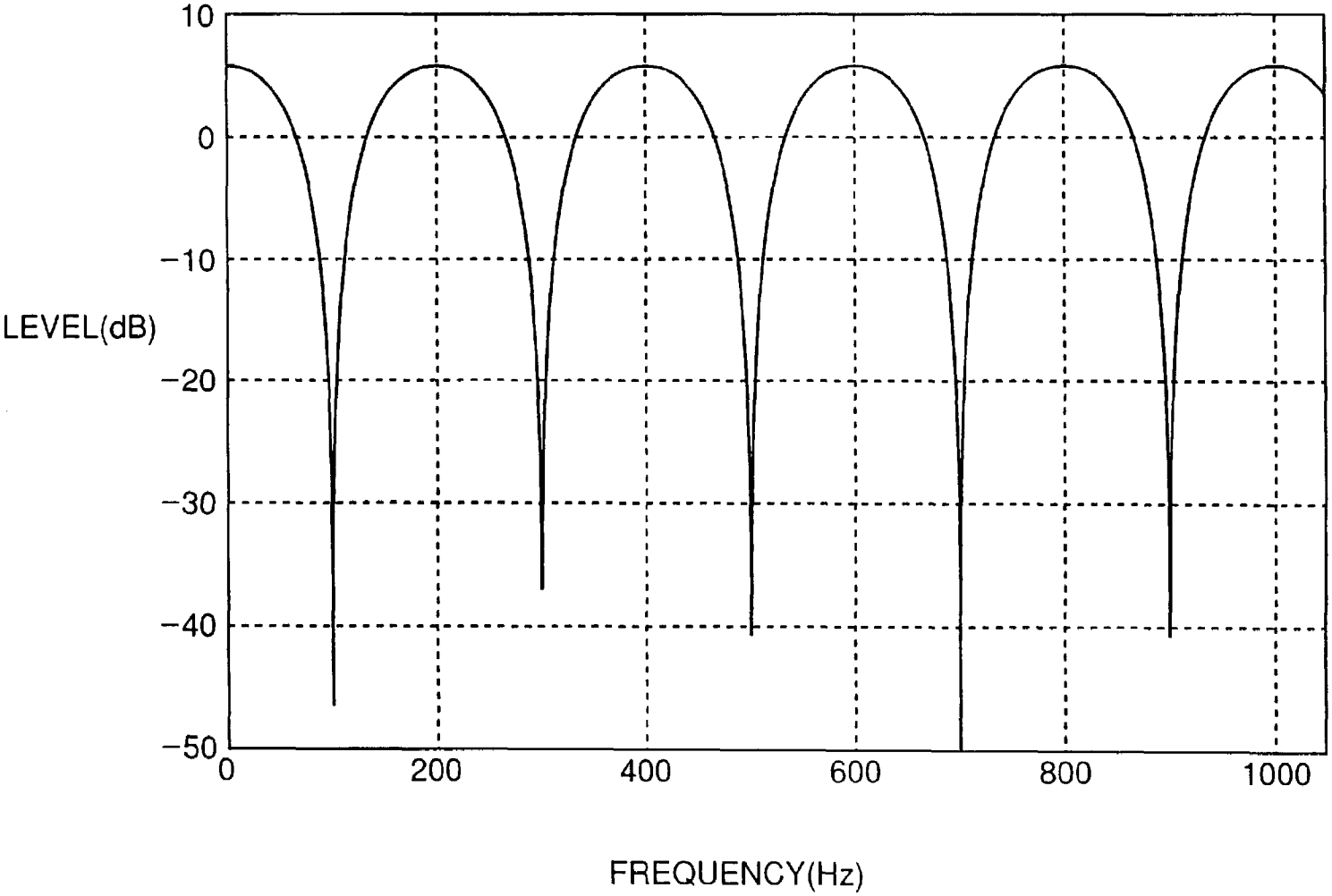
FIG. 17 is a conceptual diagram illustrating a frequency characteristic of a comb filter where a pitch Pcomb is set to 200 Hz.

Next, the description is given to operation of the comb filter processor 41. The comb filter processor 41 uses the pitch Pcomb to constitute a comb filter through which the residual components Rnew(f) are filtered to add a pitch component and its harmonic components thereto. Consequently, new residual components Rnew'(f) are obtained and supplied to an inverse FFT block 28. FIG. 17 is a conceptual diagram illustrating a characteristic example of the comb filter when the pitch Pcomb is set to 200 Hz. As shown, when the residual components are developed along the frequency axis, the comb filter is constituted on the frequency axis based on the pitch Pcomb. Namely, the shaping device includes a comb filter having a series of peaks of pass frequencies corresponding to a series of the fundamental tone and the overtones for filtering the new residual components along a frequency axis.

Figure 18:
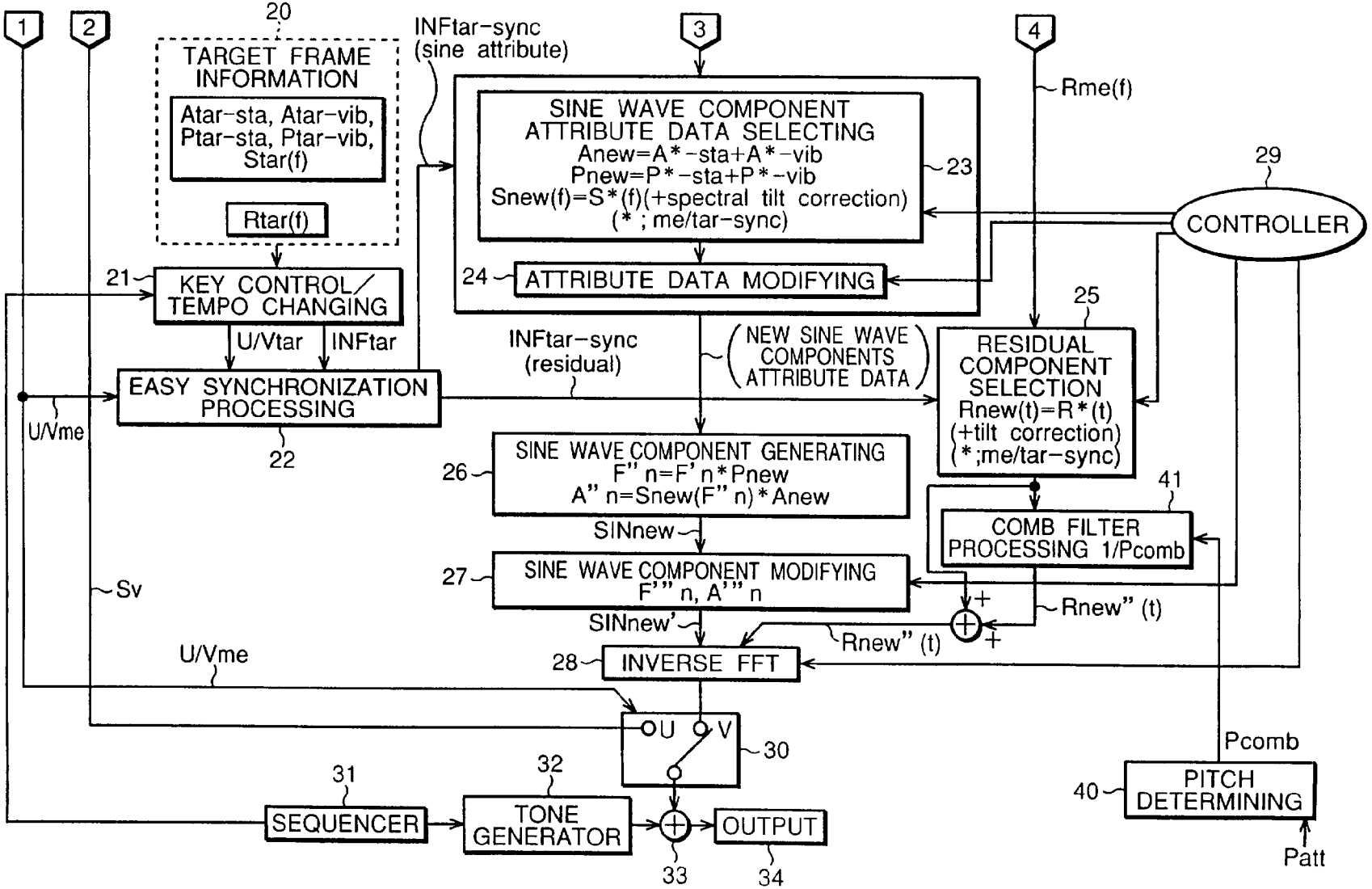
FIG. 18 is a (partial) block diagram illustrating a structure of a variation of the third embodiment of the inventive voice converting apparatus.
Figure 19:
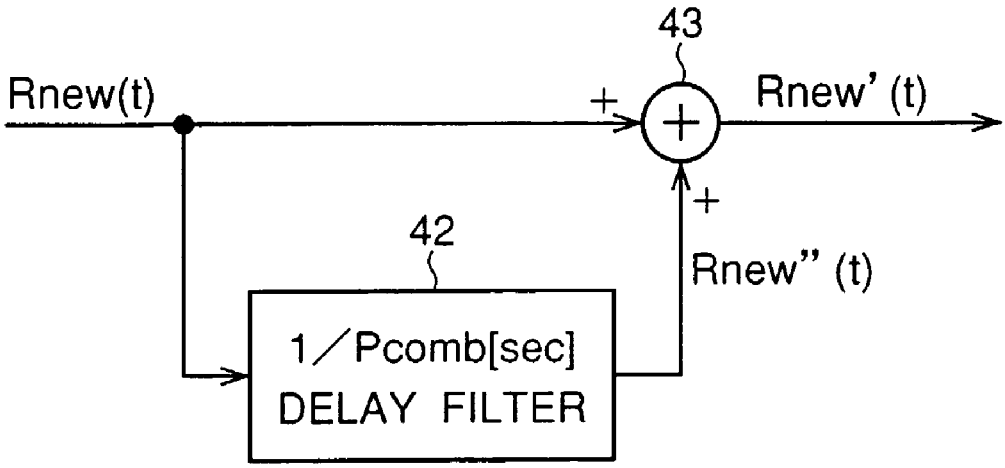
FIG. 19 is a block diagram for describing an example of a construction of a comb filter (delay filter).

In the above-mentioned third embodiment, the residual components are presented along the frequency axis. The present invention is not limited to that embodiment, and the residual components may be developed along the time axis. FIG. 18 is a block diagram illustrating (a part of) a constitution in which a variation is made to the above-mentioned third embodiment. FIG. 19 is a block diagram illustrating an example of a construction of the comb filter (delay filter). It should be noted here that blocks common to those of FIG. 16 are given the same reference numerals with their description omitted. As shown, the comb filter processor 41 takes the inverse of the pitch Pcomb decided by the pitch deciding block 40 as a delay time to constitute the comb filter 42 (delay filter). Then, the comb filter 42 executes filtering of the residual components Rnew(t) to supply the filtered residual components to an adder 43 as a residual components Rnew"(t). The adder 43 adds a pitch component and its harmonic components to the residual components Rnew(t) by adding the filtered residual components Rnew"(t) to the residual components Rnew(t) to supply the same to the IFFT processor 8 as new residual components Rnew'(t). Namely, the shaping device utilizes the comb filter 42 having a delay loop creating a time delay equivalent to an inverse of the desired pitch for filtering the residual components along a time axis so as to introduce the fundamental tone and the overtones.

Even in the case where the residual components are processed on the time axis domain, it is possible to add the pitch component and its harmonic components to the residual components Rnew(t) as similar to the above-mentioned third embodiment. As a result, only the pitch of the sine wave components becomes audible in the final output voice, thereby improving naturalness of the voice. Consequently, a song sung by a mimicking singer is output along a karaoke accompaniment. The voice quality and singing mannerism is significantly influenced by a target singer, substantially becoming those of the target singer. Thus, a mimicking song is outputted. Further, a pitch component and its harmonic components are added to the residual components Rnew(f) to supply the residual components with the pitch identical to that of the sine wave components. Thus, a composite voice mixed with the sine wave components and the residual components is kept in tune without losing naturalness of the voice.

A fourth embodiment of the invention will be described in further detail by way of example with reference to the accompanying drawings.

1. Constitution of the Fourth Embodiment

1-1. Schematic Constitution of the Fourth Embodiment

Figure 20:
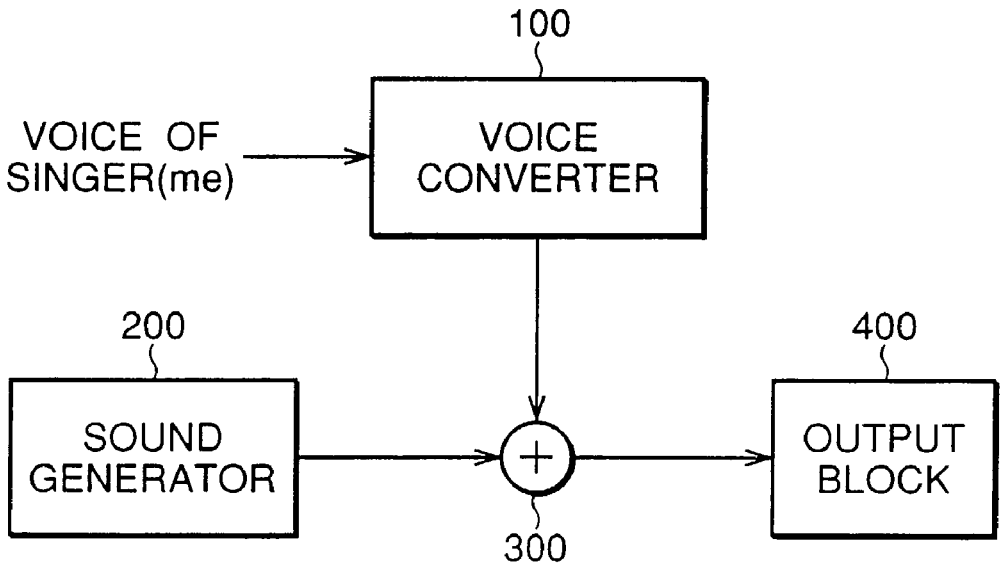
FIG. 20 is a diagram illustrating a schematic constitution of a fourth preferred embodiment of the invention.

Referring to a functional block diagram of FIG. 20, a schematic constitution of the fourth embodiment is described. It should be noted that the present embodiment is an example in which the voice converting apparatus (voice converting method) according to the invention is applied to a karaoke apparatus in which a mixer 300 mixes a voice of a singer (me) converted by a voice converting block 100 with a sound of a karaoke accompaniment generated by a sound generator 200 to output the mixed sound from an output block 400.

Figure 29:
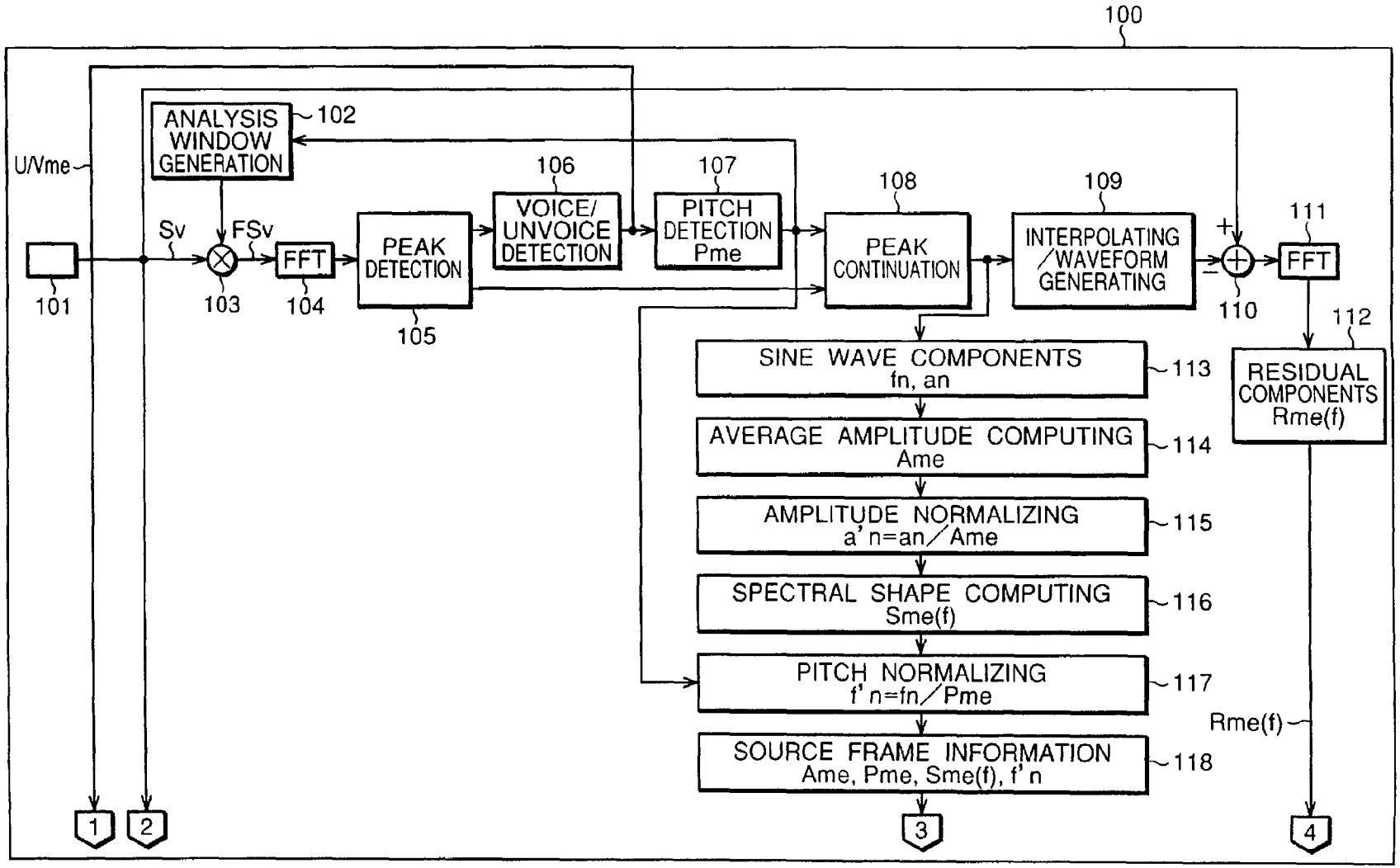
FIG. 29 is a block diagram illustrating a part of the constitution of the fourth embodiment.
Figure 30:
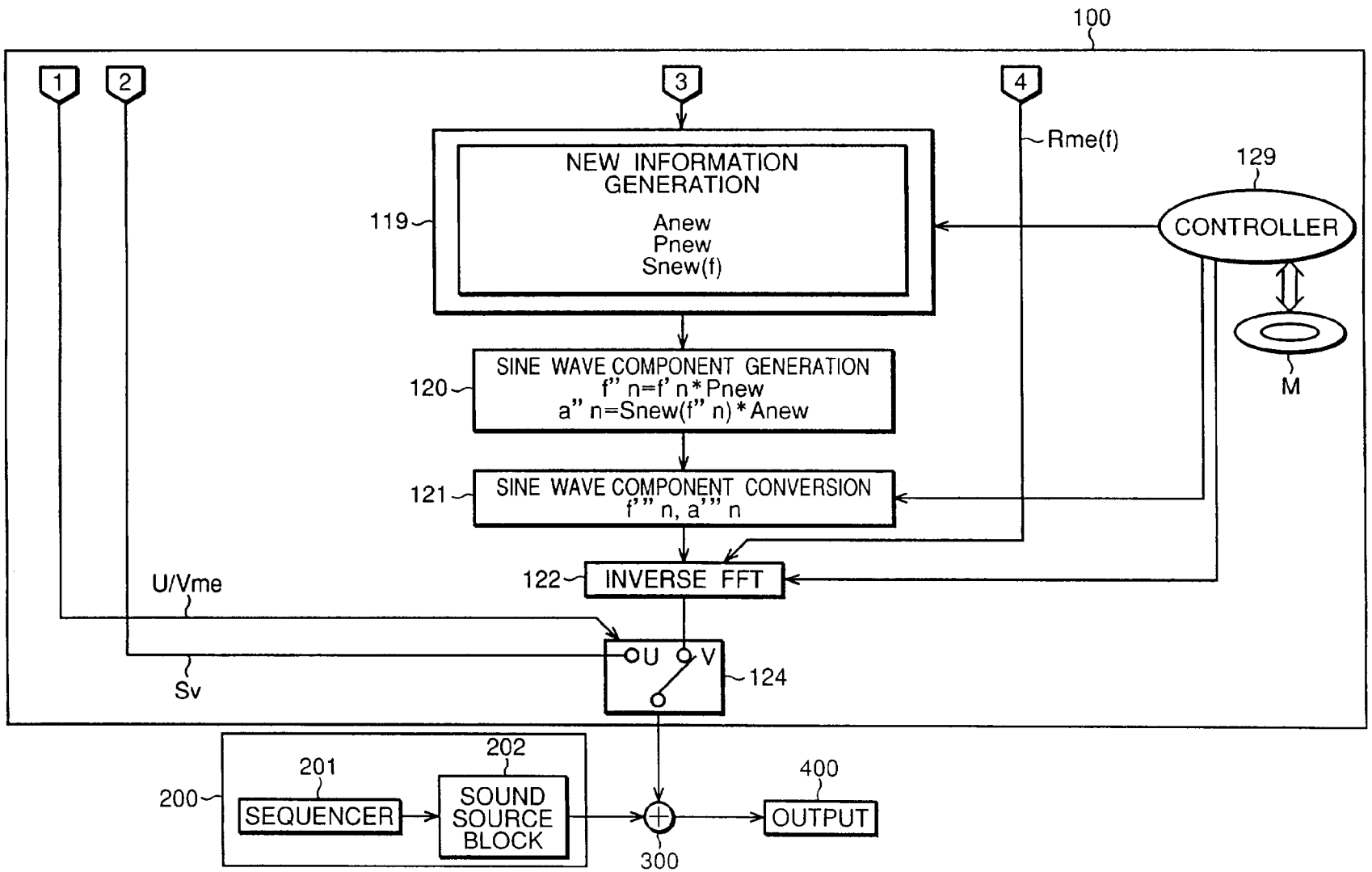
FIG. 30 is a block diagram illustrating the remaining part of the constitution of the fourth embodiment.

FIGS. 29 and 30 show detailed constitution of each block. Description is made first to the basic principle of the embodiment, then to operation of the embodiment based on the detailed constitution of FIGS. 29 and 30.

1-2. Basic Principle of the Fourth Embodiment (1) Outline of Basic Principle In the embodiment, the pitch and voice quality are converted by modifying attribute data of sine wave components extracted from an input voice signal. Of waveform components constituting an input voice signal Sv, the sine wave component is data indicative of a sine wave element, namely data obtained from a local peak value detected in the input voice signal Sv after FFT conversion, and is represented by a specific frequency and a specific amplitude. The local peak value will be described in detail later.

The present embodiment is based on a characteristic that the voiced sound includes sine waves having the lowest frequency or basic frequency (f0) and frequencies (f1, f2, . . . fn: hereinafter, referred to as frequency components) which are almost integer multiples of the basic frequency, so that the pitch and frequency characteristics can be modified on the frequency axis by converting the frequency and amplitude of each sine wave component. For execution of such processing on the frequency axis, a well-known technique for spectral modeling synthesis (SMS) is used. It should be noted that, since such a SMS technique is shown in detail in U.S. Pat. No. 5,029,509 or the like, detailed description is not made here to the SMS.

In the present embodiment, the input voice signal of a karaoke player or singer (me) is first analyzed in real time by SMS (Spectral Modeling Synthesis) including FFT (Fast Fourier Transform) to extract sine wave components (Sinusoidal components) on a frame basis. The term "frame" denotes a unit by which the input voice signal is extracted in a sequence of time frames, so-called time windows.

Figure 21:
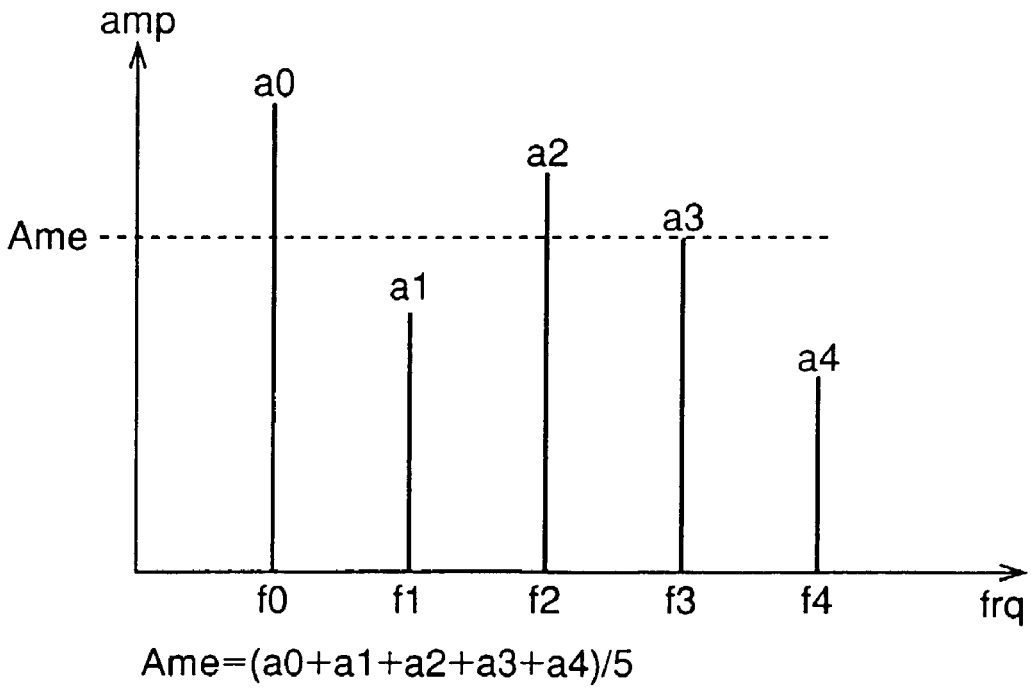
FIG. 21 is a diagram illustrating sine wave components of an input voice signal of a singer.

FIG. 21 shows sine wave components of the input voice signal Sv in a certain frame. Referring to FIG. 21, sine wave components (f0, a0), (f1, a1), (f2, a2), . . . (fn, an) are extracted from the input voice signal Sv. In the embodiment, "Pitch" indicative of tone height, "Average amplitude" indicative of tone intensity and "Spectral shape" indicative of a frequency characteristic (voice quality), which are computed from the sine wave components, are used as attribute data of the voice signal Sv of the singer (me).

The term "Pitch" denotes a basic frequency f0 of the voice, and the pitch of the singer (me) is indicated by Pme. The "Average amplitude" is the average amplitude value of all the sine wave components (a1, a2, . . . an), and the average amplitude data of the singer (me) is indicated by Ame. The "Spectral shape" is an envelop defied by a series of break points corresponding to each sine wave component (fn, a'n) identified by the frequency fn and normalized amplitude a'n. The function of the spectral shape of the singer (me) is indicated by Sme(f). It should be noted that the normalized amplitude a'n is a numerical value obtained by dividing the amplitude an of each sine wave component by the average amplitude Ame.

Figure 22:
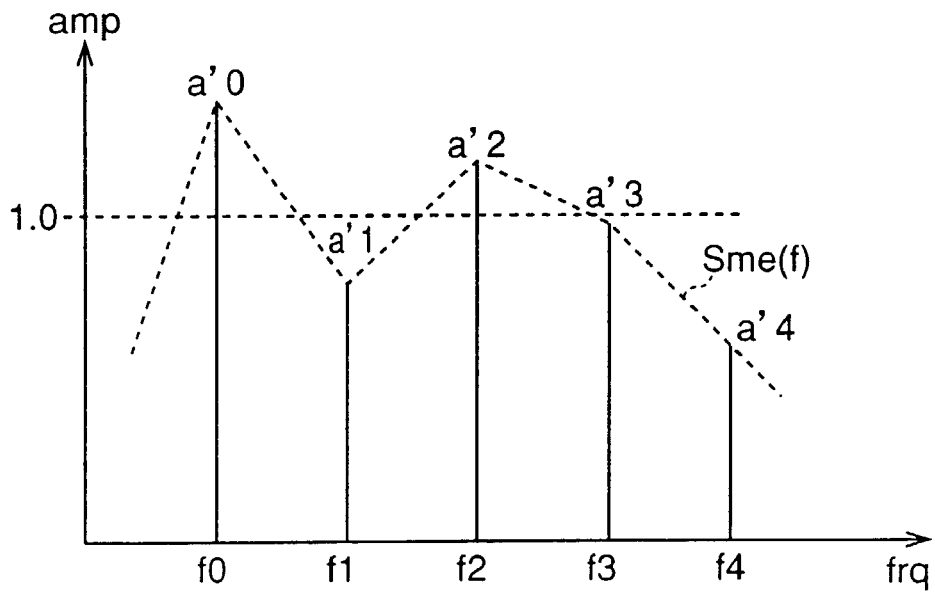
FIG. 22 is a diagram illustrating a spectral shape of the input voice of the singer.

FIG. 22 shows the spectral shape Sme(f) of the singer (me) generated based on the sine wave components of FIG. 21. In the embodiment, the line chart is indicative of the voice quality of the singer (me).

The present embodiment features that characteristics of the input voice signal are converted not only by converting the pitch, but also by generating a new spectral shape through conversion processing of at least one of the frequency and amplitude of each sine wave component corresponding to each break point of the spectral shape of the singer (me). Namely, the pitch is changed by shifting the frequency of each sine wave component along the frequency axis, while the voice quality is changed by converting the sine wave components based on the new spectral shape generated through the conversion processing for at least one of the frequency and amplitude to be taken as the break point of the spectral shape indicative of the frequency characteristic.

According to the fourth embodiment, an inventive apparatus is constructed for converting an input voice signal into an output voice signal dependently on a predetermined pitch of the output voice signal. In the inventive apparatus, an input device provides the input voice signal containing wave components. An separating device separates sinusoidal ones of the wave components from the input voice signal such that each sinusoidal wave component is identified by a pair of a frequency and an amplitude. A computing device computes a modification amount of at least one of the frequency and the amplitude of the separated sinusoidal wave components according to the predetermined pitch of the output voice signal. A modifying device modifies at least one of the frequency and the amplitude of the separated sinusoidal wave components by the computed modification amount to thereby form new sinusoidal wave components. An output device produces the output voice signal based on the new sinusoidal wave components.

Figure 23:
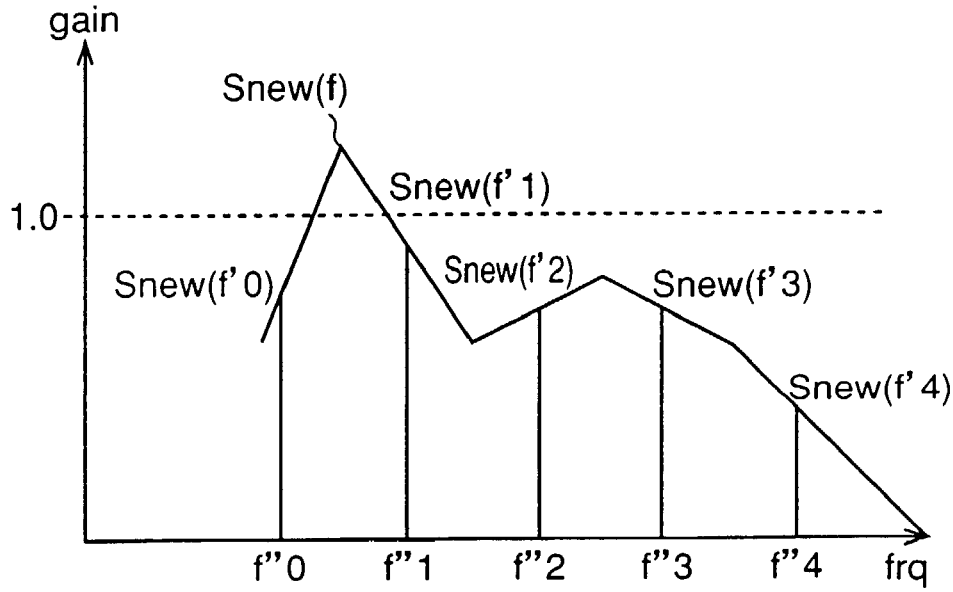
FIG. 23 is a diagram illustrating a new spectral shape.
Figure 24:
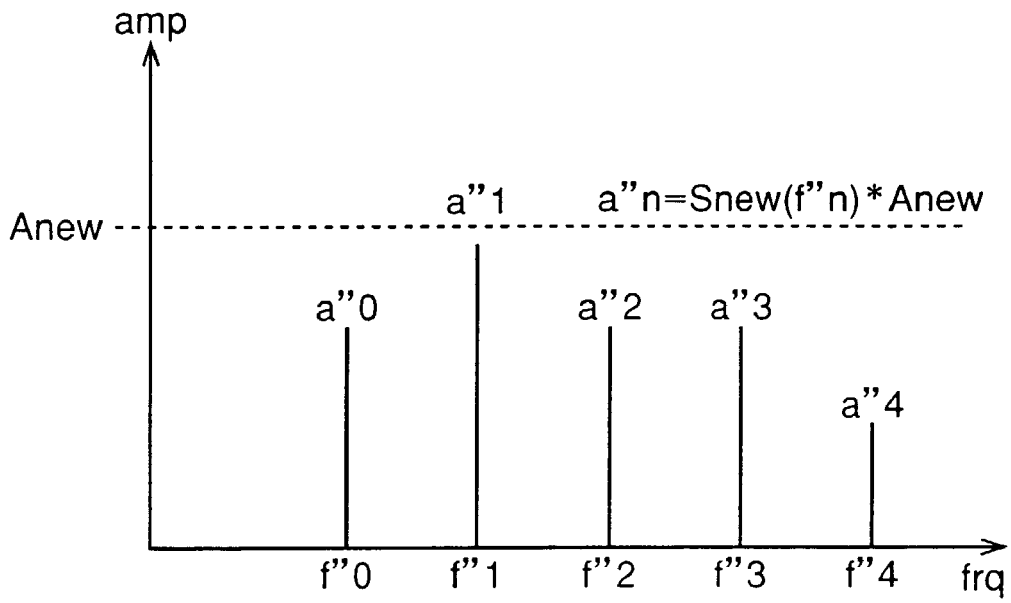
FIG. 24 is a diagram illustrating new sine wave components.

To be more specific, as shown in FIGS. 23 and 24, the frequency and the amplitude of each sine wave component are converted along with the generated spectral shape to obtain each new sine wave component according to the shifted pitch. The shifted pitch, namely the output pitch of a voice signal of which the voice has been converted and is output as a new voice signal, is computed by an appropriate magnification. For example, in case of conversion from a male voice to a female voice, the pitch of the singer (me) is doubled, while in case of conversion from a female voice to a male voice, the pitch of the singer (me) is lowered by one-half (½).

Referring to FIG. 23, the frequency f"0 is a fundamental or basic frequency corresponding to the output pitch, and frequencies f"1 to f"4 are harmonic frequencies corresponding to overtones of the fundamental tone determined by the basic frequency f"0. Indicated by Snew(f) is the function of the new spectral shape generated. Then, each normalized amplitude is specified by the frequency (f). As shown, the normalized amplitude of the sine wave component having the frequency f"0 is found to be Snew(f"0).

Then, the normalized amplitude is obtained for each of the sine wave components in the same manner, and is multiplied by the converted average amplitude Anew to determine the frequency f"n and the amplitude a"n of each sine wave component as shown in FIG. 24.

Thus, the sine wave components (frequency, amplitude) of the singer (me) are converted based on the new spectral shape generated by changing at least one of the frequency and the amplitude to be taken as the break point of the spectral shape generated based on the sine wave components extracted from the voice signal Sv of the singer (me). Thus, the pitch and the voice quality of the input tone signal Sv are modified by executing the above conversion processing, and the resultant tone is outputted.

Namely, the inventive apparatus is constructed for converting an input voice signal into an output voice signal by modifying a spectral shape. In the inventive apparatus, an input device provides the input voice signal containing wave components. An separating device separates sinusoidal ones of the wave components from the input voice signal such that each sinusoidal wave component is identified by a pair of a frequency and an amplitude. A computing device computes a spectral shape of the input voice signal based on a set of the separated sinusoidal wave components such that the spectral shape represents an envelope having a series of break points corresponding to the pairs of the frequencies and the amplitudes of the sinusoidal wave components. A modifying device modifies the spectral shape to form a new spectral shape having a modified envelope. A generating device selects a series of points along the modified envelope of the new spectral shape, and generates a set of new sinusoidal wave components each identified by each pair of a frequency and an amplitude, which corresponds to each of the series of the selected points. An output device produces the output voice signal based on the set of the new sinusoidal wave components. Specifically, the generating device comprises a first section that selects the series of the points along the modified envelope of the new spectral shape in which each selected point is denoted by a pair of a frequency and an normalized amplitude calculated using a mean amplitude of the sinusoidal wave components of the input voice signal, and a second section that generates the set of the new sinusoidal wave components in correspondence with the series of the selected points such that each new sinusoidal wave component has a frequency and an amplitude calculated from the corresponding normalized amplitude with using a specific mean amplitude of the new sinusoidal wave components of the output voice signal. Further, the generating device comprises a first section that determines a series of frequencies according to a specific pitch of the output voice signal, and a second section that selects the series of the points along the modified envelope in terms of the series of the determined frequencies, thereby generating the set of the new sinusoidal wave components corresponding to the series of the selected points and having the determined frequencies.

In the present embodiment, there are two types of the spectral shape converting methods: one involves "shift of spectral shape" in which the spectral shape is shifted along the frequency axis with maintaining the entire shape, while the other involves "control of spectral tilt" in which the tilt of the spectral shape is modified. The following description is made first to the concepts of the shift of the spectral shape and the control of the spectral tilt, then to specific operation of the present embodiment.

(2) Shift of Spectral Shape

Figure 25:
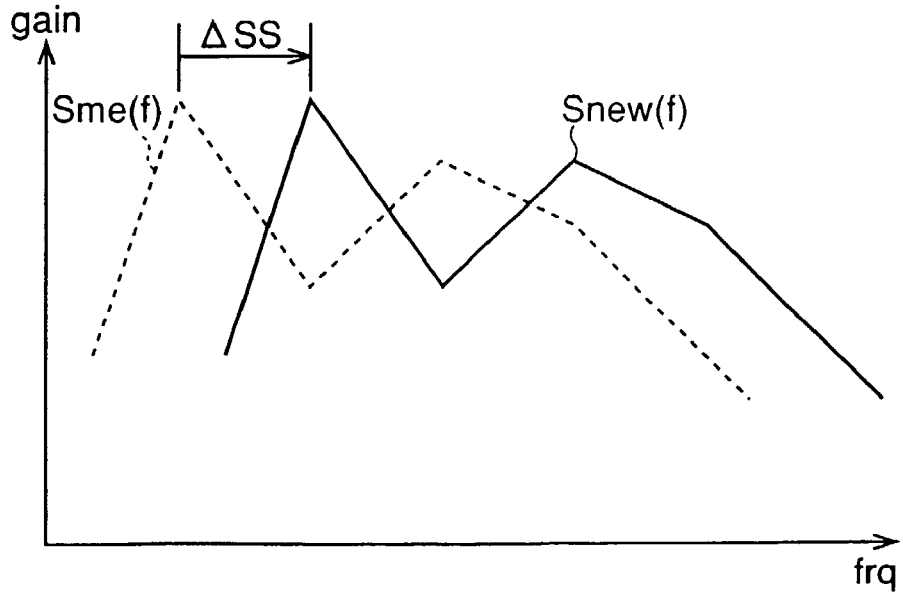
FIG. 25 is a diagram for explaining shift of a spectral shape.
Figure 26:
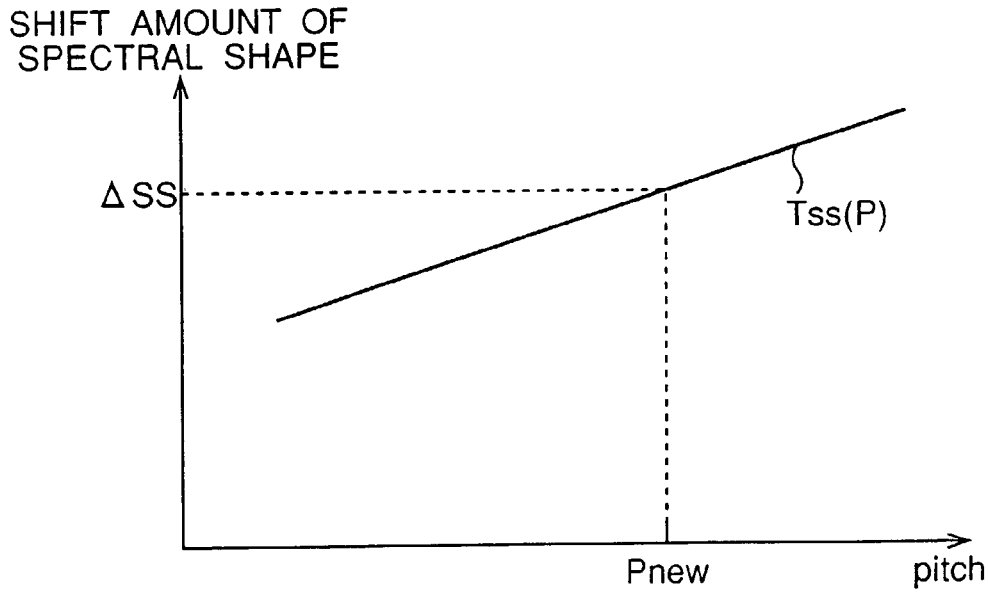
FIG. 26 is a diagram illustrating the shift amount of the spectral shape.

FIGS. 25 and 26 are diagrams for explaining the concept of shifting the spectral shape. FIG. 25 is a diagram illustrating a spectral shape, choosing an amplitude and a as the ordinate and abscissa, respectively. As shown, Sme(f) indicates the spectral shape generated based on the input voice signal Sv of the singer (me); Snew(f) indicates the new spectral shape after shifted. It should be noted that FIG. 25 shows an example in which an input male voice having a male voice quality is converted into a female voice having a female voice quality. The female voice typically has a basic frequency f0 (pitch) higher than that of the male voice. Further, the sine wave components of the female voice are distributed in a high-frequency region on the frequency axis compared to those of the male voice.

Therefore, conversion into the feminine voice quality with maintaining the vocal quality of the singer (me) can be executed by raising (doubling) the pitch of the singer (me) and generating the new spectral shape obtained by shifting the spectral shape of the singer (me) in the high-frequency direction. Conversely, in case of conversion from a female voice to a male voice, the pitch of the singer (me) is lowered (by one-half) and the spectral shape is shifted in the low-frequency direction, thereby realizing the conversion into the male voice quality with maintaining the vocal manner of the singer (me). Namely, in the inventive apparatus, the modifying device forms the new spectral shape by shifting the envelope along an axis of the frequency on a coordinates system of the frequency and the amplitude.

Next, ΔSS as shown indicates the shift amount of the spectral shape, determined by a rate function shown in FIG. 26. FIG. 26 is a diagram illustrating the shift amount of the spectral shape, choosing a pitch as the abscissa and a shift amount (frequency) of the spectral shape as the ordinate. ΔTss(P) as shown is the rate function for use in determining the shift amount of the spectral shape according to the output pitch. In the present embodiment, the shift amount of the spectral shape is thus determined based on the output pitch and the rate function Tss(P) to generate the new spectral shape. Namely, in the inventive apparatus, the modifying device modifies the spectral shape to form the new spectral shape according to a specific pitch of the output voice signal such that a modification degree of the frequency or the amplitude of the spectral shape is determined in function of the specific pitch of the output voice signal.

For example, as illustratively shown in FIGS. 25 and 26, if the output pitch is Pnew, the shift amount ΔSS of the spectral shape is obtained based on the output pitch Pnew and the rate function Tss(P) (See FIG. 26). Then, the spectral shape Sme (f) generated based on the voice signal Sv of the singer (me) is so converted that the amount to be shifted along the frequency axis becomes ΔSS, whereby the new spectral shape Snew(f) is generated.

The conversion is thus executed by shifting the spectral shape along the frequency axis with maintaining the entire shape, so that the vocal quality the person concerned can be maintained even if the pitch has been shifted. Further, the shift amount of the spectral shape is determined by use of the rate function Tss(P), so that a very small shift amount of the spectral shape can easily be controlled according to the output pitch, thereby obtaining more natural feminine or manly output.

(3) Control of Spectral Tilt

Figure 27:
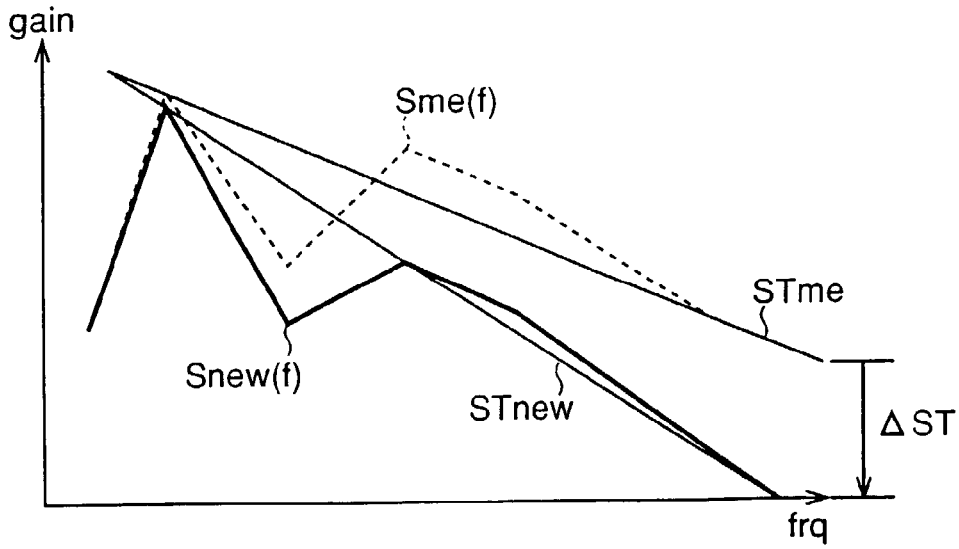
FIG. 27 is a diagram for explaining control of a spectral tilt.
Figure 28:
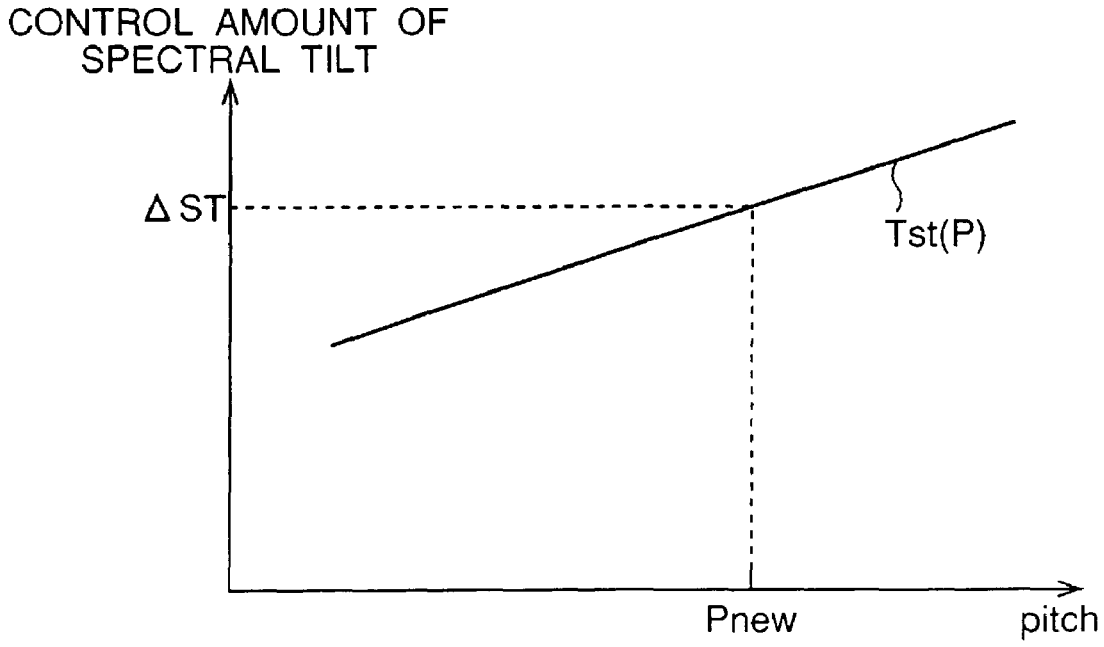
FIG. 28 is a diagram illustrating the control amount of the spectral tilt.

Next, FIGS. 27 and 28 are diagrams illustrating the concept of control of the spectral tilt. FIG. 27 is a diagram illustrating a spectral shape, choosing an amplitude and a frequency as the ordinate and the abscissa, respectively. As shown, Sme(f) indicates a spectral shape generated based on the input voice signal Sv of the singer (me), and STme indicates the spectral tilt of Sme(f). The spectral tilt is a straight line of the tilt that is almost approximated to the amplitude of the sine wave components. Details are explained in Japanese Application Laid-Open Publication No. Hei 7-325583. In the control by the spectral tilt, the modifying device forms the new spectral shape by changing a slope of the envelope.

Referring to FIG. 27, the tilt STnew of Snew(f) is found larger than the tilt STme of Sme(f). This results from the characteristic that damping of harmonic energy to the basic frequency is faster in the female voice than that in the male voice. Namely, in case of conversion of the spectral shape from the male voice to the female voice, the tilt of the spectral shape under control has only to be changed so that the tilt becomes larger (see Snew(f)). Likewise the shift amount of the spectral shape has been determined by the rate function according to the output pitch, the control amount of the spectral tilt is also determined by a rate function Tst(P) according to the output pitch.

FIG. 28 is a diagram illustrating the control amount of the spectral tilt, choosing the control amount of the spectral tilt (variation in tilt) as the ordinate and the pitch as the abscissa. Tst(P) as shown indicates the rate function for use in determining the control amount of the spectral tilt according to the output pitch. For example, if the output pitch is Pnew, the variation ΔST in tilt is obtained based on the output pitch Pnew and the rate function Tst(P) (see FIG. 28). Then, the tilt STme of the spectral shape Sme(f) generated based on the input voice signal of the singer (me) is changed by ΔST to obtain a new spectral tilt Stnew. Then, the new spectral shape Snew(f) is so generated that the tilt becomes equivalent to the new spectral tilt Stnew (see FIG. 27). Thus, the control amount of the spectral tilt is determined according to the output pitch to convert the spectral shape, and this allows more natural voice conversion.

2. Detail Constitution and Operation of the Fourth Embodiment

Referring next to FIGS. 29 and 30, details of the constitution and operation of the above-mentioned fourth embodiment are described.

2-1. Voice Converter 100

(1) Outline of Operation of Voice Converter 100

Figure 31:
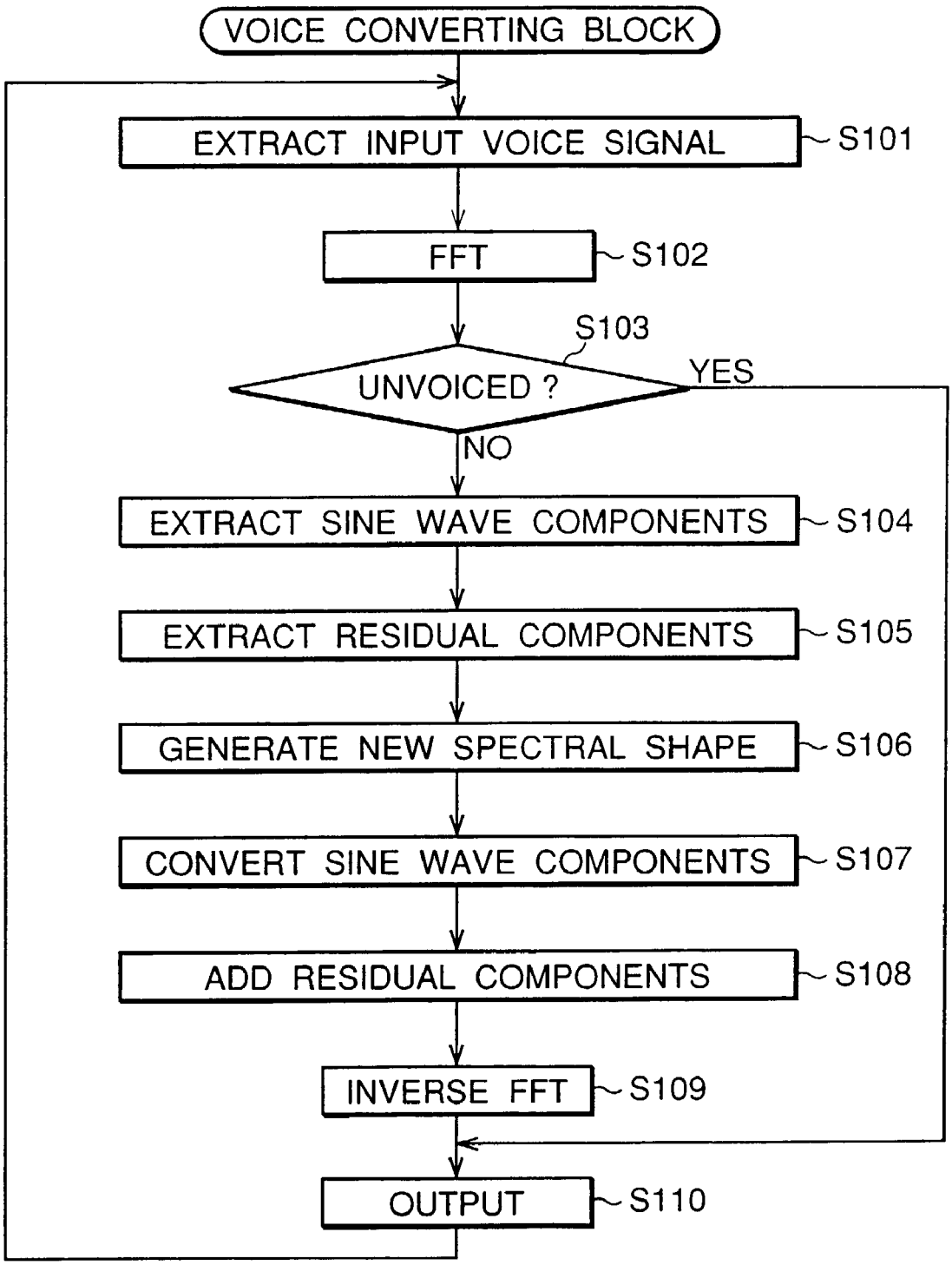
FIG. 31 is a flowchart illustrating operation of a voice converter.

Description is made first to the voice converter 100. For easy understanding, the outline of operation of the voice converter 100 is described with reference to the flowchart of FIG. 31. First, an input voice signal Sv of a singer (me) of which the voice is to be converted is extracted on a frame basis (S101) to execute FFT in real time (S102). Based on the FFT result, it is determined whether the input voice signal is an unvoiced sound (including voiceless)(S103). If unvoiced (S103: YES), the processing of steps S104 through S109 is skipped and the input voice signal Sv is output without change.

On the other hand, if it is determined in step S103 that the input voice signal Sv is not an unvoiced sound (S103: NO), SMS analysis is executed based on FSv to extract sine wave components on a frame basis (S104). Then, residual components are separated from the input voice signal Sv other than the sine wave components on a frame basis (S105). In this case, for the above-mentioned SMS analysis, pitch sync analysis is employed in which an analysis window width of the present frame regulated according to the pitch in the previous frame.

Next, the spectral shape generated based on the sine wave components extracted in step S104 is converted (S106), and the sine wave components are converted based on the converted spectral shape (S107). The converted sine wave components are added to the residual components extracted in step S105 (S108) to execute inverse FFT (S109). Then, the converted voice signal is output (S110). After the converted voice signal has been output, the processing procedure returns to step S101 in which the voice signal Sv in the next frame is input. According to the new voice signal obtained during repetition of the processing of steps S101 through S110, the reproduced voice of the singer (me) sounds like that of another singer.

[2] Details of Constitution and Operation of Voice Converter 100

Referring to FIGS. 29 and 30, there are shown details of constitution and operation of the voice converter 100. As shown in FIG. 29, a microphone 101 picks up the voice of a mimicking singer (me) and outputs an input voice signal Sv to an input voice signal multiplier 103. Concurrently, an analysis window generator 102 generates an analysis window (for example, a Hamming window) AW having a period which is a fixed multiplication (for example 3.5 times) of the period of the pitch detected in the last frame, and outputs the generated AW to the input voice signal multiplier 103. It should be noted that, in the initial state or if the last frame contains an unvoiced sound (including no tone or voiceless), an analysis window having a preset fixed period is outputted to the input voice signal multiplier 103 as the analysis window AW.

Then, the input voice signal multiplier 103 multiplies the inputted analysis window AW by the input voice signal Sv to extract the input voice signal Sv on a frame basis. The extracted voice signal is outputted to a FFT 104 as a frame voice signal FSv. To be more specific, the relationship between the input voice signal Sv and frames is indicated in FIG. 32, in which each frame FL is set so as to partially overlap its preceding frame.

Next, in the FFT 104 shown by FIG. 29, the frame voice signal FSv is analyzed. At the same time, a local peak is detected by a peak detector 105 from a frequency spectrum, which is the output of the FFT 104. To be more specific, relative to the frequency spectrum as shown in FIG. 33, local peaks indicated by "x" are detected. Each local peak is represented as a combination of a frequency value and an amplitude value. Namely, as shown in FIG. 32, local peaks are detected for each frame as a set of (f0, a0), (f1, a1), (f2, a2), . . . , (fN, aN).

Figure 32:
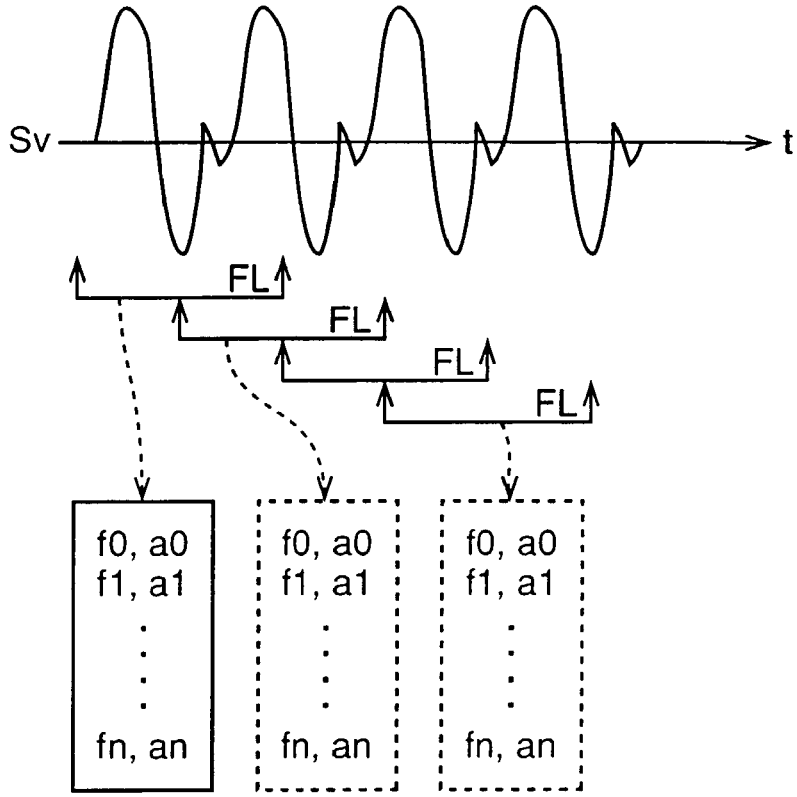
FIG. 32 is a diagram illustrating a sequence of frames of the input voice signal in the fourth embodiment.
Figure 33:
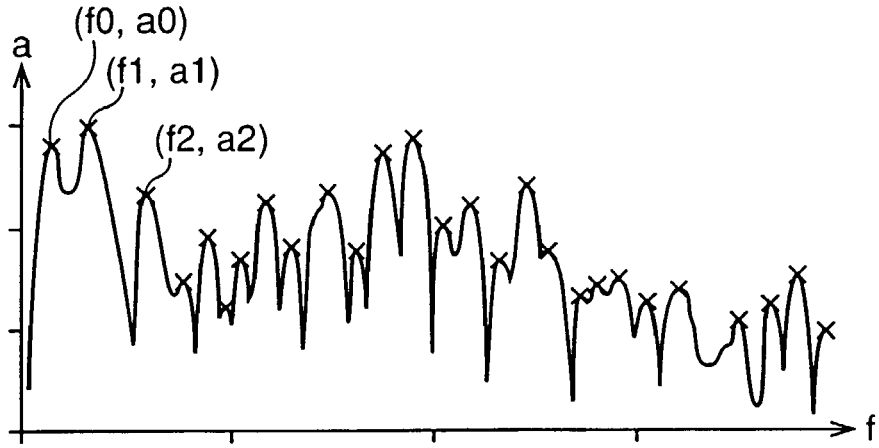
FIG. 33 is a diagram for explaining frequency spectrum peak detection in the fourth embodiment.

Then, as schematically shown in FIG. 32, each paired value (hereafter referred to as a local peak pair) within each frame is outputted to an unvoice/voice detector 106 and a peak continuation block 108. Based on the inputted local peaks of each frame, the unvoice/voice detector 106 detects that the frame is in an unvoiced state ('t', 'k' and so on) according to magnitudes of high frequency components, and outputs an unvoice/voice detect signal U/Vme to a pitch detector 107 and a cross fader 124. Alternatively, the unvoice/voice detector 106 detects that the frame is in an unvoiced state ('s' and so on) according to zero-cross counts of the frame voice signal in a unit time along the time axis, and outputs the unvoice/voice detect signal U/Vme to the pitch detector 107 and the cross fader 124. Further, the unvoice/voice detector 106 outputs the inputted local peak pairs to the pitch detector 107 directly, if the inputted frame is not in the unvoiced state.

Based on the inputted local peak pairs, the pitch detector 107 detects the pitch Pme of the frame corresponding to that local peak pairs. A more specific frame pitch Pme detecting method is disclosed in "Fundamental Frequency Estimation of Musical Signal using a two-way Mismatch Procedure," Maher, R. C. and J. W. Beauchamp (Journal of Acoustical Society of America 95(4), 2254-2263).

Figure 34:
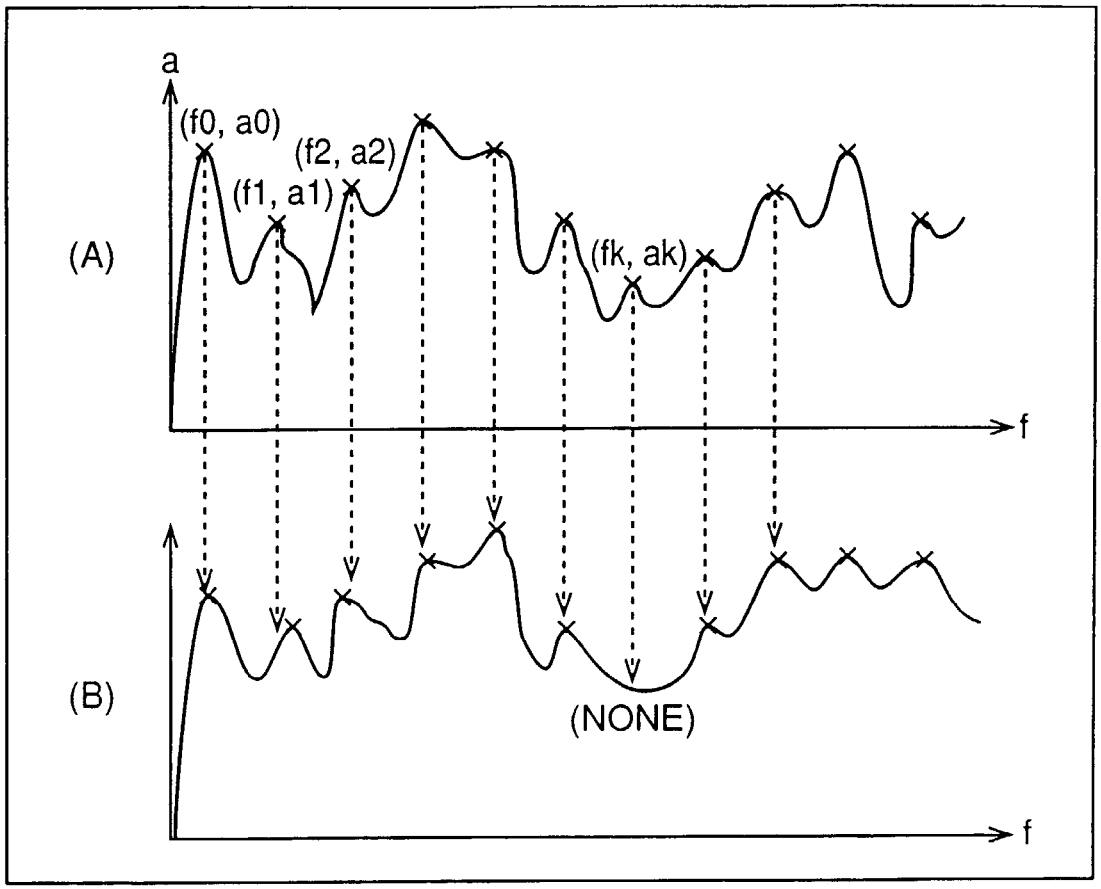
FIG. 34 is a diagram illustrating continuation operation of peak values through frames in the fourth embodiment.

Next, the local peak pairs outputted from the peak detector 105 are checked by the peak continuation block 108 for peak continuation between consecutive frames. If the continuation or linking is found, the consecutive local peaks are linked to form a data sequence. The following describes the link processing with reference to FIG. 34. Here it is assumed that the peaks as shown in FIG. 34(A) be detected in the last frame and the local peaks as shown in FIG. 34(B) be detected in the current frame. In this case, the peak continuation block 108 checks whether the local peaks corresponding to the local peaks (f0, a0), (f1, a1), (f2, a2), . . . , (fN, aN) detected in the last frame have also detected in the current frame. This check is made by determining whether the local peaks of the current frame are detected in a predetermined range around frequency points of the local peaks detected in the last frame. To be more specific, in the example of FIG. 34, as for the local peaks (f0, a0), (f1, a1), (f2, a2), and so on, the corresponding local peaks have been detected. As for a local peak (fK, aK) (refer to FIG. 34(A)), no corresponding local peak has been detected (refer to FIG. 34(B)). If corresponding local peaks have been detected, the peak continuation block 108 links the detected local peaks in the order of time, and outputs the data sequences of the paired values. If no local peak has been detected, the peak continuation block 108 provides data indicative of that there is no corresponding local peak in that frame.

Figure 35:
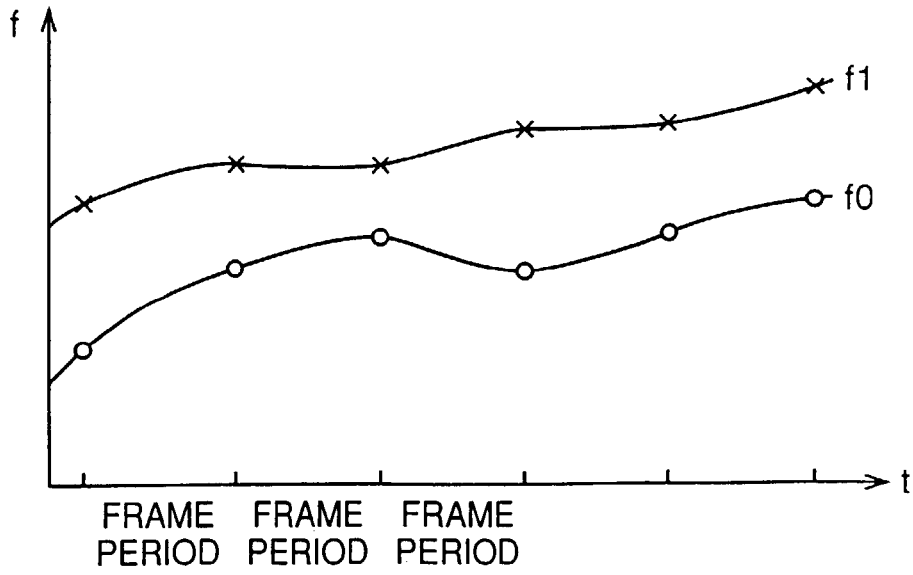
FIG. 35 is a diagram illustrating a changing state of frequency values in the fourth embodiment.

FIG. 35 shows an example of changes in the frequencies f0 and f1 of the local peaks extending two or more frames. These changes are also recognized with respect to amplitudes a0, a1, a2, and so on. In this case, the data sequence outputted from the peak continuation block 108 represents a discrete value to be outputted in every interval between frames. It should be noted that the paired value (parameters amplitude and frequency of sine wave) from the peak continuation block 108 corresponds to the above described sine wave component (fn, an).

An interpolator/waveform generator 109 interpolates the peak values outputted from the peak continuation block 108 and, based on the interpolated values, executes waveform generation according to a so-called oscillating method to output a synthetic signal $S_{SS}$ of the sine waves. The interpolation interval used in this case is the sampling rate (for example, 44.1 KHz) of a final output signal of an output block 134 to be described later. The solid lines shown in FIG. 35 show images indicative of the interpolation executed on the frequencies f0 and f1 of the sine wave components.

Then, a residual component detector 110 generates a residual component signal $S_{RD}$ (time waveform), which is a difference between the synthesized signal $S_{SS}$ of the sine wave components and the input voice signal Sv. This residual component signal $S_{RD}$ includes an unvoiced component included in a voice. On the other hand, the above-mentioned sine wave component synthesized signal $S_{SS}$ corresponds to a voiced component. Meanwhile, mimicking the voice of a target singer requires to process voiced sounds; it seldom requires to process unvoiced sounds. Therefore, in the present embodiment, voice conversion is executed on the deterministic component corresponding to a voiced vowel component. To be more specific, the residual component signal $S_{RD}$ is converted by the FFT 111 into a frequency waveform and the obtained residual component signal (the frequency waveform) is held in a residual component holding block 112 as Rme(f).

On the other hand, N number of sine wave components (f0, a0), (f1, a1), (f2, a2), and so on (hereafter generically represented as fn, an, n=0 to (N−1)) outputted from the peak detector 105 through the peak continuation block 108 are held in the sine wave component holding block 113. The amplitude An is inputted into a mean amplitude computing block 114. The mean amplitude Ame is computed by the following relation for each frame:

$$Ame=\Sigma(an)/N$$

For example, in the example shown in FIG. 21, five number of sine wave component values (n=5) are held in the sine wave component latching block 113, hence the mean amplitude is calculated by Ame=(a0+a1+a2+a3+a4)/5.

Then, each amplitude An is normalized by the mean amplitude Ame according to the following relation in an amplitude normalizer 115 to obtain normalized amplitude a'n:

$$a'n=an/Ame$$

Then, in a spectral shape computing block 116, an envelope is generated as spectral shape Sme(f) with each sine wave component (fn, a'n) identified by the frequency fn and te normalized amplitude a'n being a break point as shown in FIG. 22. In this case, the value of amplitude at an intermediate frequency point between two break points is computed by, for example, linear-interpolating these two break points. It should be noted that the interpolating is not limited to linear-interpolation.

Then, in a pitch normalizer 117, each frequency Fn is normalized by pitch Pme detected by the pitch detector 107 to obtain normalized frequency f'n.

$$f'n=fn/Pme$$

Consequently, a source frame information holding block 118 holds mean amplitude Ame, pitch Pme, spectral shape Sme(f), and normalized frequency f'n, which are source attribute data corresponding to the sine wave components included in the input voice signal Sv. It should be noted that, in this case, the normalized frequency f'n represents a relative value of the frequency of a harmonics tone sequence. If a harmonics tone structure of the frame is handled as a complete harmonics tone structure, the normalized frequency f'n need not be held.

Turning to FIG. 30, a new information generator 119 obtains a new average amplitude (Anew) corresponding to the converted voice, a new pitch (Pnew) after converted and a new spectral shape (Snew(f)) based on the average amplitude Ame, pitch Pme, spectral shape Sme(f) and normalized frequency f'n, which are held in the source frame information holding block 118 (FIG. 29).

First, the new average amplitude (Anew) is described. In the present embodiment, the average amplitude (Anew) is obtained by the following relations:

$$Anew=Ame$$

Namely, the new average amplitude is identical to the original average amplitude (Ame).

Next, the new pitch (Pnew) after converted is described. The new information generator 119 receives conversion information from a controller 123 that instructs what kind of conversion is to be executed. If the conversion information indicates a male voice to female voice conversion, the new information generator 19 computes Pnew from the following relation:

$$Pnew=Pme\times 2$$

Namely, if a male voice is to be converted into a female voice, the pitch of the input voice signal is doubled. On the other hand, if the conversion information indicates a female voice to male voice conversion, Pnew is computed by the following relation:

$$Pnew=Pme\times(1/2)$$

Namely, if a female voice is to be converted into a male voice, the pitch of the input voice signal is lowered by one-half.

Figure 36:
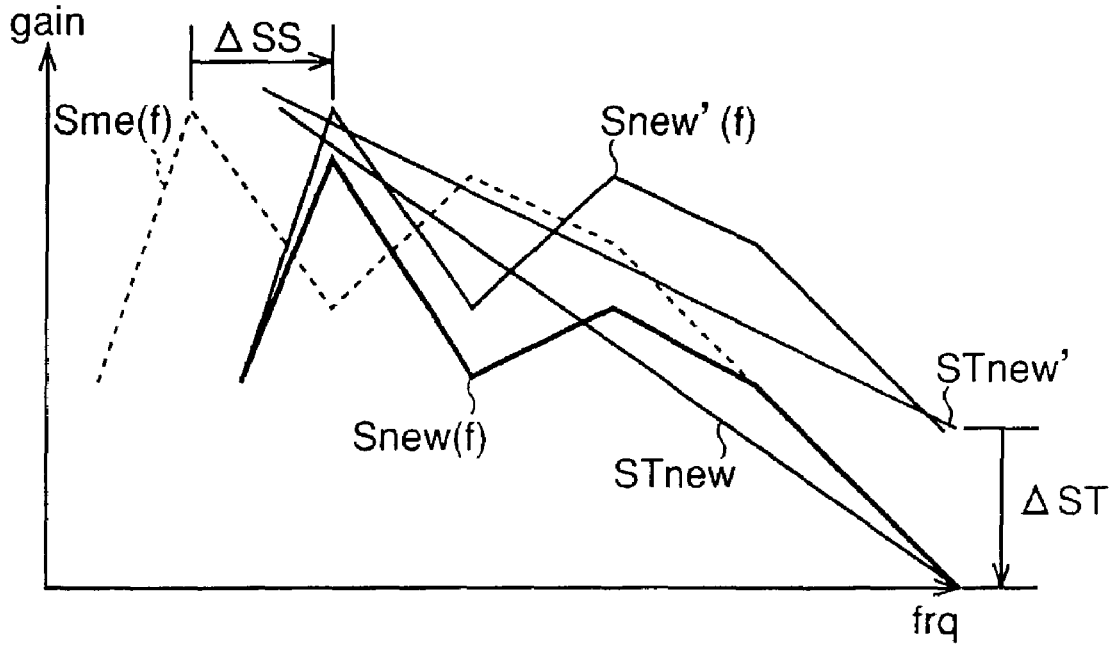
FIG. 36 is a diagram illustrating conversion of a spectral shape.
Figure 37:
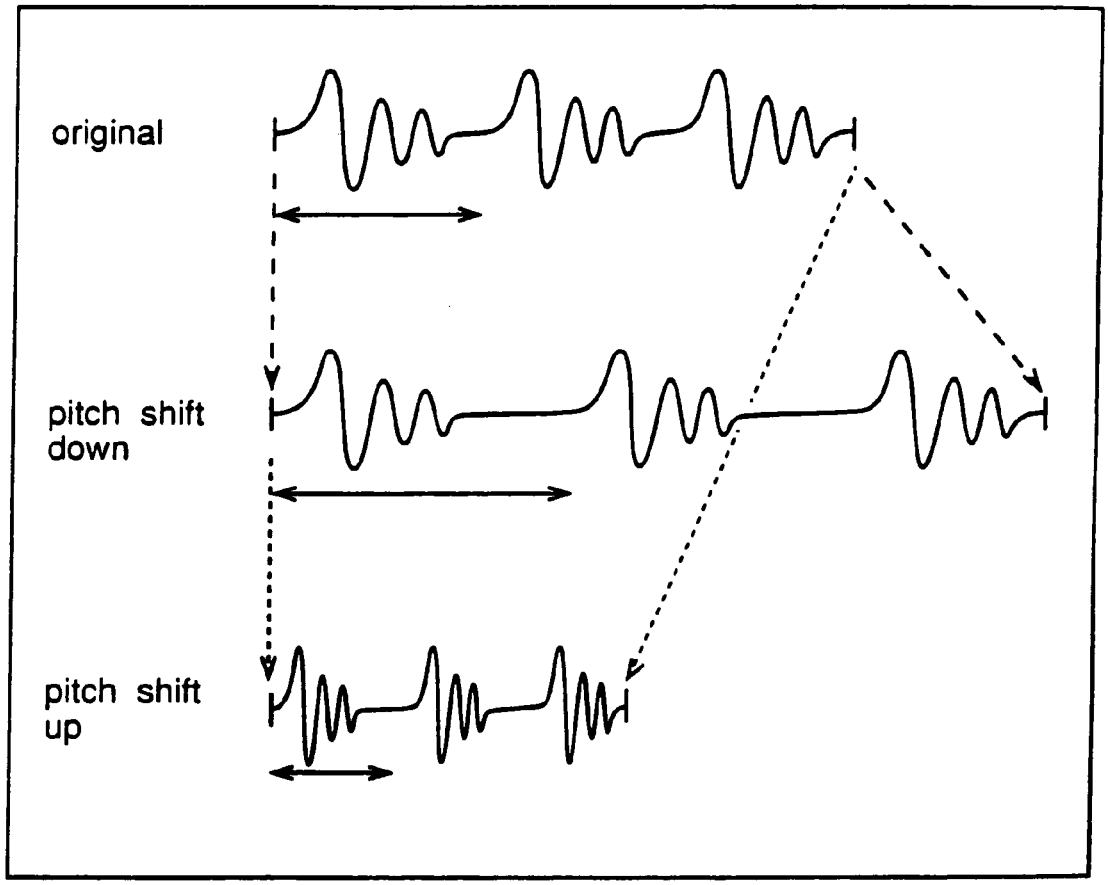
FIG. 37 is a diagram for explaining a conventional voice conversion technique.
Figure 38:
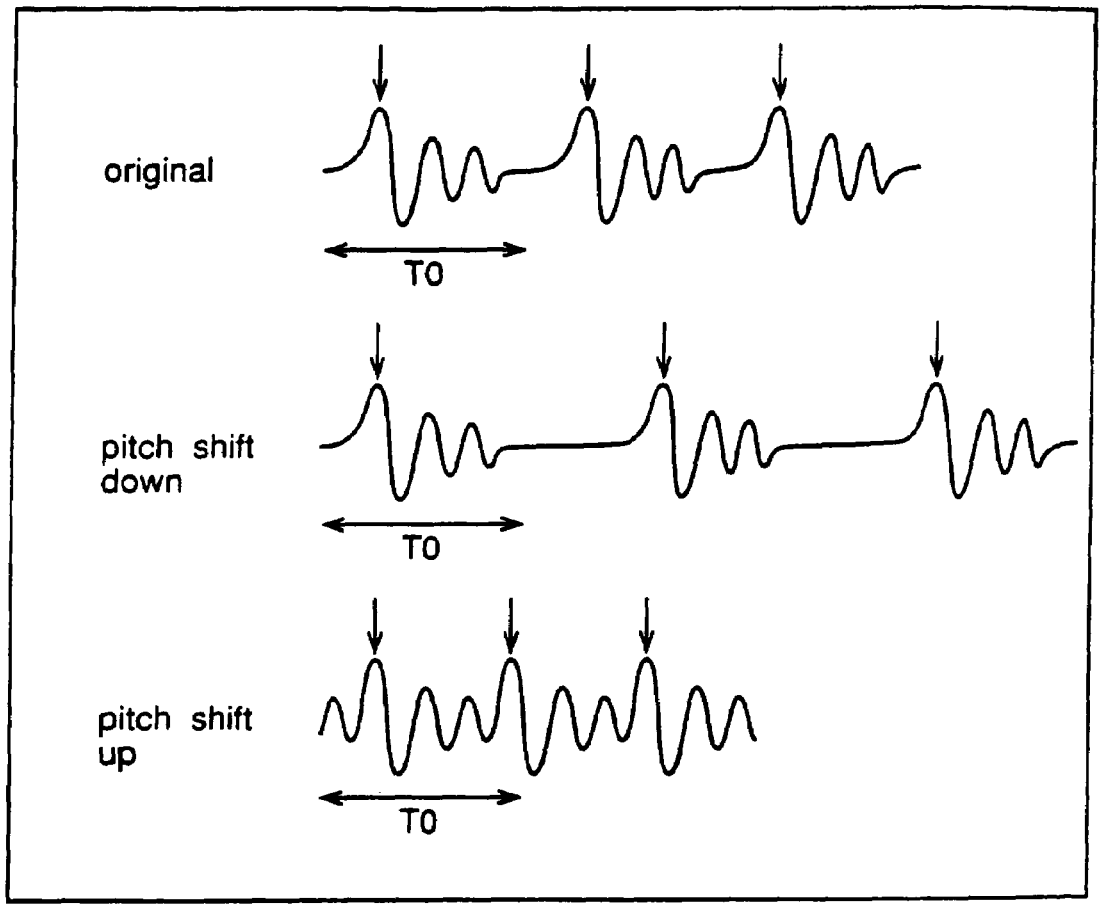
FIG. 38 is a diagram for explaining another conventional voice conversion technique.

Next, based on the new pitch Pnew computed above, the new spectral shape Snew(f) is generated in the manner mentioned in the description of the basic principle. Referring to FIG. 36, generation of the new spectral shape Snew(f) is specifically described. First, the shift amount ΔSS of the spectral shape is computed based on the rate function Tss(P) shown in FIG. 26 and Pnew. As shown in FIG. 36, Snew'(f) is obtained by shifting the spectral shape Sme(f) of the singer by the amount ΔSS along the frequency axis. Further, based on the rate function Tst(P) shown in FIG. 28 and Pnew, the control amount Δst of the spectral tilt is computed to change by the amount Δst the tilt STnew' of the spectral shape Snew'(f) shifted by the shift amount ΔSS. The new spectral shape Snew(f) having the tilt STnew is thus generated (FIG. 36).

Subsequently, a sine wave component generator 120 obtains n number of new sine wave components (f"0, a"0), (f"1, a"1), (f"2, a"2), . . . , (f"(n−1), a"(n−1)) (hereafter collectively represented as f"n, a"n) in the frame concerned based on the new amplitude component Anew, new pitch component Pnew and new spectral shape Snew(f), which have been output from the new information generator 119 (see FIGS. 33 and 34). To be more specific, the new frequency f"n and the new amplitude a"n are obtained by the following relations:

$$f''n=f'n\times Pnew$$

$$a''n=Snew(f''n)\times Anew$$

It should be noted that, if the present model is to be grasped as a model of complete harmonics structure, the following relation is provided:

$f''n=(n+1)\times Pnew$

A sine wave component modifier 121 further executes modification of the obtained new frequency f"n and new amplitude a"n based on the sine wave component conversion information supplied from the controller 123 as required (if any, further modified sine wave components are represented as f'"n, a'"n). For example, only the new amplitudes a"n (=a"0, a"2, a"4, . . . ) of even-numbered harmonic components may be enlarged (e.g., doubled). This provides a further variety to the converted voice.

An inverse FFT block 122 stores the obtained new frequency f'"n, new amplitude a'"n (=new sine wave component) and new residual component Rnew(f) into an FFT buffer to sequentially execute inverse FFT operation. Further, the inverse FFT block 122 partially overlaps the obtained signals along the time axis, and adds them together to generate a converted voice signal, which is a new voice signal. At this moment, a more real voice signal is obtained by controlling the mixing ratio of the sine wave component and the residual component based on the sine wave component/residual component balance control signal supplied from the controller 123. In this case, generally, as the mixing ratio of the residual component gets larger, a coarser the resultant voice.

Next, based on the source unvoice/voice detect signal U/Vme(t) outputted from voice/unvoice detector 106 (FIG. 29), if the input voice signal Sv is in the unvoiced state (U), the cross fader 124 outputs the same to a mixer 300 without change. If the input voice signal Sv is I the voiced state (V), the cross fader 124 outputs the converted voice signal supplied from the inverse FFT block 128 to the mixer 300. In this case, the cross fader 124 is used as a selector switch to prevent a cross fading operation from generating a click noise at switching.

2.2. Details of Constitution and Operation of Sound Generator 200

Next, the constitution and operation of the sound generator 200 are described in detail. The sound generator 200 is constituted of a sequencer 201 and a sound source block 202. The sequencer 201 outputs sound source control information for generating a karaoke accompaniment tone as MIDI (Musical Instrument Digital Interface) data for example to the sound source block 202. This causes the sound source block 202 to generate a sound signal based on the sound source control information. The generated sound signal is output to the mixer 300.

2-3. Operations of Mixer 300 and Output Block 400

The mixer 300 mixes either the input voice signal Sv or the converted voice signal with the sound signal from the sound source block 202 to output a resultant mixed signal to an output block 400. The output block 400 has an amplifier, not shown, which amplifies the mixed signal and outputs the amplified signal as an acoustic signal.

2-4. Summary

According to the present embodiment, attributes of the input tone signal represented by the values on the frequency axis are converted, so that the sine wave components can be converted, thereby enhancing the freedom of voice conversion processing. Further, the conversion amount is determined according to the output pitch, so that a very small conversion amount can easily be controlled according to the output pitch, thereby outputting a more natural voice.

3. Variations

It should be noted that the present invention is not limited to the above-mentioned fourth embodiment, and the following various variations are possible.

In the above-mentioned fourth embodiment, the sine wave components of the input voice signal Sv are converted into a set of new sine wave components by the processing of the new information generator 119 through the sine wave component converter 121. A variation may be made in which they are converted into plural sets of sine wave components. Namely, the output device including the blocks 120-122 produces a plurality of the output voice signals having different pitches, and the modifying device including the block 119 modifies the spectral shape to form a plurality of the new spectral shapes in correspondence with the different pitches of the plurality of the output voice signals. For example, a harmony sound of plural singers may be formed out of the input voice of one singer by generating plural spectral shapes having differences in shift amount of the spectral shape or control amount of the spectral tilt and by generating new sine wave components of a different output pitch for each new spectral shape.

Further, in the above-mentioned fourth embodiment, a processor to supply various effects may be provided downstream of the new information generator 119 of FIG. 29. Namely, conversion may be further executed on the generated new amplitude Anew, new pitch component Pnew and new spectral shape Snew(f) based on the sine-wave component attribute data conversion information supplied from the controller 123 as required. For example, further conversion may be so executed that the spectral shape is made dull throughout the entire length. Alternatively, the output pitch may be modulated by LFO. Namely, the output pitch may be supplied with constant vibration to make a vibrato voice. In this variation, the the inventive apparatus further comprises a vibrating device that periodically varies the specific pitch of the output voice signal. Conversely, the output pitch may be made flat to make voice quality artificial as if a robot were singing. The amplitude may also be modulated by LFO in the same manner, or otherwise the pitch may be made constant. In this case, the inventive apparatus further comprises a vibrating device that periodically varies the specific mean amplitude of the new sinusoidal wave components of the output voice signal.

As for the spectral shape, the shift amount may also be modulated by LFO. This makes it possible to obtain an effect of changing the frequency characteristic periodically. Otherwise, the spectral shape may be compressed or expanded throughout the entire span. In this case, the amount of compression or expansion may be changed according to LFO or the amount of change in pitch or amplitude.

In the above-mentioned fourth embodiment, both the spectral span and the spectral tilt are controlled, but only the spectral span or the spectral tilt may be controlled.

The above-mentioned embodiment takes the male voice to female voice conversion by way of example to describe control processing of the invention. Conversely, the female voice to male voice conversion can also be executed by shifting the spectral shape in the low-frequency direction and by controlling the spectral tilt to make gentle the converted voice. The voice conversion, however, is not limited to such conversions between a male voice and a female voice. It is also practicable to convert the input voice into any other voices having various new spectral shapes such as a neutral voice other than male and female voices, childish voice, mechanical voice and so on.

In the above-mentioned embodiment, the new average amplitude Anew is set identical to the average amplitude Ame of the singer (i.e., Anew=Ame). However, the new average amplitude Anew can also be determined from various other factors. For example, an appropriate average amplitude may be computed according to the output pitch, or determined at random.

In the above-mentioned embodiment, the SMS analysis is used to process the input voice signal on the frequency axis. However, any other signal processing is practicable as long as the signal processing deals with the input signal as a signal represented by combination of sine waves (sine wave components) and residual components other than the sine wave components.

In the above-mentioned embodiment, the spectral shape is converted according to the output pitch. Such conversion to change the voice quality according to the output pitch is not limited to the processing on the frequency axis, and can also be applied to the processing on the time axis. In this case, the amount of change in waveform on the time axis, e.g., the amount of compression or expansion of the waveform may be determined based on a rate function depending on the output pitch. Namely, after the output pitch has been determined, the amount of compression or expansion is computed based on the output pitch and the rate function. The output pitch or the rate functions Tss(f) and Tst(f) may also be changed or adjusted by the controller 123 shown in the above-mentioned embodiment. For example, a handler such as a slider may be provided in the controller 123 as a user control device so that the user can adjust such parameters as desired.

The above-mentioned embodiment executes the above-mentioned processing based on a control program stored in a ROM, not shown. The above-mentioned processing may also be executed based on the control program that has been recorded on a portable storage medium M (shown in FIG. 30) such as a nonvolatile memory card, CD-ROM, floppy disk, magneto-optical disk or magnetic disk, and is transferred to a storage such as a hard disk at a program initiation time. Such a constitution is convenient when another control program is added or installed, or the existing control program is updated or version-upped. Namely, the inventive machine readable medium M is used in the computerized karaoke machine of FIGS. 29 and 30 having a CPU in the controller block 129. The medium M contains program instructions executable by the CPU to cause the computerized karaoke machine for performing a process of converting an input voice signal into an output voice signal by modifying a spectral shape. The inventive process comprises the steps of providing the input voice signal containing wave components, separating sinusoidal ones of the wave components from the input voice signal such that each sinusoidal wave component is identified by a pair of a frequency and an amplitude, computing a spectral shape of the input voice signal based on a set of the separated sinusoidal wave components such that the spectral shape represents an envelope having a series of break points corresponding to the pairs of the frequencies and the amplitudes of the sinusoidal wave components, modifying the spectral shape to form a new spectral shape having a modified envelope, selecting a series of points along the modified envelope of the new spectral shape, generating a set of new sinusoidal wave components each identified by each pair of a frequency and an amplitude, which corresponds to each of the series of the selected points, and producing the output voice signal based on the set of the new sinusoidal wave components. Specifically, the step of producing comprises producing the output voice signal based on the set of the new sinusoidal wave components and residual wave components, which are a part of the wave components of the input voice signal other than the sinusoidal wave components.

A fifth embodiment of the invention will be described in detail by way of example with reference to the accompanying drawings.

1. Constitution of Fifth Embodiment

1-1. Schematic Description of Constitution

Figure 39:
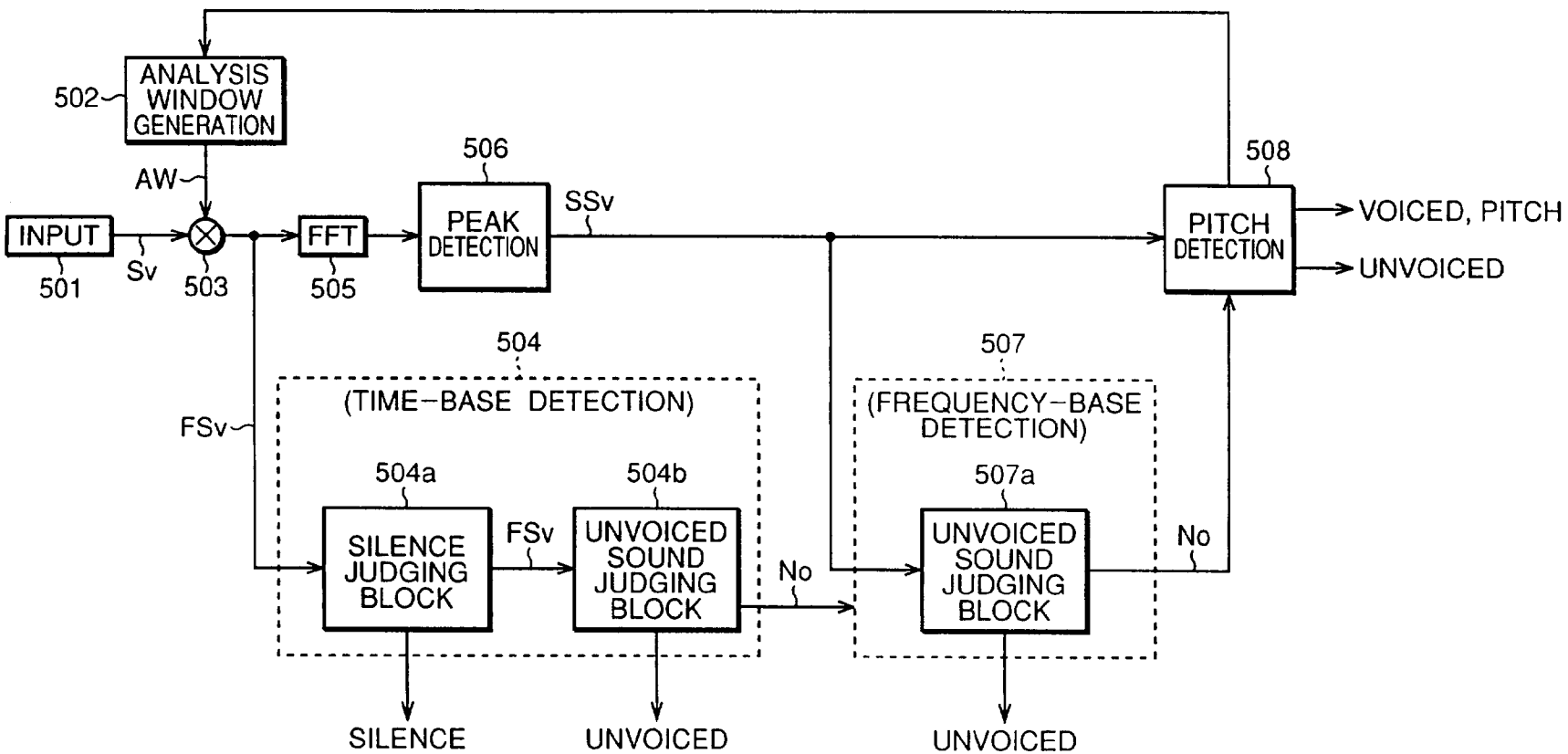
FIG. 39 is a block diagram illustrating a constitution of a fifth embodiment of the invention.

FIG. 39 is a block diagram illustrating a constitution of the fifth embodiment. The present embodiment is constituted as a voice analyzing apparatus, which analyzes an input signal and judges the same to be voiced or unvoiced. As shown in FIG. 39, the voice analyzing apparatus according to the present embodiment is constituted of a microphone 501, an analysis window generator 502, an input voice signal extracting block 503, a time-base detector 504, an FFT 505, a peak detector 506, a frequency-base detector 507 and a pitch detector 508.

In FIG. 39, the microphone 501 picks up the voice of a singer and outputs an input voice signal Sv to the input voice signal extracting block 503. The analysis window generator 502 generates an analysis window (for example, a Hamming window) AW having a period which is a fixed multiplication (for example 3.5 times) of the period of the pitch detected in the last frame, and outputs the generated AW to the input voice signal extracting block 503. It should be noted that, in the initial state or if the last frame is an unvoiced sound (including voiceless), an analysis window having a preset fixed period is output to the input voice signal extracting block 503 as the analysis window AW. The input voice signal extracting block 503 multiplies the input analysis window AW by the input voice signal Sv to extract the input voice signal Sv on a frame basis, outputting the same to the time-base detector 504 and the FFT 505 as a frame voice signal FSv.

The time-base detector 504, though described in detail later, makes a voice/unvoice judgment based on the frame voice signal FSv as time-base data. The time-base detector 504 includes a silence judging block 504*a* and an unvoiced sound judging block 504*b*.

Figure 40:
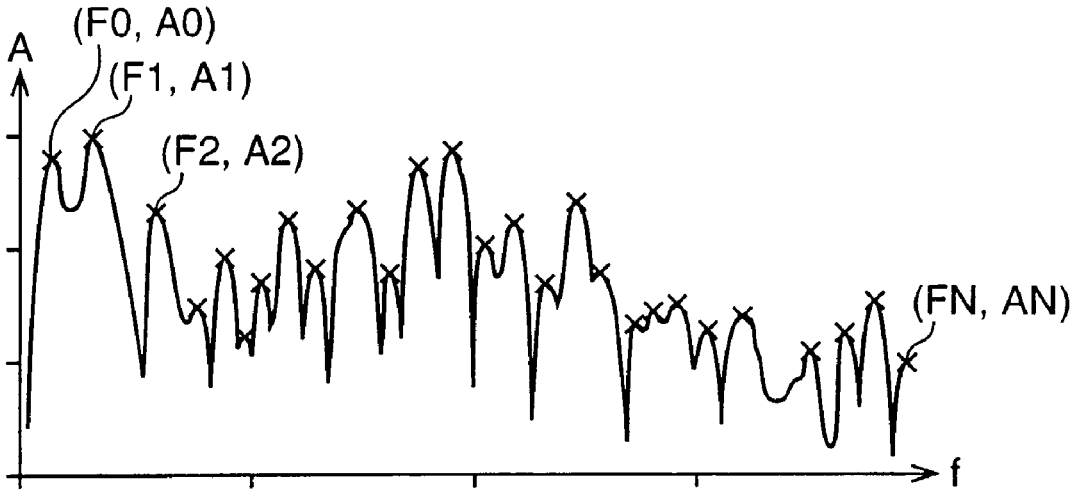
FIG. 40 is a diagram for explaining peak detection for a frequency spectrum.

The FFT 505 analyzes the frame voice signal FSv to output the frequency spectrum to the peak detector 506. The peak detector 506 detects peaks from the frequency spectrum. To be more specific, peaks indicated by "x" are detected with respect to the frequency spectrum shown in FIG. 40. A set of peaks for one frame is data that represent sine waves of the frame by means of the combination of respective frequencies and amplitudes. For frequency components SSv of the frame, the set of peaks is represented as (F0, A0), (F1, A1), (F2, A2), . . . (FN, AN) by means of (frequencies, amplitudes). The extracted data is output to the frequency-base detector 507 and the pitch detector 508.

The frequency-base detector 507, though described in detail later, makes a voice/unvoice judgment based on the input peak set, i.e., data on the frequency axis. The frequency-base detector 507 includes an unvoiced sound judging block 507*a*.

Based on the input peak set, the pitch detector 508 detects the pitch of the frame to which the peak set is belong. Then, the voice/unvoice judgment is made based on whether the pitch is detected or not. To be more specific, if a sequence of peaks constituting the peak set is disposed with periods which are almost integer multiples, the pitch is detected and the sound is judged to be voiced.

Thus, in the present embodiment, the time-base detector 504, the frequency-base detector 507 and the pitch detector 508 can execute voice/unvoice judgment, respectively.

1-2. Details of Detectors

The following describes the time-base detector 504 and the frequency-base detector 507 in more detail.

(1) Time-Base Detector 504

The time-base detector 504 is first described. The time-base detector 504 is to detect a zero crossing factor and an energy factor of the frame voice signal FSv, and is to execute the voice/unvoice judgment. As shown in FIG. 39, the time-base detector 504 includes the silence judging block 504*a* and the unvoiced sound judging block 504*b*.

Figure 41:
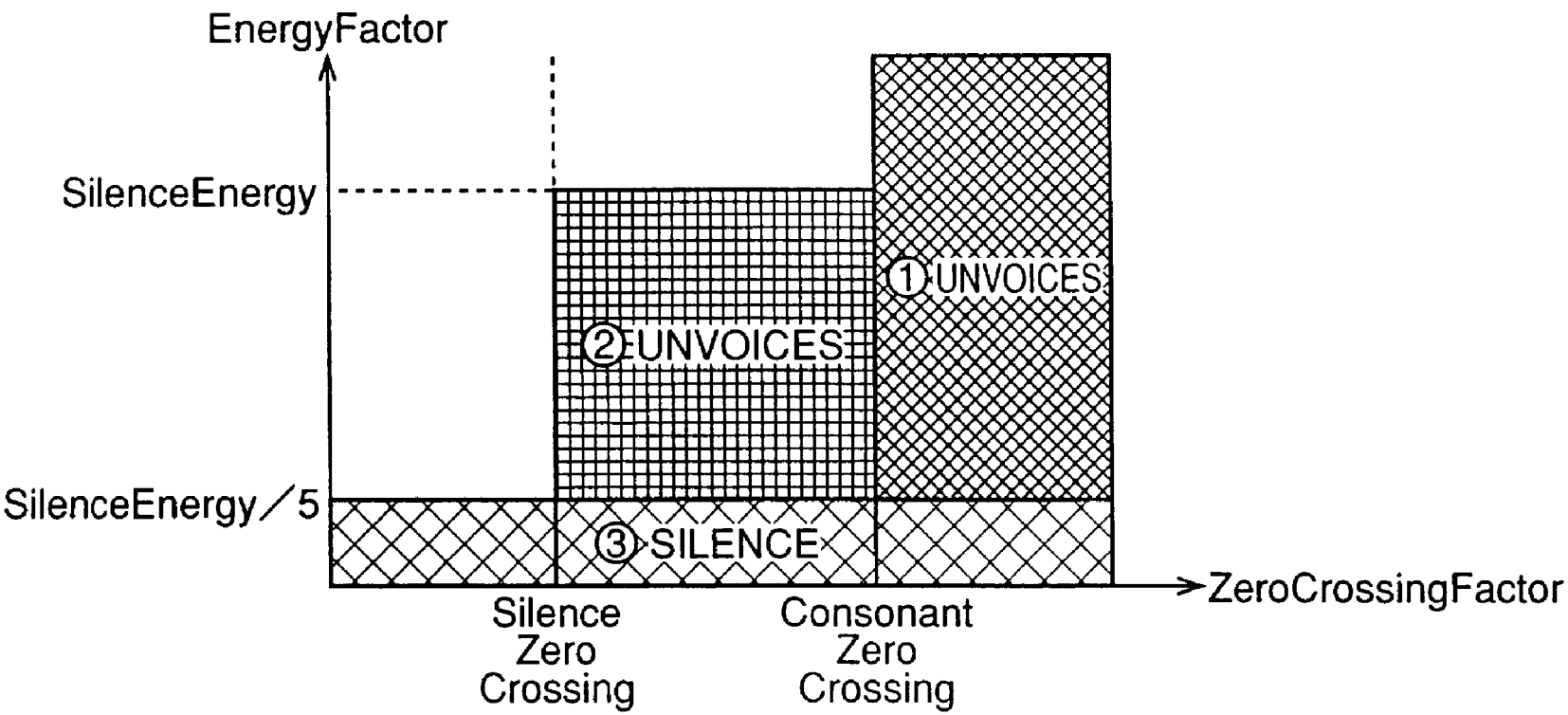
FIG. 41 is a diagram for explaining time-base judgment.

FIG. 41 is a diagram illustrating the principle of the voice/unvoice judgment in the time-base detector 504, choosing energy factor and zero crossing factor as the ordinate and abscissa, respectively. The zero crossing factor is the zero crossing counts per sample number. The zero crossing factor ZCF of the frame concerned is obtained by the following relation:

ZCF=Zero Crossing Counts of the Frame/Number of Samples of the Frame

The energy factor is the average of the absolute values of normalized sample values (amplitude). The energy factor EF of the frame concerned is obtained by the following relation:

EF=Sum of Absolute Values of Normalized Sample Values/Number of Samples of the Frame In the present embodiment, the voice/unvoice judgment is made based on two thresholds on the axis of zero crossing factor, and two thresholds on the axis of energy factor. As shown in FIG. 41, the thresholds on the axis of zero crossing factor are the first zero-crossing threshold represented as Silence Zero Crossing (hereinafter, abbreviated to SZC) and the second zero-crossing threshold represented as Consonant Zero Crossing (hereinafter, abbreviated to CZC). The thresholds on the axis of energy factor are the first energy threshold represented as Silence Energy/5 (hereinafter, abbreviated to SE/5) and the second energy threshold represented as Silence Energy (hereinafter, abbreviated to SE). It should be noted that SE/5 denotes one-fifth the Silence Energy.

Referring to FIG. 41, there are shown a region of ZCF≧CZC (region (1)), a region of SZC≦ZCF<CZC and SE/5≦SE (region (2)) and a region of EF<SE/5 (region (3)). If the zero crossing factor ZCF and the energy factor EF of the frame exist in the region (1), the zero crossing count is regarded as great enough to make a judgment that a strident sound such as "s" exists in the frame, thereby judging the frame to be unvoiced.

Unvoiced sounds have a common characteristic that the energy factor is small. Therefore, even if the zero crossing factor ZCF is not so great that the frame could not be judged to be unvoiced, actually the unvoiced judgment may be made when the energy factor is small enough. Namely, if the zero crossing factor ZCF and energy factor EF of the frame exist in the region (2), the frame is judged to be unvoiced.

If the energy factor is too small, since the voice of the frame cannot be recognized by the hearing sense of human beings, the frame is judged to be silent regardless of the amount of the zero crossing factor. In the present embodiment, the threshold for the silence judgment is set to SE/5. Namely, this setting is based on the assumption that the limit of energy factor on the sounds recognizable by the hearing sense of human beings is around one-fifth the limit of energy factor to the unvoiced sounds. Thus, if the zero crossing factor ZCF and energy factor EF of the frame exist in the region (3), the silence judgment is made.

Namely, the threshold CZC on the axis of zero crossing factor indicates the lower limit of the zero crossing count per sample to the unvoiced judgment on the frame. The threshold SZC on the axis of zero crossing factor indicates the lower limit of the zero crossing count per sample to the possibility of the unvoiced judgment on the frame, though not so high that the frame is judged to be unvoiced, on the condition the energy factor is small enough, i.e., less than the threshold (SE). The threshold SE on the axis of energy factor is the average of the absolute values of normalized sample values, indicating the upper limit to the possibility of the unvoiced judgment on the condition that the zero crossing factor ZCF is equal to or more than the threshold SZC but less than CZC (SZC≦ZCF<CZC). These thresholds CZC, SZC and SE can be experimentally determined. For example, appropriate values are set: 0.25 for CZC, 0.14 for SZC and 0.01 for SE.

Specifically, the above-mentioned voice/unvoice judgment is executed in the time-base detector 504 shown in FIG. 39 as follows: first, the silence judging block 4*a* judges whether or not the zero crossing factor ZCF and energy factor EF of the frame meet EF<SE/5 (region (3) of FIG. 41), and then the unvoiced sound judging block 504*b* judges whether they meet ZCF≧CZC (region (1) of FIG. 41) or SZC≦ZCF<CZC and SE/5<EF<SE (region (2) of FIG. 41).

Namely, the inventive apparatus is constructed for discriminating between a voiced state and an unvoiced state at each frame of a voice signal having a waveform oscillating around a zero level with a variable energy. In the inventive apparatus, a zero-cross detecting device included in the block 504 detects a zero-cross point at which the waveform of the voice signal crosses the zero level and counts a number of the zero-cross points detected within each frame. An energy detecting device included in the block 504 detects the energy of the voice signal per each frame. An analyzing device included in the block 504 is operative at each frame to determine that the voice signal is placed in the unvoiced state, when the counted number of the zero-cross points is equal to or greater than a lower zero-cross threshold SZC and is smaller than an upper zero-cross threshold CZC, and when the detected energy of the voice signal is equal to or greater than a lower energy threshold SE/5 and is smaller than an upper energy threshold SE. specifically, the analyzing device determines that the voice signal is placed in the unvoiced state when the counted number of the zero-cross points is equal to or greater than the upper zero-cross threshold CZC regardless of the detected energy, and determines that the voice signal is placed in a silent state other than the voiced state and the unvoiced state when the detected energy of the voice signal is smaller than the lower energy threshold SE/5 regardless of the counted number of the zero-cross points. Practically, the zero-cross detecting device counts the number of the zero-cross points in terms of a zero-cross factor calculated by dividing the number of the zero-crossing points by a number of sample points of the voice signal contained in one frame, and the energy detecting device detects the energy in terms of an energy factor calculated by accumulating absolute energy values at the sample points throughout one frame and further by dividing the accumulated results by the number of the sample points of the voice signal contained in one frame the. As described above, in the present embodiment, the voice/unvoice judgment is made not only based on the zero crossing count conventionally used, but also by taking into account the energy factor, thereby executing the judgment more accurately (2) Frequency-Base Detector 507

Referring next to FIG. 42, the frequency-base detector 507 is described. As shown in FIG. 39, the frequency-base detector 507 is to make a voice/unvoice judgment based on the peak set detected by the peak detector 506, i.e., based on the frequency components SSv (data on the frequency axis) represented by means of the pairs of frequencies and amplitudes. The frequency-base detector 507 includes a unvoiced sound judging block 507*a*.

Figure 42A:
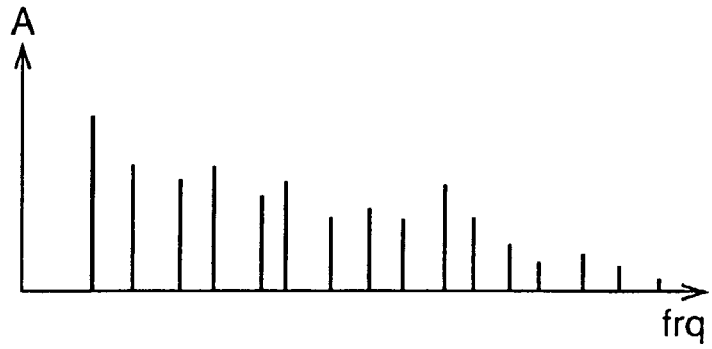
FIG. 42 is a diagram for explaining frequency-base judgment.
Figure 42B:
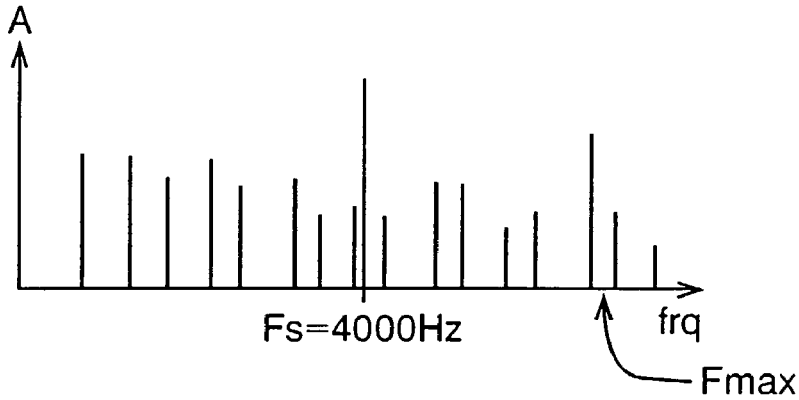
Figure 42C:
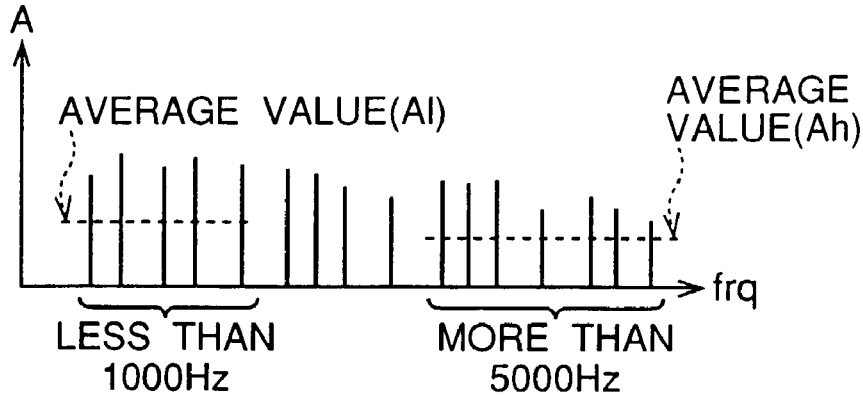

In FIG. 42, there are shown three types of distribution patterns (A), (B) and (C) of the frequency components SSv detected as a result of the peak detection, choosing the amplitude and the frequency as the ordinate and abscissa, respectively. In case of a voiced sound, generally as shown in the chart of FIG. 42(A), the amplitude becomes great for low-frequency components, while it becomes small for high-frequency components. Therefore, in the present embodiment, the voice/unvoice judgment is made by examining the high-frequency components having frequencies higher than a predetermined reference frequency as shown in the charts of FIG. 42(B) and FIG. 42(C). It should be noted that frequency components having frequencies lower than another predetermined reference frequency are called low-frequency components.

Referring to FIG. 42(B), if the frequency Fmax of a frequency component selected out of the frequency components SSv as exhibiting the maximum amplitude is equal to or more than a predetermined reference frequency Fs (Fmax≧Fs), the frame is judged to be unvoiced. Namely, frequency components that belong to a group having the frequency Fs and higher frequencies are regarded as high-frequency components in FIG. 42(B). This is based on the assumption that, if the amplitude set corresponding to the high-frequency components is greater than that of the low-frequency components, the probability of the frame being voiced is low. According to the example of FIG. 42(B), the predetermined reference frequency Fs is set to 4,000 Hz, so that the frame is judged to be unvoiced because the frequency Fmax corresponding to the maximum amplitude is higher than 4,000 Hz.

In FIG. 42(C), the voice/unvoice judgment is made by comparing the average amplitude value Al of the low-frequency components with the average amplitude value Ah of the high-frequency components. This is based on the assumption that, if the average amplitude value of the high-frequency components is great enough, the probability of the frame being voiced is low. According to the example of FIG. 42(C), the average value Al of the frequency components having frequencies of less than 1,000 Hz and the average value Ah of the frequency components having frequencies of more than 5,000 Hz are obtained, and if Ah/Al≧As, the frame is judged to be unvoiced. Here, the value As is a reference value referred to when the frame is judged to be unvoiced or not, and can be preset experimentally. For the reference value, 0.17 is preferred.

Specifically, the above-mentioned voice/unvoice judgment is executed in the unvoiced sound judging block 507*a* of the frequency-base detector 507 shown in FIG. 39 as to whether or not the frequency components SSv of the frame meet Fmax≧Fs (FIG. 42(B)) or Ah/Al≧As (FIG. 42(C)). Namely, the inventive apparatus is constructed for discriminating between a voiced state and an unvoiced state at each frame of a voice signal. In the inventive apparatus, a wave detecting device including the blocks 505 and 506 processes each frame of the voice signal to detect therefrom a plurality of sinusoidal wave components, each of which is identified by a pair of a frequency and an amplitude. A separating device included in the block 507 separates the detected sinusoidal wave components into a higher frequency group and a lower frequency group at each frame by comparing the frequency of each sinusoidal wave component with a predetermined reference frequency Fs. An analyzing device included in the block 507 is operative at each frame to determine whether the voice signal is placed in the voiced state or the unvoiced state based on an amplitude related to at least one sinusoidal wave component belonging to the higher frequency group. Specifically, the analyzing device determines that the voice signal is placed in the unvoiced state when a sinusoidal wave component having the greatest amplitude belongs to the higher frequency group. Further, the analyzing device determines whether the voice signal is placed in the voiced state or the unvoiced state based on a ratio of a mean amplitude of the sinusoidal wave components belonging to the higher frequency group relative to a mean amplitude of the sinusoidal wave components belonging to the lower frequency group. The voice/unvoice judgment can thus be made more accurately by removing unvoiced sounds beforehand as being unlikely to be normal voiced sounds.

2. Operation of the Fifth Embodiment

Figure 43:
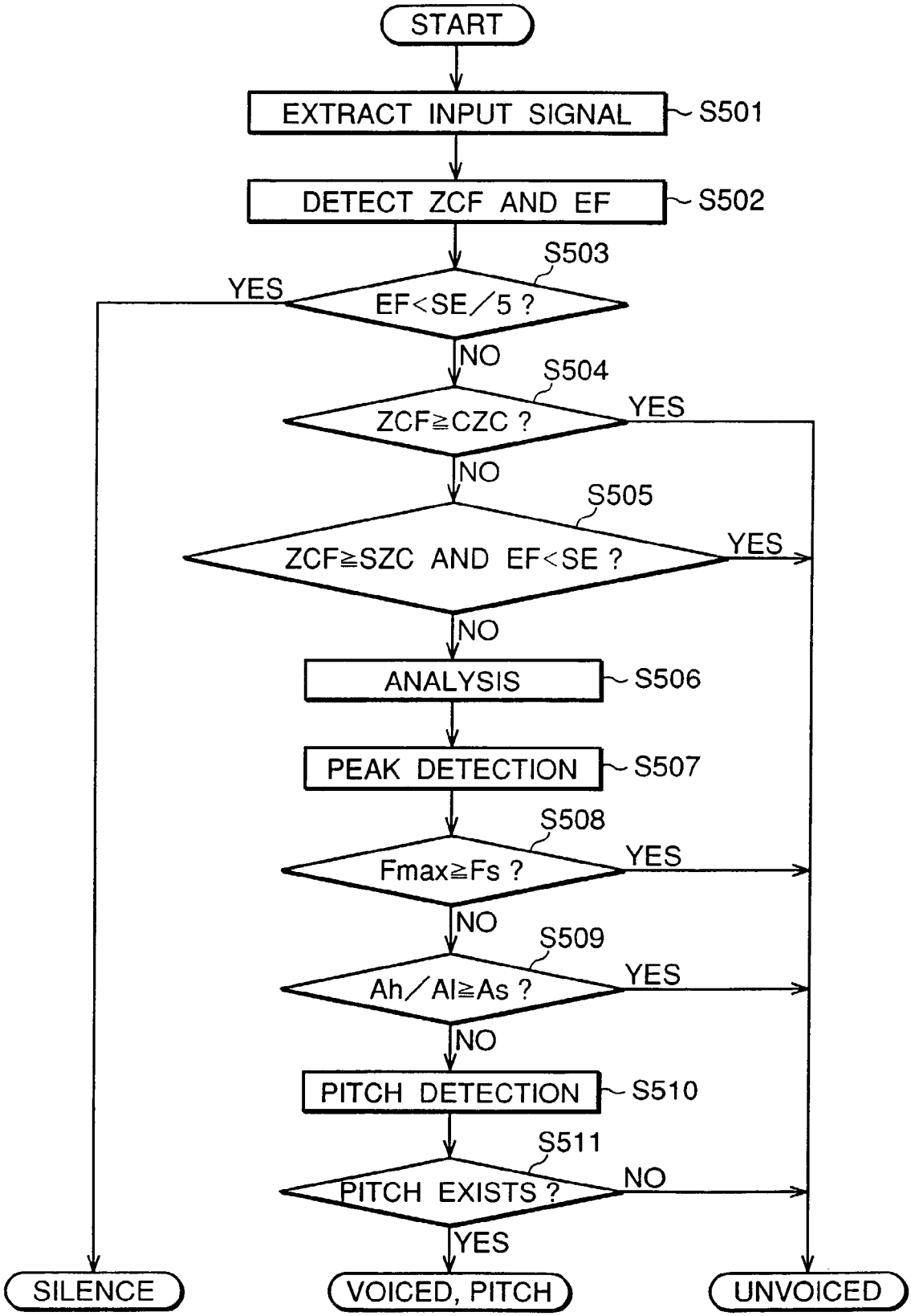
FIG. 43 is a flowchart illustrating operation of the fifth embodiment.

The following describes operation of the fifth embodiment. Description is made with reference to the functional block diagram of FIG. 39 and the flowchart of FIG. 43. First, an input voice signal Sv of a singer, which has been input from the microphone 501, is extracted on a frame basis (S501). Namely, the input voice signal extracting block 503 multiplies the input voice signal Sv by the analysis window AW generated in the analysis window generator 502 to output the same to the time-base detector 504 and the FFT 505 as a frame voice signal FSv.

The time-base detector 504 detects the above-mentioned zero crossing factor ZCF and the energy factor EF based on the frame voice signal FSv input thereto (S502). Then, the silence judging block 504*a* judges whether the detected factors meet EF<SE/5 or not (S503). If the judgment is made in step S503 to meet EF<SE/5 (S503: YES), since the frame voice signal FSv is regarded as falling in the region (3) of FIG. 41, the silence judging block 504*a* judges the voice of the singer to be silent, outputting "Silence" as the detection result.

If the judgment is made in step S503 not to meet EF<SE/5 (S503: NO), the frame voice signal FSv is output to the unvoiced sound judging block 504*b*. The unvoiced sound judging block 504*b* then judges whether or not the zero crossing factor ZCF computed in step S502 is equal to or more than the CZC (ZCF≧CZC) (S504). If the judgment on ZCF is made to be equal to or more than CZC (S504: YES), since the frame voice signal FSv is regarded as falling in the region (1) of FIG. 41, the unvoiced sound judging block 4*b* judges the voice of the singer to be unvoiced, outputting "Unvoiced" as the detection result.

Even if it is judged in step S504 that the zero crossing factor ZCF is less than CZC (S504: NO), the unvoiced sound judging block 504*b* further judges whether or not the zero crossing factor ZCF is equal to and more than SZC and whether the energy factor is less than SE (ZCF≧SZC and EF<SE) (S505). If the judgment is made to meet ZCF≧SZC and EF<SE (S505: YES), since the frame voice signal FSv is regarded as falling in the region (2) of FIG. 41, the unvoiced sound judging block 504*b* judges the frame to be unvoiced, outputting "Unvoiced" as the detection result.

If the judgment is made not to meet ZCF≧SZC and EF<SE (S505: NO), the unvoiced sound judging block 504*b* outputs a notification signal No notifying the FFT 505 that the unvoiced sound judging block 504*b* has not been able to judge the voice of the singer to be unvoiced. Upon receipt of the notification signal No, the FFT 505 analyzes the frame voice signal FSv to output the frequency spectrum to the peak detector 506 (S506). The peak detector 506 detects peaks from the frequency spectrum (S507) to output the peak set to the frequency-base detector 507 and the pitch detector 508 as the frequency components SSv.

The frequency-base detector 507 judges in the unvoiced sound judging block 507*a* whether or not the maximum frequency Fmax of a frequency component selected out of the frequency components SSv as exhibiting the maximum amplitude is equal to or more than the predetermined reference frequency Fs (Fmax≧Fs) (S508). If the judgment is made to meet Fmax≧Fs (S508: YES), since this corresponds to the case shown in FIG. 42(B), the unvoiced sound judging block 507*a* judges the frame to be unvoiced, outputting "Unvoiced" as the detection result.

Even if the judgment is made in step S508 not to meet Fmax≧Fs, the unvoiced sound judging block 507*a* obtains the average amplitude value Al of the low-frequency components (having frequencies of less than 1,000 Hz, for example) and the average amplitude value Ah of the high-frequency components (having frequencies of more than 5,000 Hz, for example) to judge whether Ah/Al≧As is met (S509). If the judgment is made to meet Ah/Al≧As (S509: YES), since this corresponds to the case shown in FIG. 42(C), the unvoiced sound judging block 507*a* judges the frame to be unvoiced, outputting a message "Unvoiced" as the detection result.

If the judgment is made in step S509 not to meet Ah/Al≧As (S509: NO), the frequency-base detector 507 outputs the notification signal No from the unvoiced sound judging block 507*a* to the pitch detector 508. Upon receipt of the notification signal No, the pitch detector 508 executes detection processing for detecting the presence of a pitch based on the frequency components SSv input thereto (S510). The pitch detector 508 then judges whether a pitch exists or not based on the processing result of step S510 (S511). If it is judged that no pitch exists (S511: NO), the pitch detector 508 judges the frame to be unvoiced, outputting the message "Unvoiced" as the detection result. If it is judged in step S511 that a pitch exists (S511: YES), the pitch detector 508 judges the frame to be voiced, outputting not only "Voiced" as the detection result, but also the pitch detected in step S510.

As discussed above, the time-base detector 504 first executes the voice/unvoice judgment based on the three thresholds (CZC, SZC and SE), and even if it has not been able to judge the sound of the singer to be unvoiced, the frequency-base detector 507 can execute a further voice/unvoice judgment, thus gradating the voice/unvoice judgment. In addition, the pitch detector 508 executes the pitch detection and the further voice/unvoice judgment on the frame on which the judgment has been made not to be unvoiced, thereby executing the voice/unvoice judgment more accurately.

3. Variations

It should be noted that the present invention is not limited to the above-mentioned embodiment, and the following various variations are possible. For example, the specific numerical values shown in the above-mentioned fourth embodiment are examples and the present invention is not limited to these values. In the above-mentioned embodiment, a voice signal of each frame is judged by converting the zero crossing count of the frame to the zero crossing factor ZCF. It is also practicable to use any other parameters computed by other computing methods as long as the parameter corresponds to the zero crossing count. For the energy of a voice signal of each frame, any other parameters computed by other computing methods may also be used instead of the energy factor EF as long as the parameter corresponds to the energy.

In the above-mentioned embodiment, the threshold for the unvoiced judgment is set to SE/5, but it is replaceable with any other values, or no need to be fixed values. For example, plural kinds of thresholds may be prepared so that the kind of thresholds can be changed according to the condition in which previous frames are judged to be unvoiced. This variation prevents unnecessary voice/unvoice judgment from being repeated frequently at the time of inputting consecutive frames with energy factors of about SE/5.

The fifth embodiment executes the above-mentioned processing based on a control program stored in a ROM, not shown. The above-mentioned processing may also be executed based on the control program that has been recorded on a portable storage medium such as a nonvolatile memory card, CD-ROM, floppy disk, magneto-optical disk or magnetic disk and is transferred to a storage such as a hard disk at program initiation time. Such a constitution is convenient when another control program is added or installed, or the existing control program is updated for version-up. Namely, the inventive machine readable medium is used in the computerized apparatus having a CPU. The inventive medium contains program instructions executable by the CPU to cause the computerized apparatus for performing a process of discriminating between a voiced state and an unvoiced state at each frame of a voice signal having a waveform oscillating around a zero level with a variable energy. The process comprises the steps of detecting a zero-cross point at which the waveform of the voice signal crosses the zero level so as to count a number of the zero-cross points detected within each frame, detecting the energy of the voice signal per each frame, and determining at each frame that the voice signal is placed in the unvoiced state, when the counted number of the zero-cross points is equal to or greater than a lower zero-cross threshold and is smaller than an upper zero-cross threshold, and when the detected energy of the voice signal is equal to or greater than a lower energy threshold and is smaller than an upper energy threshold. Further, the process comprises the steps of processing each frame of the voice signal to detect therefrom a plurality of sinusoidal wave components, each of which is identified by a pair of a frequency and an amplitude, separating the detected sinusoidal wave components into a higher frequency group and a lower frequency group at each frame by comparing the frequency of each sinusoidal wave component with a predetermined reference frequency, and determining at each frame whether the voice signal is placed in the voiced state or the unvoiced state based on an amplitude related to at least one sinusoidal wave component belonging to the higher frequency group.

As mentioned above and according to the first aspect of the invention, a converted voice reflecting the voice quality and singing mannerism of a target singer may be easily obtained from the voice of a mimicking singer.

As described above, according to the second aspect of the invention, sine wave components and residual components, which are extracted from an input voice signal, are modified based on sine wave components and residual components of a target voice signal, respectively. Then, before the sine wave components and the residual components respectively modified are synthesized with each other, a pitch component and its harmonic components are removed from the residual components. As a result, without impairing the neutrality of the synthesized voice, it is easy to obtain a converted voice from an input voice of a live singer, which reflects the voice quality and vocal manner of a target singer.

As mentioned above and according to the third aspect of the invention, sine wave components and residual components, which are extracted from an input voice signal, are modified based on sine wave components and residual components of a target voice, respectively. Then, before the sine wave components and the residual components are synthesized with one another, a pitch component and its harmonic components are added to the modified residual components. Since a composite voice obtained by the synthesis is thus kept in tune without losing naturalness, a converted voice reflecting the voice quality and singing mannerism of a target singer may be easily obtained from the input voice of a mimicking singer.

As mentioned above and according to the fourth aspect of the invention, the voice quality and pitch can be converted more naturally with high freedom of processing.

As mentioned above and according to the fifth aspect of the invention, the voice/unvoice judgment can be executed accurately.

What is claimed is:

1. An apparatus for converting an input voice signal into an output voice signal by modifying a spectral shape, the apparatus comprising:

an input device that provides the input voice signal containing wave components;

a separating device that separates sinusoidal ones of the wave components from the input voice signal such that each sinusoidal wave component is identified by a pair of a frequency and an amplitude;

a computing device that computes a spectral shape of the input voice signal based on a set of the separated sinusoidal wave components such that the spectral shape represents an envelope having a series of break points corresponding to the pairs of the frequencies and the amplitudes of the sinusoidal wave components, the computing device further computing a spectral tilt of the spectral shape of the input voice signal and computing a modification amount of the spectral tilt of the spectral shape of the input voice signal according to a predetermined pitch of the output voice signal;

a modifying device that modifies the spectral shape to form a new spectral shape representing a modified envelope having a series of new break points by shifting the envelope along an axis of the frequency on a coordinates system of the frequency and the amplitude, the modifying device using a function defining a relation between a modification degree and a pitch, and determining the modification degree of a frequency or an amplitude of each break point of the new spectral shape according to the predetermined pitch of the output voice signal by using the function, the modifying device further modifying the spectral tilt of the new spectral shape by the computed modification amount;

a generating device that determines a series of frequencies according to the predetermined pitch of the output voice signal, and that selects a series of points which are positioned along the modified envelope of the new spectral shape in correspondence to the series of the determined frequencies, but which are different from the series of the new break points of the modified envelope, and that generates a set of new sinusoidal wave components each identified by each pair of a frequency and an amplitude, which corresponds to each of the series of the selected points; and an output device that produces the output voice signal based on the set of the new sinusoidal wave components.

2. The apparatus according to claim 1, wherein the computing device computes the modification amount of the spectral tilt according to a rate function which defines a relationship between the modification amount and the predetermined pitch of the output voice signal.

3. A method of converting an input voice signal into an output voice signal by modifying a spectral shape, the method comprising:

providing the input voice signal containing wave components;

separating sinusoidal ones of the wave components from the input voice signal such that each sinusoidal wave component is identified by a pair of a frequency and an amplitude;

computing a spectral shape of the input voice signal based on a set of the separated sinusoidal wave components such that the spectral shape represents an envelope having a series of break points corresponding to the pairs of the frequencies and the amplitudes of the sinusoidal wave components, and further computing a spectral tilt of the spectral shape of the input voice signal and computing a modification amount of the spectral tilt of the spectral shape of the input voice signal according to a predetermined pitch of the output voice signal;

modifying the spectral shape to form a new spectral shape representing a modified envelope having a series of new break points by shifting the envelope along an axis of the frequency on a coordinates system of the frequency and the amplitude, using a function defining a relation between a modification degree and a pitch, and determining the modification degree of a frequency or an amplitude of each break point of the new spectral shape according to the predetermined pitch of the output voice signal by using the function, and further modifying the spectral tilt of the new spectral shape by the computed modification amount;

determining a series of frequencies according to the predetermined pitch of the output voice signal, and selecting a series of points which are positioned along the modified envelope of the new spectral shape in correspondence to the series of the determined frequencies, but which are different from the series of the new break points of the modified envelope, and generating a set of new sinusoidal wave components each identified by each pair of a frequency and an amplitude, which corresponds to each of the series of the selected points; and producing the output voice signal based on the set of the new sinusoidal wave components.

4. The method according to claim 3, wherein the modification amount of the spectral tilt is computed according to a rate function which defines a relationship between the modification amount and the predetermined pitch of the output voice signal.

5. A machine readable medium used in a computer machine having a CPU, the medium containing program instructions executable by the CPU to cause the computer machine to perform a process of converting an input voice signal into an output voice signal by modifying a spectral shape, the process comprising:

providing the input voice signal containing wave components;

separating sinusoidal ones of the wave components from the input voice signal such that each sinusoidal wave component is identified by a pair of a frequency and an amplitude;

computing a spectral shape of the input voice signal based on a set of the separated sinusoidal wave components such that the spectral shape represents an envelope having a series of break points corresponding to the pairs of the frequencies and the amplitudes of the sinusoidal wave components, and further computing a spectral tilt of the spectral shape of the input voice signal and computing a modification amount of the spectral tilt of the spectral shape of the input voice signal according to a predetermined pitch of the output voice signal;

modifying the spectral shape to form a new spectral shape representing a modified envelope having a series of new break points by shifting the envelope along an axis of the frequency on a coordinates system of the frequency and the amplitude, using a function defining a relation between a modification degree and a pitch, and determining the modification degree of a frequency or an amplitude of each break point of the new spectral shape according to the predetermined pitch of the output voice signal by using the function, and further modifying the spectral tilt of the new spectral shape by the computed modification amount;

determining a series of frequencies according to the predetermined pitch of the output voice signal, and selecting a series of points which are positioned along the modified envelope of the new spectral shape in correspondence to the series of the determined frequencies, but which are different from the series of the new break points of the modified envelope, and generating a set of new sinusoidal wave components each identified by each pair of a frequency and an amplitude, which corresponds to each of the series of the selected points; and producing the output voice signal based on the set of the new sinusoidal wave components.

6. The machine readable medium according to claim 5, wherein, in the computing step of said process, the modification amount of the spectral tilt is computed according to a rate function which defines a relationship between the modification amount and the predetermined pitch of the output voice signal.

7. A method of generating a female voice signal from a male voice signal by modifying a spectral shape, the method comprising:

providing the male voice signal containing wave components;

separating sinusoidal ones of the wave components from the male voice signal such that each sinusoidal wave component is identified by a pair of a frequency and an amplitude;

computing a spectral shape of the male voice signal based on a set of the separated sinusoidal wave components such that the spectral shape represents an envelope having a series of break points corresponding to the pairs of the frequencies and the amplitudes of the sinusoidal wave components, and further computing a spectral tilt of the spectral shape of the male voice signal as a straight line that is approximated to the respective amplitudes of the sinusoidal wave components and computing a modification amount of the spectral tilt according to a rate function which defines a relationship between the modification amount and a predetermined pitch of the female voice signal;

modifying the spectral shape to form a new spectral shape representing a modified envelope having a series of new break points by shifting the envelope along an axis of the frequency on a coordinates system of the frequency and the amplitude, using a function defining a relation between a modification degree and a pitch, and determining the modification degree of a frequency or an amplitude of each break point of the new spectral shape according to the predetermined pitch of the female voice signal by using the function, and further modifying the spectral tilt of the new spectral shape of the male voice signal by the computed modification amount to a spectral tilt for the female voice signal said spectral tilt of the female voice signal having a slope larger than a slope of the spectral tilt of the male voice signal;

determining a series of frequencies according to the predetermined pitch of the female voice signal, and selecting a series of points which are positioned along the modified envelope of the new spectral shape in correspondence to the series of the determined frequencies, but which are different from the series of the new break points of the modified envelope, and generating a set of new sinusoidal wave components each identified by each pair of a frequency and an amplitude, which corresponds to each of the series of the selected points; and producing the female voice signal based on the set of the new sinusoidal wave components.

8. A machine readable medium used in a computer machine having a CPU, the medium containing program instructions executable by the CPU to cause the computer machine to perform a process of generating a female voice signal from a male voice signal by modifying a spectral shape, the process comprising:

providing the male voice signal containing wave components;

separating sinusoidal ones of the wave components from the male voice signal such that each sinusoidal wave component is identified by a pair of a frequency and an amplitude;

computing a spectral shape of the male voice signal based on a set of the separated sinusoidal wave components such that the spectral shape represents an envelope having a series of break points corresponding to the pairs of the frequencies and the amplitudes of the sinusoidal wave components, and further computing a spectral tilt of the spectral shape of the male voice signal as a straight line that is approximated to the respective amplitudes of the sinusoidal wave components and computing a modification amount of the spectral tilt according to a rate function which defines a relationship between the modification amount and a predetermined pitch of the female voice signal;

modifying the spectral shape to form a new spectral shape representing a modified envelope having a series of new break points by shifting the envelope along an axis of the frequency on a coordinates system of the frequency and the amplitude, using a function defining a relation between a modification degree and a pitch, and determining the modification degree of a frequency or an amplitude of each break point of the new spectral shape according to the predetermined pitch of the female voice signal by using the function, and further modifying the spectral tilt of the new spectral shape of the male voice signal by the computed modification amount to a spectral tilt for the female voice signal said spectral tilt of the female voice signal having a slope larger than a slope of the spectral tilt of the male voice signal;

determining a series of frequencies according to the predetermined pitch of the female voice signal, and selecting a series of points which are positioned along the modified envelope of the new spectral shape in correspondence to the series of the determined frequencies, but which are different from the series of the new break points of the modified envelope, and generating a set of new sinusoidal wave components each identified by each pair of a frequency and an amplitude, which corresponds to each of the series of the selected points; and producing the female voice signal based on the set of the new sinusoidal wave components.

9. An apparatus for converting a male voice signal into a female voice signal by modifying a spectral shape, the apparatus comprising:

an input device that provides the male voice signal containing wave components;

a separating device that separates sinusoidal ones of the wave components from the male voice signal such that each sinusoidal wave component is identified by a pair of a frequency and an amplitude;

a computing device that computes a spectral shape of the male voice signal based on a set of the separated sinusoidal wave components such that the spectral shape represents an envelope having a series of break points corresponding to the pairs of the frequencies and the amplitudes of the sinusoidal wave components, the computing device further computing a spectral tilt of the spectral shape of the male voice signal as a straight line that is approximated to the respective amplitudes of the sinusoidal wave components and computing a modification amount of the spectral tilt according to a rate function which defines a relationship between the modification amount and a predetermined pitch of the female voice signal;

a modifying device that modifies the spectral shape to form a new spectral shape representing a modified envelope having a series of new break points by shifting the envelope along an axis of the frequency on a coordinates system of the frequency and the amplitude, the modifying device using a function defining a relation between a modification degree and a pitch, and determining the modification degree of a frequency or an amplitude of each break point of the new spectral shape according to the predetermined pitch of the female voice signal by using the function, the modifying device further modifying the spectral tilt of the new spectral shape of the male voice signal by the computed modification amount to a spectral tilt for the female voice signal said spectral tilt of the female voice signal having a slope larger than a slope of the spectral tilt of the male voice signal;

a generating device that determines a series of frequencies according to the predetermined pitch of the female voice signal, and that selects a series of points which are positioned along the modified envelope of the new spectral shape in correspondence to the series of the determined frequencies, but which are different from the series of the new break points of the modified envelope, and that generates a set of new sinusoidal wave components each identified by each pair of a frequency and an amplitude, which corresponds to each of the series of the selected points; and an output device that produces the female voice signal based on the set of the new sinusoidal wave components.

* * * * *